US006116716A

United States Patent [19]

Tajika et al.

[11] Patent Number: 6,116,716

[45] Date of Patent: Sep. 12, 2000

[54] METHOD FOR STANDARDIZING AN INK JET RECORDING HEAD AND AN INK JET RECORDING HEAD FOR ATTAINING SUCH STANDARDIZATION, INK JET RECORDING METHOD, AND INFORMATION PROCESSING APPARATUS, AND HOST APPARATUS

[75] Inventors: Hiroshi Tajika; Mikio Shiga, both of Yokohama; Hiroyuki Ishinaga; Shinya Matsui, both of Tokyo; Akira Nagatomo, Yokohama; Toshio Kashino, Chigasaki; Tetsushi Kohno, Tokyo; Yoshie Asakawa, Nagano-ken, all of Japan

[73] Assignee: Canon Kabushiki Kaisha, Tokyo, Japan

[21] Appl. No.: 08/891,974

[22] Filed: Jul. 11, 1997

[30] Foreign Application Priority Data

Jul. 12, 1996 [JP] Japan ..... 8-183855
Jul. 12, 1996 [JP] Japan ..... 8-183856

[51] Int. Cl.[7] ..... B41J 29/393

[52] U.S. Cl. ..... 347/19; 347/49

[58] Field of Search ..... 347/5, 9, 19, 49, 347/50, 65

[56] References Cited

U.S. PATENT DOCUMENTS

| | | | |
|---|---|---|---|
| 4,803,500 | 2/1989 | Milbrandt | 347/49 |
| 4,872,027 | 10/1989 | Buskirk et al. | 347/19 |
| 5,049,904 | 9/1991 | Nakamura et al. | 347/19 |
| 5,289,210 | 2/1994 | Takayanagi | 347/19 X |
| 5,638,097 | 6/1997 | Takayanagi et al. | 347/19 X |
| 5,668,582 | 9/1997 | Manzone et al. | 347/49 |
| 5,684,518 | 11/1997 | Nobel et al. | 347/50 |
| 5,821,962 | 10/1998 | Kudo et al. | 347/65 |
| 5,886,726 | 3/1999 | Pawelka et al. | 347/49 X |
| 5,903,285 | 5/1999 | Ju et al. | 347/5 |

*Primary Examiner*—William J. Royer
*Attorney, Agent, or Firm*—Fitzpatrick, Cella, Harper & Scinto

[57] ABSTRACT

A method for standardizing an ink jet recording head is arranged to be capable of utilizing the characteristics of each of recording heads to the maximum, while maintaining the compatibility between them. Particularly, the compatibility is maintained between the novel type recording head whose interior is partitioned into two layers through movable members, and a conventional type recording head. When the conventional type recording head is mounted on a novel type recording apparatus, all the requirements are handled by the novel type recording apparatus side to drive the conventional type recording head under a condition regulated for the conventional type recording head. When the novel type recording head is mounted on a conventional type recording apparatus, it is driven within the capacity of performance of the conventional type recording apparatus. A discriminator for discriminating the kind of mounted recording head is provided for each of the recording apparatuses. In this way, various control operations are attained. When the structure is arranged to use separate recording heads and ink tanks, the compatibility is maintained, while utilizing the difference in characteristics of the novel type recording head and ink, and those of the conventional type recording head and ink to the maximum by means of discriminating one kind of ink from another.

41 Claims, 26 Drawing Sheets

FIG. 25

RECORDING MODE

- ORDINARY MODE
- PICTORIAL MODE 1
- PICTORIAL MODE 2
- BLACK AND WHITE MODE

FIG. 26

PLEASE MOUNT HEAD CARTRIDGE FOR
PICTORIAL MODE 1
CURRENT HEAD CARTRIDGE ORDINARY MODE

FIG. 27

PLEASE SET PLAIN PAPER,
COATED PAPER OR PICTORIAL PAPER

METHOD FOR STANDARDIZING AN INK JET RECORDING HEAD AND AN INK JET RECORDING HEAD FOR ATTAINING SUCH STANDARDIZATION, INK JET RECORDING METHOD, AND INFORMATION PROCESSING APPARATUS, AND HOST APPARATUS

BACKGROUND OF THE INVENTION

1. Field of the Invention

The present invention relates to an ink jet recording system for recording by discharging ink droplets onto a recording medium. More particularly, the invention relates to a method for standardizing an ink jet recording head and an ink tank, using different discharging principles, to be made capable of maintaining compatibility between plural kinds of ink jet recording heads having different recording characteristics and operational characteristics, respectively, and a recording head, an ink jet recording method, and an information processing apparatus using such a standardizing method.

2. Related Background Art

A recording apparatus, which is used as output equipment for a printer, a copying machine, facsimile equipment, or a complex electronic equipment or work station including a computer, word processor, or the like, is structured to record images on a recording material (a recording medium), such as a paper sheet, thin plastic sheet, in accordance with image information. Depending on the method for forming images on a recording medium, recording apparatuses are classified into those using an ink jet method, a wire-dot method, a thermal method, and a laser beam method, among some others. Also, such classification is possible in accordance with scanning methods adopted for image recording.

For a serial type recording apparatus, which adopts a serial scanning method where main scanning is performed in a direction intersecting the conveying direction of a recording medium (sub-scanning direction), images are recorded (main scanned) by recording means mounted on a carriage that travels along the recording medium. After one line portion of recording is over, the recording sheet is carried by a given amount (pitch conveyance). After that, recording (main scanning) is resumed for images on the next line on the recording material whose feeding has come to a stop again. This operation is repeated to record on the entire recordable area of the recording material. On the other hand, for a line type recording apparatus, which records on a recording material by recording made only by sub-scanning in the conveying direction of the recording material, the recording material is set at a given recording position, and then, after one line portion is recorded altogether, a sheet feeding (pitch conveyance) operation is performed by a given amount. Further, images on the next line are recorded altogether. This operation is repeated to record on the entire recordable area of the recording material.

Of the recording apparatuses described above, the ink jet recording apparatus is to record by discharging ink from recording means (recording head) onto a recording material. The recording means is easily made compact to record highly precise images at high speeds. It is also possible for this apparatus to record on an ordinary paper sheet without any particular treatment given to it, which contributes to making its running costs lower. Also, with a non-impact method, its noises are lower. There is also an advantage, among others, that it is easy to record in colors using ink of different colors. Of these apparatuses, the line type ink jet apparatus, which is provided with many numbers of nozzles arranged in the sheet width direction, makes it possible to record at higher speeds. Particularly, among those having ink jet recording means, the apparatus that utilizes thermal energy for discharging ink makes it easy to manufacture a head provided with a highly densified arrangement of liquid flow paths (discharge port arrangement) by forming electrothermal transducing elements, electrodes, liquid flow paths, a ceiling plate, and others on an elemental substrate through the process of semiconductor manufacture, such as etching, deposition, spattering, and others. As a result, a head of this type can be made compact.

FIG. 1 is a perspective view which shows the structure of the conventional ink jet recording apparatus of this type. The ink jet recording apparatus comprises, broadly, a sheet feeding unit 20 that stacks paper sheets, sheet materials, or other recording media; a carriage unit 5 having a platen 39 for carrying and exhausting a recording medium, a feed roller, and an exhaust roller; a carriage unit that mounts a recording head 7 on it for recording; and a cleaning unit 6 for performing a recovery operation to clean the recording head 7 mounted on the carriage unit 5.

The cleaning unit 6 comprises a pump 60 for cleaning the recording head 7; a cap 61 for capping the recording head 7 in order to prevent the recording head 7 from drying out; and a driving change over arm 62 that switches the driving force from the carrier roller 36 to the sheet feeding unit 20 or to the pump 60. The driving change over arm 62 is arranged to fix a planet gear (not shown) that rotates centering on the shaft of the carrier roller 36 in a given position at a time other than sheet feeding or cleaning. Then, no driving force of the carrier roller 36 is transmitted to the sheet feeding unit 20 and the pump 60. When the carriage 50, which will be described later, travels, the driving change over arm 62 shifts in the direction indicated by an arrow A in FIG. 1. Then, the planet gear is freed. The planet gear shifts following the regular rotation or reverse rotation of the carrier roller 36. It is thus arranged that when the carrier roller rotates regularly, the driving force is transmitted to the sheet feeding unit 20. When the carrier roller rotates reversely, the driving force is transmitted to the pump 60. If no recording is performed or if the apparatus is left intact for a long time, the viscosity of ink in the discharge ports of the recording head 7 becomes high to cause defective discharging or some other unfavorable operations. Therefore, the discharge port surface of the recording head 7 is capped by the cap 61, and then, the interior of the cap 61 is sucked by means of the pump 60 to remove ink remaining in the discharge ports, the viscosity of which has become high, in order to recover the discharging performance of the recording head 7.

The carriage unit 5 is provided with a carriage 50 serving as means for attaching and detaching the recording head 7, which is arranged to be detachably mountable. The carriage 50 is slidably fitted over a guide shaft 81 and a guide rail 82 fixed to a chassis 8 in a direction at right angles to the carrying direction of the sheet material. Also, the carriage 50 is coupled to one position of a timing belt 83 tensioned around a pulley fixed to the output shaft of a carriage motor and an idle pulley 84 rotatively and axially supported. Then, the structure is arranged to enable the recording head 7 to reciprocate by the driving force of the carriage motor in the directions along the guide shaft 81.

Now, a description will be provided of the recording head 7 to be mounted on the carriage 50. FIGS. 2A, 2B, 2C and 2D are views which illustrate the recording head 7 formed integrally with an ink tank. Here, FIG. 2A is a view which shows the right side thereof. FIG. 2B shows the bottom thereof. FIG. 2C is the front view. FIG. 2D is a view which shows the left side thereof.

The recording head 7 is of a cartridge type, which is formed integrally with an ink tank 73 that retains ink to be supplied to the head unit 71, and which discharges ink downward in FIG. 2A. A sponge having ink impregnated in it is stuffed in the ink tank 73. The head unit 71 comprises an aluminum base plate 72, a silicon plate, a head substrate, a liquid chamber retaining ink temporarily, an ink filter, an ink supply tube 80 to supply ink from the ink tank 73 to the liquid chamber, and some others. The silicon plate and the head substrate are arranged on the base plate 72. For the silicon plate, a plurality of nozzles (discharge ports) 70 are arranged in a line in a density of 360 nozzles/inch. At the same time, heater elements, electrodes, and electric wires are formed on it to generate thermal energy for use of ink discharge. The arrangement direction of the discharge ports 70 is inclined at an angle of 1 to 4 degrees to a direction perpendicular to the main scanning direction of the recording head 7 for reasons derived from its driving. As a result, the head unit 71 is installed with an inclination with respect to the ink tank 73.

Here, the details of the structure of the head unit 71 will be described. FIG. 3 is a perspective view which shows the vicinity of the discharge ports 70 of the head unit 71. For the head unit 71, a plurality of discharge ports 70 are formed at given pitches on the discharge port surface 70*a* arranged to face the recording medium at a given gap. Along the wall surface of each of the liquid flow paths 70*d*, which is conductively connected with the common liquid chamber 70*c* and each of the discharge ports 70, each of the electrothermal transducing elements (heat generating resistor or the like) 70*e* is arranged to generate energy for use in ink discharge. The common liquid chamber 70*c* is conductively connected with the ink tank 73 (see FIGS. 2A to 2D). Here, the structure is arranged to supply ink from the ink tank 73 to the common liquid chamber 70*c*. Ink, which is supplied from the ink tank 73 and temporarily retained in the common liquid chamber 70*c*, is caused to flow in the liquid flow path 70*d* by means of capillary phenomenon, thus forming a meniscus at each discharge port 70*b*. The liquid flow path 70*d* is then conditioned to be filled with ink. At this juncture, when the electrothermal transducing element is energized to generate heat in accordance with recording signals, which are electric signals, ink on the electrothermal transducing element 70*e* is heated abruptly to generate film boiling for the creation of air bubbles in the liquid flow path 70*d*. By the expansion of the air bubbles, ink is discharged from the discharge port 70. Here, for the energy generating element that generates thermal energy, the electro-thermal transducing element is shown. However, such an element is not necessarily limited to it. A piezo-electric element may be used for exerting discharging pressure instantaneously by means of mechanical energy generated by this element. In this respect, electric signals, which are used for energizing each of the electrothermal transducing elements 70*e*, are provided by a printed-circuit board (not shown) that controls the operation of the recording apparatus through a flexible base board 56 (see FIG. 1) arranged for the carriage 50.

Now, the fundamental structure of the recording head has been described. However, in recent years, the structure generally adopted uses an ink tank that is made separable from a recording head in order to replace only the ink tanks, because there is more demand on the mixed use of the color recording and monochromatic recording or because the life of the recording head has been made longer. The present invention is designed to deal with such recording heads of the type that the ink tank is made separable, with the objectives being focused on the maintenance of compatibility between such heads. Hereinafter, a description will be provided of a recording head structured to be capable of exchanging ink tanks.

As shown in FIGS. 4A to 4C, the recording head 170 that can exchange ink tanks has the nozzle unit 171 for discharging ink, which is installed on the holder 173 together. FIG. 4A is a front view; FIG. 4B, a side view; and FIG. 4C, a bottom view, respectively. The holder 173 is a housing provided with an aperture on approximately ⅔ from the top of the front and on the upper surface. At the same time, the holder is partitioned into two portions by means of an inner plate 174. In each of the portions thus arranged, a black ink tank 175 for retaining black ink, and a color ink tank 176 for retaining three colors of ink of yellow, cyan, and magenta are detachably held, respectively. In this way, color recording is made possible, while saving space.

The attachment and detachment of the black ink tank 175 and the color ink tank 176 to and from the holder 173 are executed through the aperture of the holder 173 described above. Also, in the same manner as arranged for the recording head shown in FIGS. 2A to 2D, a stepped guide 74 is provided for the side of this holder, which is guided by the guide arm 513 (see FIG. 7A) when the holder is mounted on the head holder 51 (see FIGS. 6A and 6B). The holder is also provided with a contact surface 78, which serves as an electric contact means for making connection with the contact unit 561 (see FIG. 9) of the carriage 50 side, as well as a stopper 179. If the recording head is not placed in its regular position, the contact surface 78 and the contact unit 561 on the carriage 50 side are prevented from abutting upon other members.

The nozzle unit 171 is divided into the discharge port group 370B for use of black ink, the discharge port group 370Y for use of yellow ink, the discharge group 370C for use of cyan ink, and the discharge port group 370M for use of magenta ink corresponding to each color ink, respectively. Ink is supplied to each of the discharge port groups 370B, 370Y, 370C, and 370M through each of the ink supply tubes 306B, 306Y, 306C and 306M, which is dedicated to each of the groups, respectively. An ink lead out tube, which protrudes into the interior of the holder 173, is provided for each of the ink supply tubes 306B, 306Y, 306C, and 306M. Then, the structure is arranged to supply ink retained in each of the ink tanks 175 and 176 to the nozzle unit 171 through the respective ink lead out tubes and ink supply tubes 306B, 306Y, 306C and 306M when the black ink tank 175 and the color ink tank 176 are mounted on the holder 173.

Also, FIGS. 5A and 5B are views which show the method for installing each of the ink tanks 175 and 176 on the recording head 170. For each of the ink tanks 175 and 176, apertures 181 and 182 are arranged to supply ink to the recording head 170 side. Particularly, for the color ink tank 176, three apertures 182 are arranged with respect to each of the colors, yellow, magenta, and cyan. These apertures 181 and 182 are in contact with the leading end of the ink lead out tubes when the ink tanks 175 and 176 are installed on the holder 173. Then, ink flows into each of the ink lead out tubes.

The recording head 7 (FIGS. 2A to 2D) or the recording head 170 (FIGS. 4A to 4C) thus structured is installed on the carriage unit 5 of the ink jet recording apparatus, and driven in the main scanning direction. Now, in conjunction with FIGS. 6A, 6B, 7A, 7B, 8 and 9, a description will be provided of the carriage unit 5. The recording head 7 and the recording head 170 are provided with the installation unit structured in the same manner with respect to the carriage unit 5. The description given below is applicable to both the recording head 7 and the recording head 170 alike. In this respect, the description is provided of the recording head 170 of a type where the ink tank is separately arranged as the representative example hereof.

The attachment unit of the recording head 170 comprises the carriage 50, head holder 51, base cover 52, hook lever 53, contact spring 54, hook cover 55, flexible base board 56, and rubber pad 57 with respect to the carriage unit 5.

Here, FIG. 6A is a view which shows the process in which the head is mounted on the carriage. FIG. 6B is a view which shows the state after the head is mounted.

As shown in FIG. 6A and FIG. 6B, the recording head 170 is mounted on the head holder 51 along the guide 501 arranged for the carriage 50. The structure is then arranged to enable the holder to slide to the left-hand and right-hand sides. The head holder 51 is provided with the guide unit 511 for guiding the recording head 170; the contact surface 503 of the side plate 502 that stands vertically on the carriage 50; and the pressure unit 512 that presses the recording head 170 to the contact surface 503 and the positioning surface 504. There are three points on the positioning surface of the side plate 502 of the carriage 50. Then, the two points on the base plate 72 (see FIG. 2A), which are in the vicinity of the nozzle 70 (FIG. 3) of the recording head 170, and the one point, which is on the recording head 170 above the ink tank 73 (see FIGS. 2C and 2D), are arranged to face the positioning surface described above.

For the recording head 170, the contact surface 503 of the carriage 50 is arranged to be positioned inside the triangle formed by the three points of the positioning surface 504. The pressing position of the pressure unit 512 of the head holder 51 is also positioned within this triangle. Also, in the position that faces the pressure unit 512 of the head holder 51, the guide arm 513 is provided. When the recording head 170 should part from the contact surface 503, this guide arm 513 functions with respect to the recording head 170.

FIGS. 7A and 7B are views which illustrate the attachment mechanism of the head to be mounted on the carriage. Here, FIG. 7A is a view showing the upper surface thereof. FIG. 7B is a front view.

The hook lever 53 is rotatively installed on the side plate 502 of the carriage 50. For the rotational center of the hook lever 53, the contact spring 54 is provided to bias the hook lever 53. The hook cover 55 is installed to cover the hook lever 53 and hold the hook lever 53 not to fall off from the carriage 50. As shown in FIG. 7A and FIG. 7B, the hook lever 53 and the head holder 51 are provided with cams 516 and 531, which abut upon each other, respectively.

Here, the structure is arranged to enable the head holder 51 to shift in the left and right directions by the rotation of the hook lever 53. Also, by the biasing force of the contact spring 54, the head holder 51 presses the head through the hook lever 53.

On the side plate 502 of the carriage 50, the fitting pins 505*a* and 505*b* are arranged corresponding to the fitting holes 77*a* and 77*b* of the base plate 72 of the recording head 170, thus making it possible to perform accurate positioning. In this respect, FIG. 8 is a view which shows the carriage unit 5, observed from above.

On the contact surface 503 provided for the side plate 502 of the carriage 50, there is arranged the rubber pad 57 formed by an elastic material, such as silicon rubber having rubber hardness of 30 to 50 degrees, in order to establish electric contact with the recording head 170. Then, on the rubber pad 57, the contact unit 561 is arranged, which is prepared by forming the extrusion on the conductor of the flexible base board 56 by giving forming treatment to it. Then, the structure is arranged to deform the rubber pad 57 by a given amount when the recording head 170 is mounted, and the base plate 72 of the recording head 170 is in contact with the positioning surface 504 of the carriage 50 as described above. In this way, the electric contact is reliably implemented between the flexible base board 56 and the contact surface 78 of the recording head 170. Here, by this electric contact, the signal lines and power lines are coupled between the recording head 170 and the recording apparatus main body with each other. At the same time, the main body side recognizes the ID that distinctly indicates the kind of the recording head. Also, it is arranged for the main body side to read out the detected value of the temperature sensor arranged inside the recording head 170.

With the structure thus arranged, when images are formed on a sheet material, the carrier roller 36 and the pinch roller 37 carry the sheet material to the line position where images are formed. At the same time, the carriage 50 shifts to the line position of the image formation (the position in the direction perpendicular to the carrying direction of the sheet material) by means of the carriage motor, thus enabling such position of image formation to face the recording head 170. After that, in accordance with recording signals from the electric base board, the recording head 170 discharges ink from the head unit 71 onto the sheet material for the formation of images.

With the structure arranged as described above, the recording head 170 is detachably mounted and held on the carriage unit 5. Then, required positioning, electric contact and other related operations are performed. Then, depending on each of the printing modes, such as high quality (HQ) and high speed (HS), the recording head 170 is driven by the predetermined driving frequencies to perform each recording accordingly. Also, by exchanging recording heads to be mounted on the carriage unit 5, the execution of various kinds of recording becomes possible. For example, there are prepared a recording head for single color use (monochrome head) for recording in monochrome color, and a recording head for multiple color use, which is provided with nozzle lines and ink tanks retaining four color ink, such as black, cyan, magenta, and yellow. Then, when recording in monochrome color, the monochrome head is mounted, while for recording in colors, the head for multiple color use is mounted, hence making it possible to perform a desired recording. In this case, the ID (the kind) of the head to be used is detected to enable the recording apparatus main body to recognize the kind of head for switching over all the controlling operations corresponding to the head to be used. In this way, driving control, image processing, reliability control, and printing control are optimized, among some others. More specifically, the optimization is carried out with respect to the driving condition (the driving voltage, the driving pulses, the driving frequency, the pulse width control (PWM control) of the driving pulse, the driving method, and the like), the recovery condition and the recovery sequence (suction, pre-discharge, wiping, and the like), printing control (sheet feeding, mask, pass numbers, color processing, gamma correction, and the like), and the countermeasure taken for abnormal operation (control of abnormally high temperature), among some others.

There have been increasing demands for the wider utilization of bubble jet technologies and techniques for various products in many different fields, as discussed below.

For example, as to the demand on the improvement of discharging efficiency, the adjustment of the thickness of protection film has been studied to optimize the performance of heat generating elements. A study made of the effects on the enhancement of transfer efficiency of generated heat to liquids. Also, in order to obtain high quality images, there has been proposed a driving condition under which a liquid discharging method or the like is arranged to be able to execute good ink discharge at higher ink discharging speeds with better stabilized creation of air bubbles. Also, from the viewpoint of a high-speed recording, there has been proposed the improved configuration of liquid flow paths that makes it possible to obtain a liquid jet head capable of refilling liquid in the liquid flow paths at higher speeds in order to make up for the liquid that has been discharged.

Of the various configurations of liquid flow paths thus proposed, the structure of liquid flow paths is disclosed in the specification of Japanese Patent Laid-Open Application No. 63-199972 as shown in FIGS. 10A and 10B. The structure of the liquid flow paths and the method for manufacturing heads disclosed in the specification thereof are the inventions devised with attention given to the back waves (the pressure directed opposite to the direction toward the discharge ports, that is, pressure exerted in the direction toward the liquid chamber 12). The back waves produce an energy loss because such energy is not exerted in the discharging direction.

For the liquid flow path configuration shown in FIGS. 10A and 10B, heaters (heat generating elements) 2 are arranged on an elemental substrate. At the same time, a valve 90 is arranged away from the air bubble generating area formed by the heat generating element 2, and positioned on the side opposite to the discharge port 18 with respect to the heat generating element 2. As shown in FIG. 10B, this valve 90 is set at the initial position thereof such as adhesively bonded to the ceiling of the liquid flow path 10, and then, the valve is caused to hang down in the liquid flow path 10 along the creation of air bubble. It is also referred to in the disclosure that the invention is designed to control the aforesaid back waves partly by the provision of the valve 90 in order to suppress the energy loss. However, it is clearly understandable that the partial suppression of the back waves by means of the valve 90 is not practical for liquid discharge when studies are made precisely on the process in which the air bubbles are created in the liquid flow path 10 that retains the discharging liquid in it. In other words, the back waves themselves are not fundamentally related directly with discharging as described above. Of the pressures exerted by the air bubble, those directly related with discharging have already acted upon liquid so that the liquid is in the state of being discharged from the liquid flow path the moment the back waves are generated in the flow path as shown in FIG. 10A. Therefore, even if the back waves are suppressed, it is clear that no significant influence is exerted on the liquid discharge, not to mention the partial suppression of the back waves.

Also, in accordance with the conventional ink jet recording method described above, each of the heat generating elements repeats heating, while being in contact with ink. As a result, deposit is accumulated on the surface of each heat generating element due to burning of ink. Depending on the kinds of ink, such deposit is made in a considerable quantity, and results in the unstabilized creation of air bubbles, hence making it difficult to perform ink discharge in good condition. Also, it is desired to provide a method for performing discharge in good condition without changing the quality of discharging liquid even when the liquid used has the nature such as to easily deteriorate by the heat application or the liquid has the nature such as to make sufficient foaming difficult. Here, with this in view, there has been proposed a method for discharging liquid by transferring pressure exerted by foaming to discharging liquid, while arranging means for separating the liquid used to create air bubbles by the application of heat (foaming liquid) and the liquid for use of discharges (discharging liquid) as different liquids, such as disclosed in the specifications of Japanese Patent Laid-Open Application No. 61-69467, Japanese Patent Laid-Open Application No. 55-81172, U.S. Pat. No. 4,480,259, among some others. In accordance with these disclosures, the structure is arranged to completely separate ink serving as discharging liquid, and foaming liquid by use of silicon rubber or some other flexible film so as not to allow the discharging liquid to be directly in contact with the heat generating elements, and at the same time, to transfer pressure exerted by foaming of the foaming liquid to the discharging liquid by means of the deformation of the flexible film. With a structure of the kind, it is attained to prevent the deposit from being accumulated on the surface of each heat generating element, to provide the improved degree of selection freedom of discharging liquids, or the like.

However, the structure that completely separates discharging liquid and foaming liquid as described above is the one whereby to transfer pressure, exerted at the time of foaming to discharging liquid by means of the deformation of the flexible film, brought about by its expansion and contraction. Therefore, the pressure exerted by the deforming thereof is absorbed by the flexible film to a considerable extent. Also, the amount of deformation of the flexible film is not large. As a result, although it is possible to obtain the effect that discharging liquid and foaming liquid are made separable, there is a fear that discharging efficiency and discharging power are lowered after all.

As described above, further enhancement of discharging characteristics is desired for the method for discharging liquid by forming air bubbles (particularly, air bubbles created following film boiling) in each of the liquid flow paths. Under the circumstances, therefore, the inventor et al. hereof have reverted to making studies on the principle of the discharge of droplets, and have made the technical analyses given below in order to provide a novel type droplet discharging method utilizing air bubbles, as well as heads and others to be used for such novel type method. The first technical analysis is to begin with the operation of the movable member in each of the liquid flow paths, such as an analysis on the principle of the mechanism of such movable member in the liquid flow path. The second analysis is to begin with the principle of droplet discharging by means of air bubbles, and the third analysis is to begin with the bubble generation area of each heat generating element for use of air bubble creation. As a result, while shedding light upon the aspects that have not been taken into consideration for the conventional art, it is made possible to improve the fundamental discharging characteristics of the liquid discharging method for creating each of the air bubbles (particularly, the air bubble following film boiling) in each of the liquid flow paths to such a high level that cannot be anticipated in accordance with the conventional art.

In other words, the inventor et al. hereof have established a completely new technique to control air bubbles positively by arranging the positional relationship between the fulcrum of a movable member and the free end thereof in such a manner as to locate the free end on the discharge port side, that is, on the downstream side or by arranging the movable member to face each heat generating element or air bubble generating area. The present invention based upon the new technique. More specifically, in terms of energy to be given to a discharging amount by an air bubble itself, the developing component of the air bubble on the downstream side should be taken into consideration as the greatest element for the remarkable enhancement of the discharging characteristics. In other words, it has been found that the developing component of the air bubble on the downstream side should be converted efficiently so as to be directed toward discharging in order to enhance the discharging efficiency and the discharging speed as well. With this in view, it has been arranged to positively shift the developing component of the air bubble on the downstream side to the free end side of the movable member, thus having completed the invention of an extremely high technical standard as compared to the conventional liquid discharging method.

For this invention, it is found preferable to take the heat generating area for the creation of each of the air bubbles into consideration, which is the downstream side of the center line passing each of the center areas of electrothermal transducing elements in the flowing direction of liquid, for example, or take the structural elements, such as each movable member and liquid flow path into consideration, which are related to the development of each air bubble on the downstream side of the area center for its creation.

In addition to the techniques described above, the inventor et al. hereof have devised the structure of the liquid flow paths and the configuration of the heat generating elements to suppress the back waves and the developing component of each air bubble that advances in the direction opposite to the liquid supply direction, while effectuating the further enhancement of discharging power, thus leading to the introduction of an epoch-making technique that makes it possible to direct the flow of the discharging liquid in one way.

Now, the ink jet recording head produced in accordance with such new discharging principle requires driving condition (such as voltage, driving frequency) fit for the values of physical properties of discharging liquid (ink), such as viscosity, and resolution, which are different from those of the conventional ink jet recording head referred to in the description of the related background art. Therefore, the ink jet recording head that adopts the new discharging principle (hereinafter referred to as a novel type ink jet recording head) needs to be mounted on a novel type ink jet recording apparatus, as well as to be supplied with ink that fits the use of the novel type ink jet recording head. When these needs are satisfied, the novel type ink jet recording head demonstrates its characteristic performance to the maximum. In the description given below, only the so-called ink tank separation type ink jet recording head is taken into account. This ink jet recording head uses the ink tank, which is made separable from the head unit thereof, and it is arranged to exchange ink tanks alone.

For the novel type ink jet recording head, it should be considered that this head is mounted on the novel type recording apparatus in order to discharge novel type ink that fits the novel type ink jet recording head appropriately. (Likewise, for the conventional recording head, it should be ideal to mount the conventional head on the conventional recording apparatus for discharging conventional ink). Desirably, however, the arrangement should be made so that an ink tank retaining the conventional ink is installed on the novel type ink jet recording head, and then, mounted on the novel type ink jet recording apparatus in an emergency, such as ink shortage or it is made possible to use novel type ink for the conventional recording head or recording apparatus to cope with such emergency. In other words, it is desirable to maintain compatibility between the novel type ink and recording head or novel type recording apparatus, and the conventional ink and recording head or conventional recording apparatus. In this case, it is preferable to maintain compatibility between the novel and conventional printer drivers for driving a recording apparatus in accordance with image data.

However, it is impossible to enhance the compatibility between these two kinds if only the configurations of the coupling units of carriage are made equal for recording apparatuses, among the configurations of recording heads, or the configurations of the coupling units between ink tank and recording head are made equal between the novel and conventional ones. It is also impossible to attain the optimization of image qualities, recording speeds, operational reliability, and other related requirements within the allowable combination of ink, recording heads, and recording apparatuses. Also, no proposal has been made as to any method for preventing damage from being caused to the recording apparatus main body or the recording head for reasons such as the supply of inappropriate ink being conducted. If ink should be switched over while the recording head is in use, there is a possibility that the mixture of different kinds of ink brings about impediments. In order to attain good recording by enhancing the compatibility between ink, recording heads, and recording apparatuses, there are obstacles yet to be removed as given below.

(1) Ink for High Speed Recording

As a novel type ink, the refilling characteristic and fixation capability of ink should be improved to make such ink usable for a high speed recording. In other words, ink, which is made usable for discharging at higher driving frequencies, is adopted. In this case, if such novel type ink is used for the conventional recording head or recording apparatus, a discrepancy takes place between the characteristic of ink and the estimated characteristic of the conventional head or the estimated image processing, head control, carriage control and other related control of the conventional recording apparatus main body. In this respect, the refilling characteristic and fixation capability of the ink thus prepared for a high speed recording are enhanced by improving the permeability, viscosity, and surface tension of ink, among some others.

(2) Ink Usable for an Ordinary Paper Sheet

Ink is improved so that no bleeding or feathering may be brought about as novel type ink is used for printing on an ordinary paper sheet. Even in this case, a discrepancy takes place with respect to the image processing, head control, and operational reliability control if such improved ink is used for the conventional recording head or recording apparatus. Here, bleeding, feathering, coloring, density, fixation, or other properties of ink usable for an ordinary paper sheet are enhanced to be usable as a novel type ink by improving its permeability, viscosity, reactivity (to heat and light), polarity, among some other properties.

(3) Ink of Higher Reliability

The evenness, fixation, evaporation, and other properties of the novel type ink are improved to provide an enhanced reliability. If such improved ink is used for the conventional recording head or recording apparatus, a discrepancy takes place with respect to the head control and operational reliability control, among some others.

(4) Ink for a Higher Image Quality

The coloring, density and other properties of the novel type ink ink are enhanced to make it usable for recording images in higher quality. If such improved ink is used for the conventional recording head or recording apparatus, a discrepancy takes place with respect to image processing, head control, and operational reliability control, among some others. In this respect, the permeability, viscosity, reactivity (to heat and light), and polarity are enhanced, among some other properties, to obtain improved characteristics of bleeding, feathering, coloring, density, fixation, and the like.

(5) Compatibility Between the Contact Units of Recording Heads

The layout of contacts, the number of contact pads, and other related elements are yet to be discussed for the utilization of a higher performance of the novel type recording head, while being provided with the common terminals usable for the conventional recording head.

(6) Compatibility Between Driving Conditions

As compared with the conventional recording head, the driving frequency and resolution are enhanced for the novel type recording head. However, a discrepancy takes place between the novel type recording head and the conventional one with respect to head control if a high speed recording and high quality image recording are attempted, while fully utilizing such enhanced driving frequency and resolution.

(7) Compatibility Between Recovery Conditions, and Recovery Sequences (recovery by means of suction, pre-discharge, and wiping of discharge port surface), Among Some Others.

Since the structure of the liquid flow paths and ink to be used are different, the sucking condition and others are made different, and thus a discrepancy takes place with respect to the recovery sciences of the novel type recording head and the conventional one in some cases. Also, as described later, the novel type recording head is arranged by a single liquid flow path structure or by a two-flow path structure. In some cases, the sucking condition may be different even between these structures of the novel type recording head alone. (8) Compatibility between printing controls (sheet feeding, masking, number of passes, color processing, γ correction, and the other factors) The modification of ink properties, and resolution may result in discrepancies between change of states with respect to the recorded images (colors, γ values, dot diameters, and textures). (9) Compatibility between countermeasures against abnormal operations (control of abnormally high temperature, ink dropping from discharge ports, detection of disabled discharges, and the like) Since the structures of recording heads are different, the specific heat, heat capacitance, heat radiation, and sensor characteristics are caused to change. As a result, a discrepancy takes place between the countermeasures that should be taken by the novel and conventional recording heads or recording apparatuses.

The novel type ink jet recording head produced in accordance with the new discharging principle has a two-flow path structure in its inner arrangement of the head. Liquid supplied by means of the movable member described above to the portion on the air bubble generating area side is mainly used for the creation of air bubbles for discharging. For the novel type ink jet recording head thus structured, it is possible to arrange the supply of discharging liquid used mainly for discharging, and the supply of foaming liquid, used for the creation of air bubbles for discharging separately. These foaming liquid and discharging liquid may be made of one and the same liquid or different ones. Therefore, depending on the cases where discharging liquid and foaming liquid are separated by means of the inner structure of the recording head and where these liquids are not separated, the driving condition (such as the driving frequency, the width of driving pulse, and the resolution) and the abnormal operation countermeasures (such as the control of abnormally high temperature, ink dropping from the discharge ports, detection of disabled discharges, and the like) may present discrepancies with regard to the compatibility aspect even for the novel type recording head itself in some cases.

When foaming liquid and discharging liquid are made different, the operational characteristics may differ depending on the kinds of such liquids, whether or not these liquid are mutually mixable. Then, conceivably, discrepancies may take place with respect to compatibility between novel type recording heads themselves as to the aspects of driving conditions referred to in paragraph (6) above and countermeasures taken with respect to abnormal operation referred to in paragraph (9) above. Particularly, when reactive components may be contained in foaming liquid and discharging liquid, respectively, for the enhancement of coloring and fixation of ink on a recording medium, it is necessary to give fullest attention to the compatibility with respect to the printing control (such as sheet feeding, masking, number of passes, color processing, γ correction, and the like) referred to in paragraph (8) above. It becomes possible to use highly viscous liquid as discharging liquid if foaming liquid and discharging liquid are separated. The fullest attention should be given to the compatibility of the recovery conditions and recovery sciences (such as suction/compression recovery, pre-discharges, wiping of the discharge port surface) as referred to in paragraph (7) above.

As described above, there are many problems yet to be solved as to the compatibility between the novel type ink and the conventional recording head or recording apparatus or between the conventional type recording head and the novel type ink, and further, between various novel types of ink and recording head, and then, to make it possible to perform the best recording on the assumption of the combination of ink, recording heads, and recording apparatuses thus given.

SUMMARY OF THE INVENTION

It is a first object of the present invention to provide a method for standardizing an ink jet recording head and an ink tank devised to easily maintain compatibility with each other, while utilizing the difference between the conventional recording method that uses the conventional type ink by means of the conventional type recording head and a recording method, which makes it possible to widen the section range of ink by use of the novel type recording head characterized in that the interior of the recording head is partitioned into two layers through the movable member as in the recording head described above.

It is a second object of the invention to provide a standardizing method for solving the discrepancy with respect to the driving control between a simple recording method using the conventional type ink by means of the conventional type recording head and a recording method, which makes it possible to widen the section range of ink by use of the novel type recording head characterized in that the interior of the recording head is partitioned into two layers through the movable member as in the recording head described above, and also, to provide a recording apparatus that has solved such a discrepancy.

It is a third object of the invention to provide a standardizing method for solving the discrepancy with respect to the recovery control between a simple recording method using the conventional type ink by means of the conventional type recording head and a recording method, which makes it possible to widen the section range of ink by use of the novel type recording head characterized in that the interior of the recording head is partitioned into two layers through the movable member as in the recording head described above, and also, to provide a recording apparatus that has solved such a discrepancy.

It is a fourth object of the invention to provide a standardizing method for solving the discrepancy with respect to the printing control between a simple recording method using the conventional type ink by means of the conventional type recording head and a recording method, which makes it possible to widen the section range of ink by use of the novel type recording head characterized in that the interior of the recording head is partitioned into two layers through the movable member as in the recording head described above, and also, to provide a recording apparatus that has solved such discrepancy.

It is a fifth object of the invention to provide a printer driver for solving the discrepancy with respect to the user interface (corresponding to a recording medium, resolution, setting of recording method, or the like) between a simple recording method using the conventional type ink by means of the conventional type recording head and a recording method, which makes it possible to widen the section range of ink by use of the novel type recording head characterized in that the interior of the recording head is partitioned into two layers through the movable member as in the recording head described above.

It is a sixth object of the invention to provide a standardizing method for solving the discrepancy with respect to the results of various detections for handling abnormal operations and the like between the conventional type recording head and the novel type recording head characterized in that the interior of the recording head is partitioned into two layers through the movable member as in the recording head described above, while maintaining the compatibility between them, and also, to provide a recording apparatus that has solved such discrepancy.

In order to achieve the objects described above, the present invention is designed to include the aspects given below.

A method for standardizing an ink jet recording head comprises the step of:

providing a second ink jet recording head mountable on a first ink jet recording apparatus and capable of discharging ink under a first driving condition with respect to a market system including the first ink jet recording apparatus provided with a first ink jet recording head for discharging ink under the first driving condition and supplying means for supplying only the first driving condition, the second ink jet recording head being mounted on a second ink jet recording apparatus different from the first ink jet recording apparatus, having a discharging performance superior to the first ink jet recording apparatus, and discharging ink under a second driving condition different from the first driving condition.

An ink jet recording head used for an ink jet recording system provided with a mounting unit capable of exchangeably mounting ink jet recording heads, discriminating means for discriminating the kind of the ink jet recording head mounted on the mounting unit, and at least means for setting the optimal condition within an allowable range in accordance with the kind of the discriminated ink jet recording head, wherein the ink jet recording head is provided with a contact surface engaging with the contact surface provided for the mounting unit to make electrical connection therewith, and at least the information regarding the kind of the ink jet recording head is transferred to the ink jet recording system side by serial data communication through the specific contacts on the contact surface.

An ink jet recording method for the ink jet recording system to form images on a recording medium by discharging ink from a discharge port provided for the ink jet recording head, comprising the following steps of:

using a system provided with a mounting unit capable of exchangeably mounting at least two kinds of ink jet recording heads, a first ink jet recording head having a first recording characteristic, and a second ink jet recording head having a second recording characteristic different from the first recording characteristics, and discriminating means for discriminating the kind of the ink jet recording head mounted on the mounting unit; and recording in accordance with the result of discrimination by the discriminating means in the optimal recording condition among restrictive conditions resulting from the combination of the ink jet recording head mounted on the mounting unit and the ink jet recording system.

An information processing apparatus used for executing the method for standardizing an ink jet recording head, and used for outputting printing data to the recording apparatus including the mounting unit, the information processing apparatus being provided with a printer driver for receiving from the recording apparatus the information regarding the kind of an ink jet recording head mounted on the mounting unit, and executing image processing in accordance with the kind of ink jet recording head mounted on the mounting unit.

A method for standardizing an ink jet recording head and an ink tank, comprising the step of:

providing a second ink jet recording head different from a first ink jet recording head, and a second ink tank retaining a second ink supplied to the second ink jet recording head detachably mountable on a second ink jet recording apparatus different from the first ink jet recording apparatus with respect to a market system including the first ink jet recording apparatus capable of detachably mounting with each other the first ink jet recording head for discharging ink and a first ink tank retaining a first ink supplied to the first ink jet recording head, the second ink jet recording head being made capable of discharging the second ink by mounting the second ink tank, and having discharging performance superior to the first ink jet head, and also, being made capable of discharging the first ink by mounting the first ink tank, and the second ink being discharged by the second ink jet recording head, and having characteristics superior to the first ink, and also, being discharged by the first ink jet recording head.

An ink jet recording method for the ink jet recording system to form images on a recording medium by discharging ink from the discharge port provided for the ink jet recording head having an ink tank being made separable and exchangeable therefor, comprising the following steps of:

using a system provided with a mounting unit capable of exchangeably mounting at least two kinds of ink jet recording heads, a first ink jet recording head having first recording characteristics, and a second ink jet recording head having second recording characteristics different from the first recording characteristics, and discriminating means for discriminating the kind of the ink jet recording head mounted on the mounting unit and the kind of ink tank installed on the ink jet recording head; and recording in accordance with the result of discrimination by the discriminating means in the optimal recording condition among restrictive conditions resulting from the combination of the installed ink tank and the ink jet recording head mounted on the mounting unit and the ink jet recording system.

An information processing apparatus used for executing the method for standardizing an ink jet recording head and an ink tank and used for outputting printing data to the recording apparatus including the mounting unit, the information processing apparatus being provided with a printer driver for receiving from the recording apparatus information regarding the kind of an ink jet recording head mounted on the mounting unit, and the kind of ink tank installed on the ink jet recording head, and executing image processing in accordance with the kind of the ink jet recording head mounted on the mounting unit and the kind of the ink tank installed on the ink jet recording apparatus.

An information processing apparatus used for executing a method for standardizing an ink jet recording head and an ink tank and used for outputting printing data to the recording apparatus including the mounting unit, the information processing apparatus being provided with a printer driver for receiving from the recording apparatus information regarding the kind of ink tank installed on the ink jet recording head mounted on the mounting unit, and executing image processing in accordance with the kind of the installed ink tank.

A host apparatus for transferring signals including recording data with a connected recording apparatus, the recording apparatus exchangeably mounting a plurality of recording heads, comprising:

receiving means for receiving signals related to the kind of connected recording apparatus and the kind of recording head mounted on the recording apparatus;

means for generating image data corresponding to images to be recording by the recording apparatus;

output means for outputting to the recording apparatus the image data and signals to control the recording apparatus; and control means for changing at least one of image data and the signals to control the recording apparatus in accordance with signals related to the kind of the recording head received by the receiving means.

A method for controlling the recording apparatus of a host apparatus for transferring signals including recording data with the connected recording apparatus, the recording apparatus exchangeably mounting a plurality of recording heads, comprising the following steps of:

receiving signals related to the kind of the connected recording apparatus and the kind of the recording head mounted on the recording apparatus;

generating image data corresponding to images to be recording by the recording apparatus;

changing at least one of image data and the signals to control the recording apparatus in accordance with signals related to the kind of the recording head received by the receiving means; and outputting to the recording apparatus the image data and signals to control the recording apparatus.

Other objectives and advantages besides those discussed above will be apparent to those skilled in the art from the description of a preferred embodiment of the invention which follows. In the description, reference is made to accompanying drawings, which form a part hereof. Such example, however, is not exhaustive of the various embodiments of the invention, and therefore reference is made to the claims which follow the description for determining the scope of the invention.

BRIEF DESCRIPTION OF THE DRAWINGS

FIG. 25 is a view which shows the example of an indication given to the user of the system.

FIG. 26 is a view which shows the example of an indication given to the user of the system.

FIG. 27 is a view which shows the example of an indication given to the user of the system.

DETAILED DESCRIPTION OF THE PREFERRED EMBODIMENTS

Now, with reference to the accompanying drawings, a description will be provided of the embodiments in accordance with the present invention.

(Outline)

The ink jet recording system embodying the present invention is arranged to be capable of maintaining compatibility between the conventional type ink jet recording head referred to in the "Related Background Art" and the novel type ink jet recording head based upon the new discharging principle described above; between the novel type ink to be used for the conventional type ink jet recording head, and the novel type ink to be used for the novel type ink jet recording head; and between the conventional type recording apparatus (printer) fundamentally suitable for the conventional type ink jet recording head, and the novel type recording apparatus for use of the novel type ink jet recording head, as well as the system is arranged to be capable of performing the best recording by combining ink, a recording head, and a recording apparatus corresponding to given condition of such combination.

(First Mode Embodying the Present Invention)

At first, a description will be provided of the mode in which an ink container (ink tank) retaining ink and a recording head are structured to be separable, and arranged to be exchangeable individually.

Figure 1:
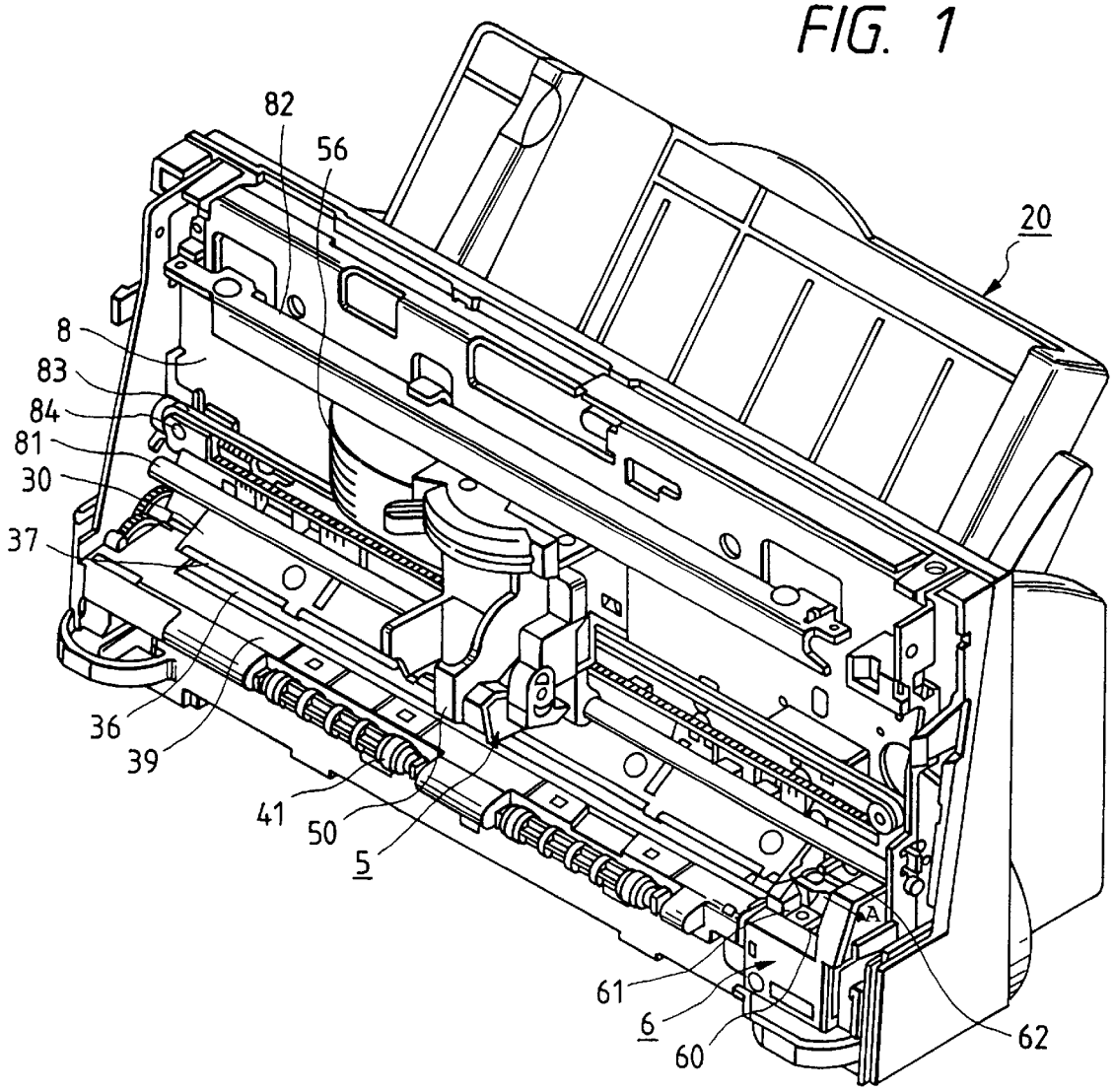
FIG. 1 is a view which shows the structure of an ink jet recording apparatus.
Figure 2A:
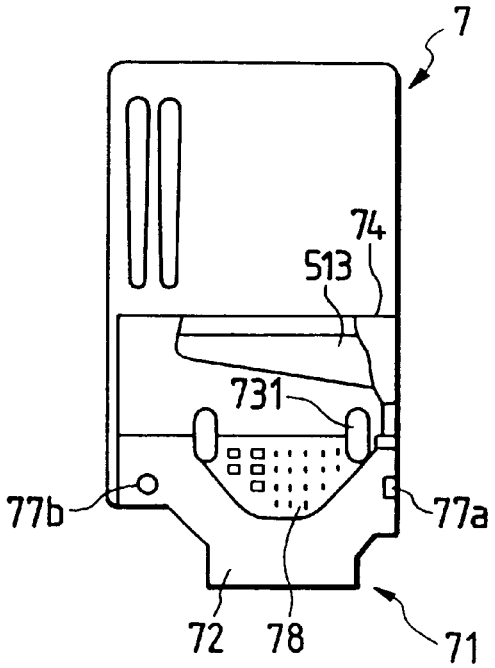
FIGS. 2A, 2B, 2C and 2D are views which illustrates a recording head formed integrally with an ink tank.
Figure 2B:
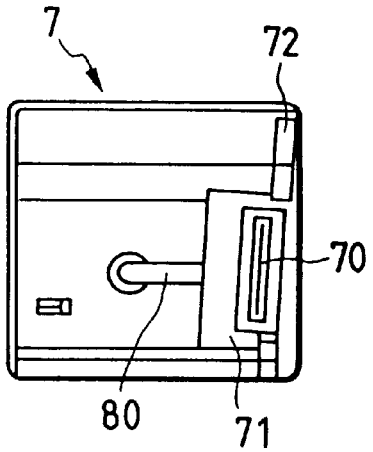
Figure 2C:
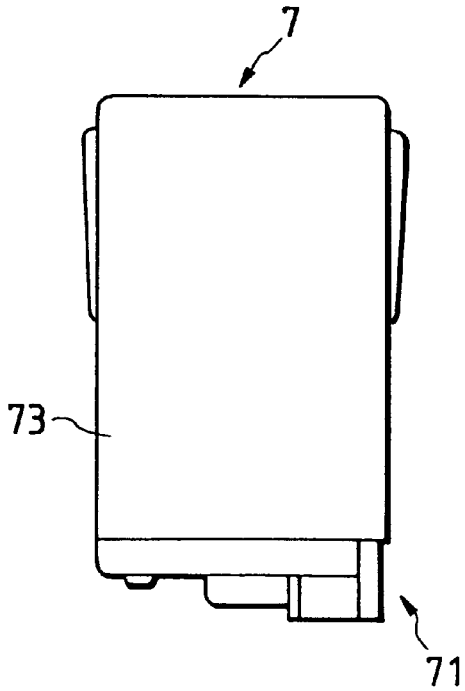
Figure 2D:
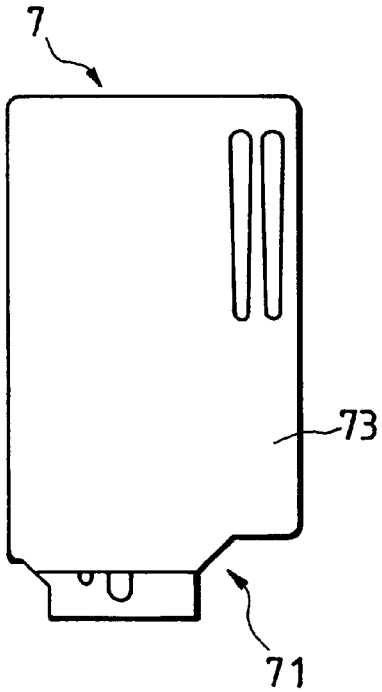
Figure 3:
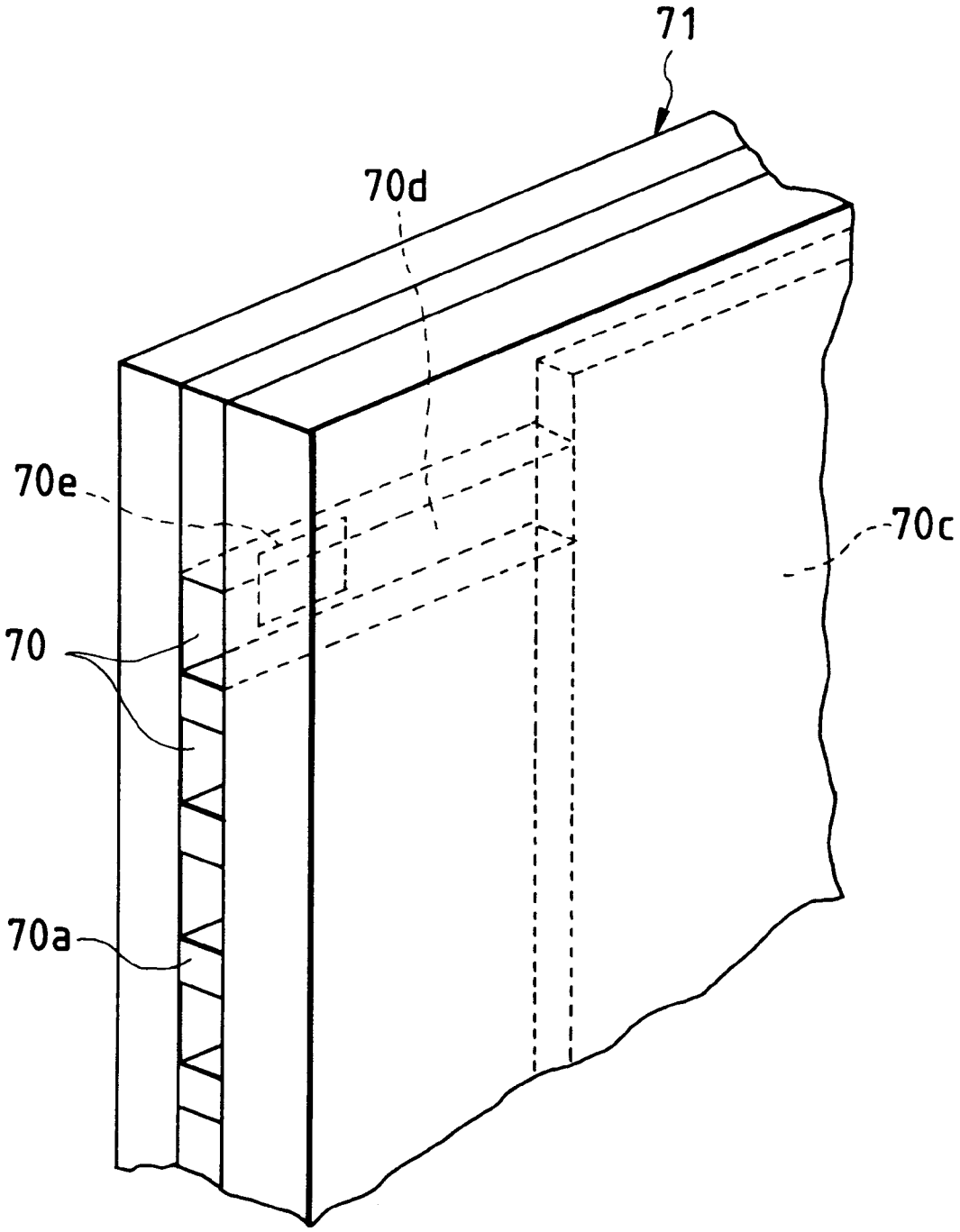
FIG. 3 is an enlarged view which shows the vicinity of the discharge port of a head unit.
Figure 11:
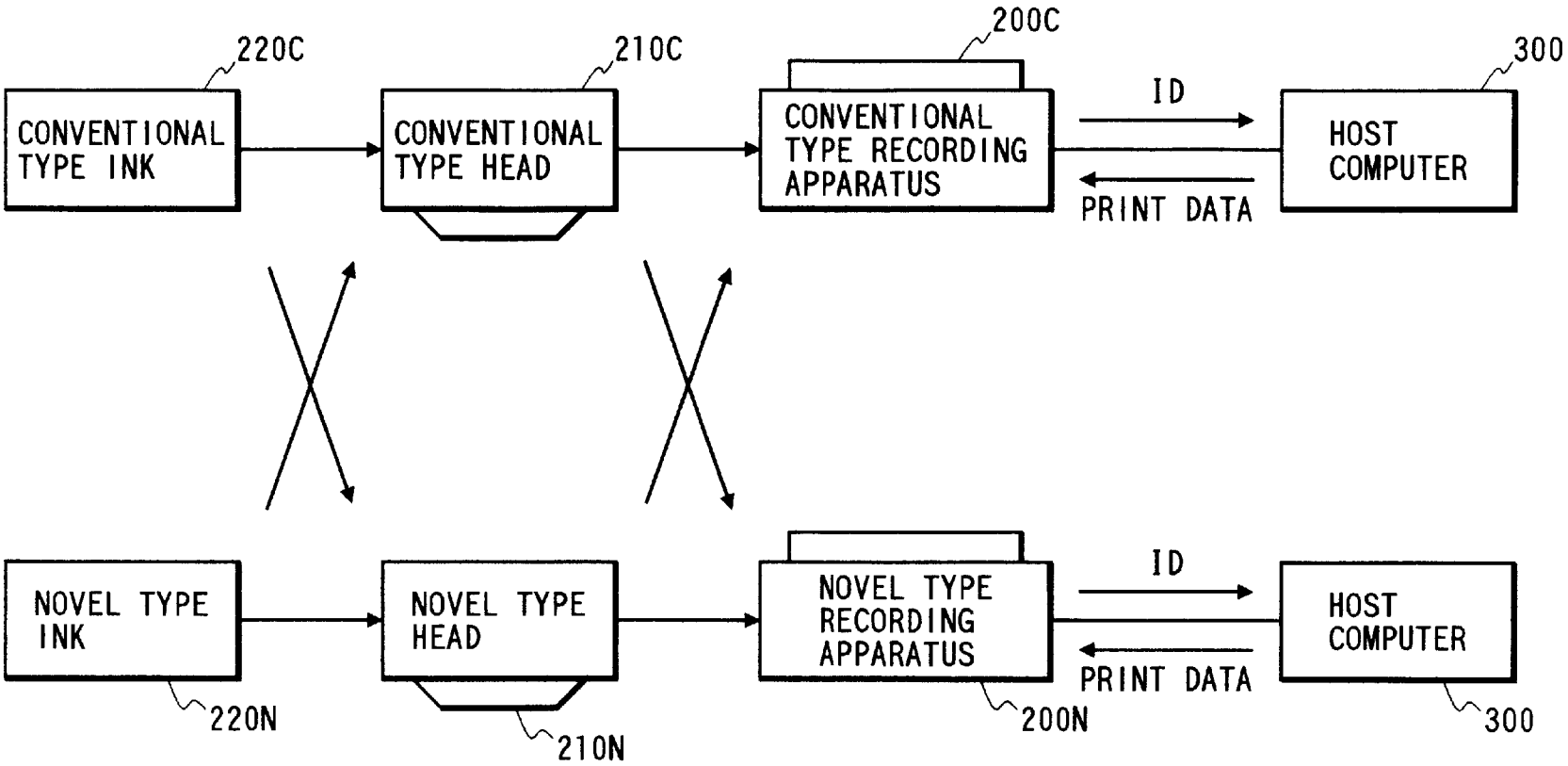
FIG. 11 is a view which illustrates the variation of the combination of a recording head and a recording apparatus.

FIG. 11 is a view which illustrates the variations of the combination of these kinds of ink, recording heads, and recording apparatuses. Here, it is assumed that ink is retained in an ink tank for supply. Also, it is assumed that the same ink jet recording apparatus described in conjunction with FIG. 1 is used for the recording apparatus in accordance with the present embodiment. As described later, a recording apparatus is generally provided with the hardware portion including the system of mechanism, electric circuitry including control circuit, and related units, and the software portion comprising the stored programs and some others to be executed by the CPU (central processing device), which is installed on a part of the hardware portion. The software is stored on the ROM (Read Only Memory) which is replaceable, or on the EPROM (Electrically Erasable ROM), which is rewritable from the host computer side or on the flash memory.

The conventional type recording apparatus 200C and the novel type recording apparatus 200N are connected with a host computer 300, respectively, to receive printing data from the host computer 300. These recording apparatuses 200C and 200N are arranged to be able to mount both the conventional type recording head 210C and the novel type recording head 210N. In other words, while the configurations of the conventional type recording head 210C and the carriage unit of the convectional type recording apparatus 200C are set so that the conventional type recording head 210C is made mountable on the carriage unit 5 (see FIG. 1) of the conventional type recording head 210C, the configuration of the novel type recording head 210N is made to be fitted into the carriage unit of the conventional type recording apparatus 200C. Then, the configuration of the novel type recording apparatus 200N is made to be able to receive either recording heads 210C and 210N. The difference between the conventional type and novel type of the recording apparatuses is whether the operational voltage and driving signals with respect to the head are designed on the assumption of use for the conventional one or of the most suitable use for the novel one. Further, the ink tank 220N that retains the novel type ink and the ink tank that retains the conventional ink 220C are arranged to be mountable on either the recording heads 210N and 210C. In FIG. 11, each of the combinations of ink and recording apparatus is indicated by arrows.

Here, caution should be taken as to the fact that when the conventional type recording apparatuses are designed, none of the novel type recording apparatuses exist. For designing of the conventional type hardware, any one of the novel type recording heads and ink are taken into consideration at all. As a result, if the novel type recording head 210N should be mounted on the conventional type recording apparatus 200C or if novel type ink should be used therefor, the novel type recording head 210N should be driven in the same condition as applicable to the case where the conventional type recording head 210C is mounted or the conventional type ink is used or the software should be replaced to make it possible to drive the novel type recording head 210N or the novel type ink in condition applicable thereto (within the allowable limit of the hardware to be used).

(Novel Type Recording Head (One-Flow Path Structure))

Here, before describing the recording system embodying the present invention, a description will be provided of the novel type recording head that constitutes the premise of the present embodiment. In other words, a description will be provided of a liquid jet head based upon the new discharging principle described above. FIGS. 12A, 12B, 12C and 12D are cross-sectional views showing such liquid jet head, taken in the direction of the liquid flow path. FIG. 13 is a partly broken perspective view showing this liquid jet head. Here, at first, a description will be provided of the liquid jet head of one-flow path structure where discharging liquid and foaming liquid are not distinguished.

For this liquid jet head, the heat generating elements 2 that cause thermal energy to act upon liquid (here, each in a form of a heat generating resistor of 40 $\mu$m×105 $\mu$m) are arranged on an elemental substrate 1 as a discharge energy generating element for discharging liquid, and on this elemental substrate, liquid flow paths 10 are arranged corresponding to the heat generating elements 2. Each liquid flow path 10 is conductively connected with each discharge port 18, and at the same time, it is connected with a common liquid chamber 13 conductively, thus receiving liquid from this common liquid chamber 13 in an amount corresponding to the liquid that has been discharged from each discharge port 18.

Above the liquid flow path 10 on the elemental substrate, a plate type movable member 31 having a flat portion is arranged in a cantilever fashion, which is formed by a material having elasticity such as metal, and structured to face each heat generating element 2 described above. One end of this movable member 31 is fixed to a base (a supporting member) 34 or the like formed by patterning photosensitive resin on the wall of the liquid flow path and the elemental substrate. In this way, the movable member is supported. In this way, a fulcrum (fulcrum portion) 33 is constituted.

This movable member 31 is arranged in a position facing the heat generating element 2 away from the heat generating element by approximately 15 μm to cover it so that the movable member has the fulcrum (fulcrum portion; fixed end) 33 on the upstream side of a large flow running from the common liquid chamber 13 to the discharge port side through the movable member by means of the discharging operation of liquid, and that it has the free end (free end portion) 32 on the downstream side with respect to this fulcrum 33. Between the heat generating element 2 and the movable member 31 is an air bubble generating area 11. In this respect, the kinds, configurations, and arrangements of the heat generating elements and movable members are not necessarily limited to those which have been described. As described later, it should be good enough if only these elements and members are in a configuration and arrangement that enable them to control the development of air bubbles and the propagation of pressure as well. Here, a description will be provided of the liquid flow path described above by dividing it into two areas (a first liquid flow path 14 and a second liquid flow path 16); with the movable member 31 a boundary, the portion conductively connected with the discharge port 18 directly is defined as the first liquid flow path, and the portion provided with the air bubble generating area 11 and liquid supply path 12 is defined as the second liquid flow path 16 so as to facilitate the description of the flow of liquid, which will be taken up later.

The heat generating element 2 is energized to heat liquid in the air bubble generating area 11 between the movable member 31 and the heat generating element 2. Then, an air bubble is created in the liquid by means of film boiling phenomenon as disclosed in the specification of U.S. Pat. No. 4,723,129. Pressure exerted by the creation of the air bubble and the air bubble act upon the movable member 31 priorly. The movable member 31 is displaced to be open largely to the discharge port side centering on the fulcrum 33 as shown in FIGS. 12B and 12C or FIG. 13. Due to the displacement or the state of the displacement of the movable member 31, the propagation of pressure exerted by the creation of the air bubble and the development of the air bubble itself are led to the discharge port side.

Here, of the discharging principles described above, the fundamental one will be described. In this respect, one of the most important principles is that each of the movable members arranged to face an air bubble is displaced from the first position where it resides stationarily to the second position that is the position after displacement by the pressure exerted by the air bubble or by the air bubble itself, and that the pressure exerted by the creation of the air bubble or by the air bubble itself brought about by the displacement of the movable member 31 is led to the downstream side where the discharge port is arranged.

Figure 14:
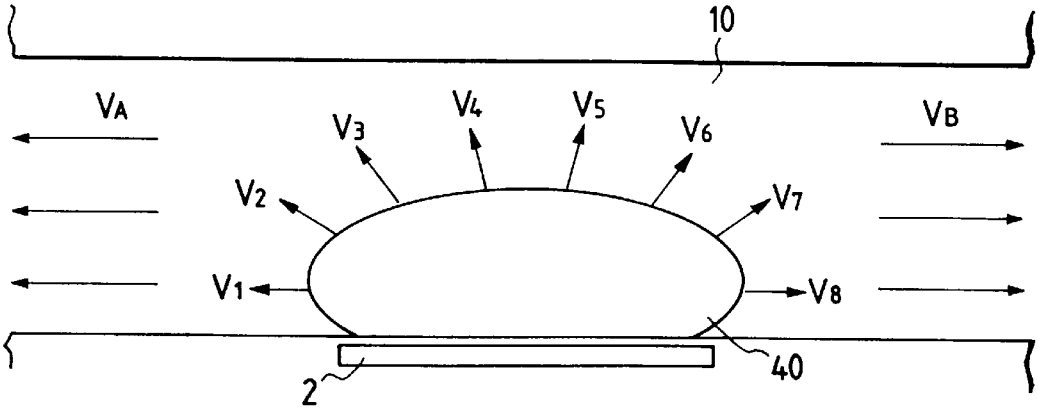
FIG. 14 is a view which schematically shows the pressure propagation from an air bubble in accordance with the conventional recording head.
Figure 15:
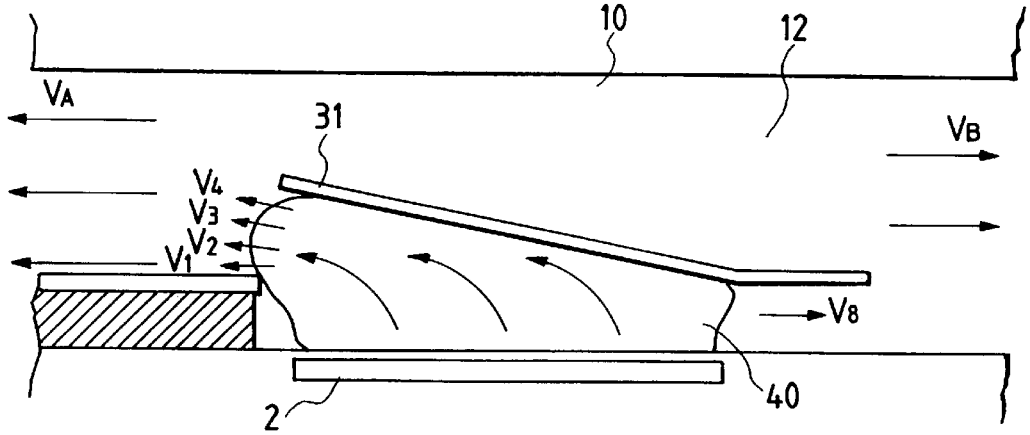
FIG. 15 is a view which schematically shows the pressure propagation from an air bubble in accordance with a novel type recording head.

In comparison, FIG. 14 schematically shows the conventional structure of a liquid flow path without using the movable member and FIG. 15 schematically shows the liquid flow path structure using the movable member 31, this new discharging principle will be described further in detail. In this respect, the propagating direction of pressure in the direction of the discharge port is defined as $V_A$, and the propagating direction of pressure to the upstream side is defined as $V_B$.

As shown in FIG. 14, there is no structure for the conventional head that regulates the propagating direction of pressure exerted by the creation of the air bubble. As a result, the pressure propagating directions of the air bubble are brought in the direction of normal lines of the surface of the air bubble and directed variously as indicated by the reference marks $V_1$ to $V_8$. Of the pressures thus directed, those having influence most on the liquid discharge are the components in the pressure propagating direction toward $V_A$, that is, those designated by reference marks $V_1$ to $V_4$, which reside in the pressure propagating directions closer to the discharge port portion from the position almost in a half of the air bubble. These are important components that directly contribute to the condition of discharging efficiency, discharging power, discharging speeds, and the like. Further, $V_1$ functions better because it is closest to the discharge port side $V_A$. On the contrary, $V_4$ has a comparatively smaller component in the direction toward $V_A$.

In contrast, when the movable member is provided as shown in FIG. 15 based upon the principle described above, the propagating directions of pressure exerted by the creation of the air bubble, which are directed variously at $V_1$ to $V_4$ in the case shown in FIG. 14, are led to the downstream side (discharge port side) to change them in the pressure propagating direction toward $V_A$. In this way, the pressure exerted by the creation of the air bubble 40 is made to contribute to discharging directly and efficiently. Then, the developing direction of the air bubble itself is also led to the downstream side as in the pressure propagation directed at $V_1$ to $V_4$, thus enabling it to be developed larger in the downstream side than in the upstream side. The developing direction of the air bubble itself is controlled likewise by means of the movable member 31. Thus, the pressure propagating direction of the air bubble is controlled to make it possible to attain the fundamental enhancement of the discharging efficiency, discharging power, discharging speeds, and the like.

Now, reverting to FIGS. 12A, 12B, 12C, and 12D, the discharging operation of this liquid jet head will be described in detail.

Figure 12A:
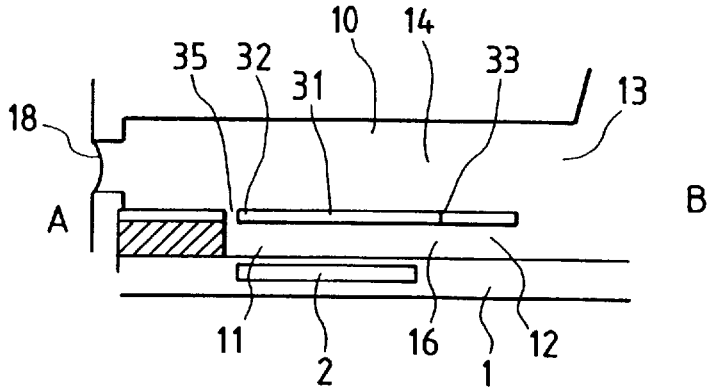
FIGS. 12A, 12B, 12C and 12D are cross-sectional views schematically showing one example of a novel type recording head having the one-flow path structure.
Figure 12B:
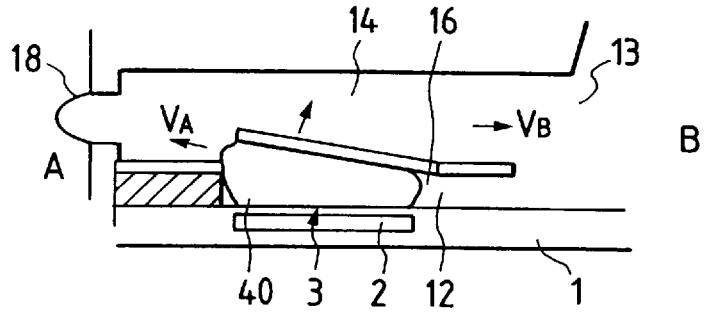
Figure 12C:
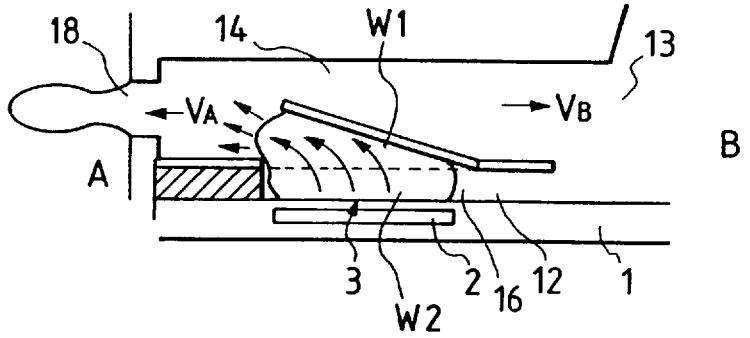
Figure 13:
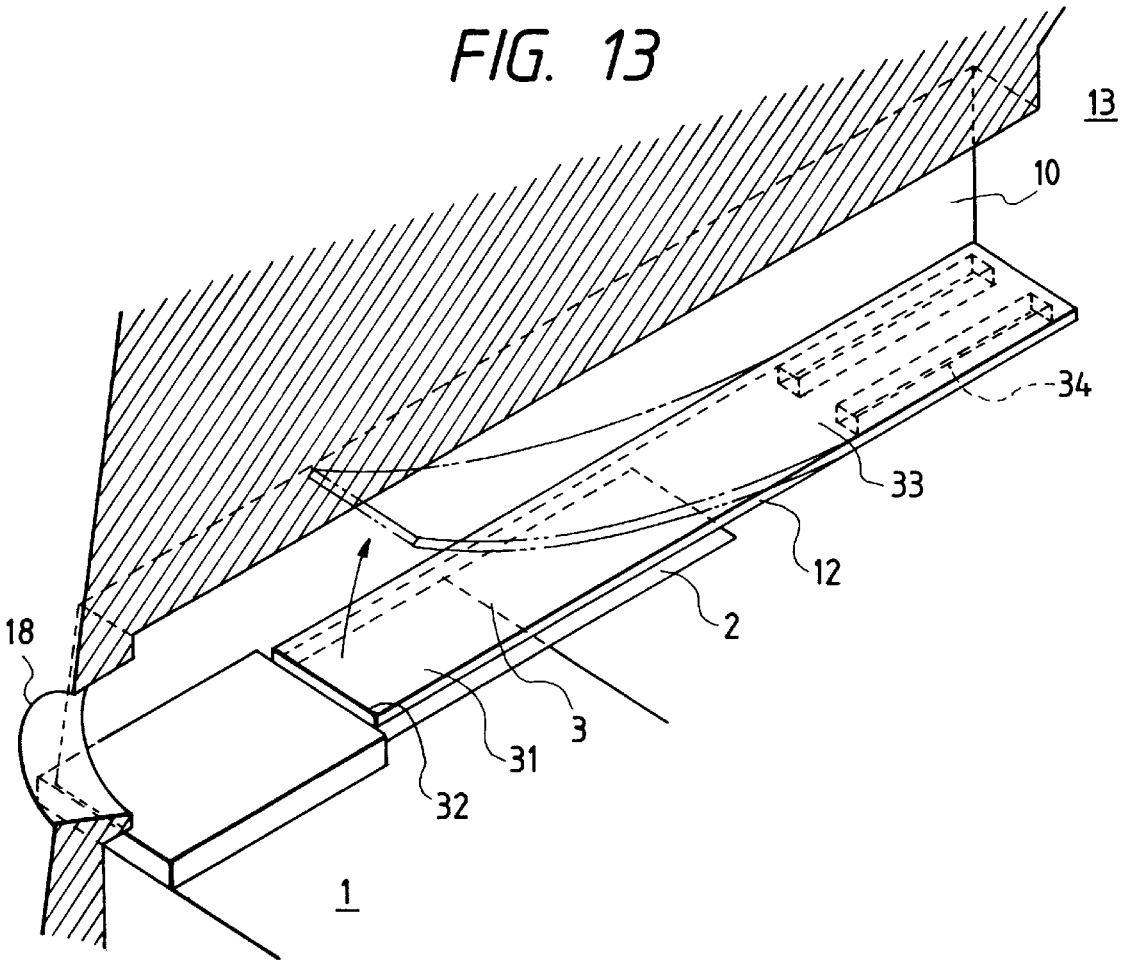
FIG. 13 is a partially broken perspective view which shows the novel type recording head represented in FIGS. 12A to 12D.

FIG. 12A shows the state before electric energy or the like is applied to the heat generating element 2, which is a state before the heat generating element generates heat. Here, what is important is that the movable member 31 is located in a position to face at least the downstream side portion of the air bubble with respect to the air bubble that has been created by the head of the heat generating element. In other words, the movable member 31 is arranged up to the position downstream at least from the center 3 of the area of the heat generating element in this structure of the liquid flow path (that is, downstream from the line passing the area center 3 of the heat generating element, which is orthogonal to the longitudinal direction of the liquid flow path).

FIG. 12B shows a state that electric energy or the like is applied to the heat generating element 2 to heat it. Thus, liquid filled in the air bubble generating area 11 is partly heated to create the air bubble following film boiling. At this juncture, the movable member 31 is displaced from the first position to the second position by means of pressure exerted by the creation of the air bubble 40, thus leading the propagating direction of the pressure exerted by the creation of the air bubble to the discharge port side. Here, what is important is that, as referred to earlier, the free end 32 of the movable member 31 is arranged on the downstream side (discharge port side), while the fulcrum 33 is arranged on the upstream side (common liquid chamber side) so that at least a part of the movable member is allowed to face the downstream portion of the heat generating element, that is, the downstream portion of the air bubble.

FIG. 12C shows a state that the air bubble 40 is further developed. Here, in accordance with the pressure following the creation of the air bubble 40, the movable member 31 is further displaced. The air bubble 40 thus created is developed larger on the downstream side than the upstream side, and at the same time, it is developed larger still beyond the first position of the movable member 31 (the position indicated by a dotted line). In this way, as the air bubble 40 is being developed, the movable member 31 is gradually displaced. Thus, it becomes possible to lead the developing direction of the air bubble toward the direction in which the pressure propagating direction of the air bubble 40 and its voluminal shift are easily effectuated. In other words, the developing direction of the air bubble toward the free end side is directed to the discharge port 18 evenly. This is considered to be a factor that contributes to the enhancement of the discharging efficiency. The movable member 31 presents almost no obstacle in propagating the pressure waves in the direction of the discharge port following the air bubble or the creation of the air bubble. The propagating direction of the pressure and the developing direction of the air bubble can be controlled efficiently corresponding to the magnitude of the pressure to be propagated.

Figure 12D:
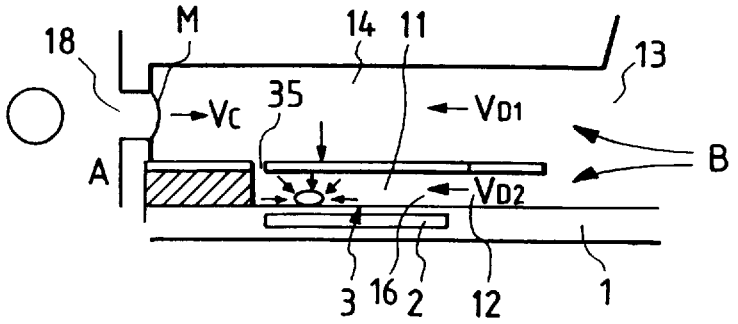

FIG. 12D shows a discharged liquid droplet, which is in flight, and at the same time, it shows a state that the air bubble 40 is contracted due to the reduction of the pressure in the air bubble subsequent to the film boiling described above, and that the air bubble disappears. In this state, no electric energy is applied to the heat generating element 2 (at least, any energy larger than that required to maintain the air bubble is not applied). The movable member 31, which is displaced to the second position, is returned to the initial position shown in FIG. 12A (the first position) by means of the negative pressure exerted by the contraction of the air bubble and the restoring force provided by the spring of the movable member 31 itself as well. Also, at the time of the disappearance of bubbles, liquid is caused to flow in from the upstream side (B side in FIG. 12D), that is, from the common liquid chamber side as the flow of liquid designated by reference marks $V_{D1}$ and $VD_2$, and also, from the discharge port side as designated by $V_C$, in order to make up the contracted volume of the air bubble on the air bubble generating area 11, as well as the voluminal portion of liquid that has been discharged.

Now, a description has been provided of the operation of the movable member following the creation of an air bubble, and also, of the discharging operation of liquid. Hereinafter, a description will be provided of the liquid refilling for this liquid jet head in detail.

Following the state shown in FIG. 12C, the air bubble 40 enters the bubble disappearing process after its volume becomes the greatest. At this juncture, liquid that makes up the volume that has been reduced due to the disappearance of the bubble is caused to flow in the air bubble generating area 11 from the discharge port 18 side of a first liquid flow path 14 and from the common liquid chamber 13 side of a second liquid flow path 16 as well.

For the conventional liquid flow structure that does not contain any movable member 31, the amount of liquid flowing in the bubble disappearance position from the discharge port side and the liquid amount flowing in from the common liquid chamber are determined by the magnitude of flow resistance between the portion nearer to the discharge port than to the air bubble generating area and the portion nearer to the common liquid chamber (that is, determined by the flow resistance and the inertia of liquid). Therefore, if the flow resistance is smaller on the side near to the discharge port, a large amount of liquid flows in the bubble disappearance position from the discharge port side, which makes the regressive amount of the meniscus greater. Particularly when the flow resistance on the side nearer to the discharge port is made smaller in order to enhance the discharging efficiency, the regressive amount of meniscus M becomes greater. As a result, it takes more time to execute refilling, which hinders a higher speed printing.

In contrast, for the liquid jet head that adopts the discharging principle described above, the movable member 31 is provided. Therefore, the regression of the meniscus comes to a stop when the movable member 31 returns to the original position when the bubble disappears, provided that the upper side of the volume W of the air bubble is given as $W_1$, and the air bubble generating area 11 side as $W_2$ with the first position being defined as the boundary between them. After that, the voluminal portion of the liquid supply for the remaining $W_2$ is made up by the liquid supply from the flow $V_{D2}$, which is mainly from the second liquid flow path. In this way, whereas the regressive amount of the meniscus becomes as large as almost a half of the volume of the air bubble W conventionally, it is possible to suppress the regressive amount of the meniscus to almost a half of the $W_1$, which is already smaller than the conventional regressive amount of the meniscus. Further, the liquid supply for the voluminal portion $W_2$ can be executed compulsorily mainly from the upstream side ($V_{D2}$) of the second liquid flow path 16 along the surface of the movable member 31 on the heat generating side. Therefore, refilling can be implemented at a higher speed.

Here, characteristically, when refilling is executed using the pressure exerted at the time of deforming for the conventional head, the vibration of the meniscus becomes great, leading to the degrading of image quality. However, with the high-speed refilling described above, it is possible to suppress and make the vibration of the meniscus extremely small, because the liquid flow is suppressed by means of the movable member 31 on the area of the first liquid flow path 14 on the discharge port side and the air bubble generating area 11 on the discharge port side as well.

Thus, with the structure arranged in accordance with the discharging principle used for the present invention, it is possible to attain the compulsory refilling to the air bubble generating area 11 through the second liquid flow path 16 of the liquid supply path 12, and also, to attain a high-speed refilling by suppressing the regression and vibration of the meniscus. Therefore, stabilized discharges and a high-speed repetition of discharges can be implemented. Also, when applying it to the field of recording, the enhancement of image quality and high-speed recording can be implemented. Moreover, it is made possible to discharge even colorant ink stably, which is not easily implemented by conventional ink jet recording.

The liquid discharging principle described above is dually provided with the effective functions given below. In other words, it is possible to suppress the propagation of pressure exerted by the creation of an air bubble to the upstream side (back waves). In the air bubble created on the heat generating element, most of the pressure exerted by the air bubble on the common liquid chamber side (upstream side) becomes a force that pushes back liquid (back waves) toward the upstream side in accordance with the conventional art.

The back waves bring about not only the pressure on the upstream side, but also, the shifting amount of liquid caused thereby, and the inertial force following such shifting of liquid. This event results in the unfavorable performance of liquid refilling into the liquid flow paths, leading also to the hindrance of high-speed driving. In accordance with the liquid discharging principle described above, such action working upon the upstream side is suppressed at first by means of the movable member 31, and then, the further enhancement of refilling supply performance is implemented.

Now, a description will be provided further of the structures and effects characteristic of this liquid jet head structured based upon the new discharging principle.

The second liquid flow path 16 is provided with a liquid supply path 12 having an inner wall (the surface of the heat generating element does not fall remarkably) which is essentially connected with the heat generating element 2 flatly on the upstream side of the heat generating element 2. In this case, the liquid supply to the air bubble generating area and to the surface of the heat generating element 2 is executed as indicated by the reference mark $V_{D2}$ along the surface of the movable member 31 on the side nearer to the air bubble generating area 11. As a result, the stagnation of liquid on the surface of the heat generating element 2 is suppressed to make it possible to easily remove the deposition of gas remaining in liquid, as well as the so-called remaining bubbles yet to disappear. Also, there is no possibility that the heat accumulation on liquid becomes too high. Therefore, it is possible to perform more stabilized creation of bubbles repeatedly at high speeds. In this respect, the description has been provided of the liquid supply path 12 having an inner wall, which is essentially flat, but the present invention is not necessarily limited to it. It should be good enough if only the liquid supply path has a smooth inner wall connected with the surface of the heat generating element smoothly, and is configured so that there is no possibility that liquid is stagnated on each of the heat generating elements and that any large disturbance of flow takes place in supplying liquid.

Also, the liquid supply to the air bubble generating area is executed from the $V_{D1}$ through the side portion (slit 35) of the movable member. However, in order to lead the pressure toward the discharge port more effectively when each of the air bubbles is created, a large movable member is adopted to cover the entire area of the air bubble generating area (to cover the surface of the heat generating element totally) as shown in FIGS. 12A to 12D. In this case, the liquid flow from the $V_{D1}$ to the air bubble generating area 11 may be blocked if the mode is such that the flow resistance between the air bubble generating area 11 and the area near to the discharge port on the first liquid flow path 14 becomes larger when the movable member 31 returns to the first position. With the head structure described above, there is provided the flow $V_{D1}$ for liquid supply to the air bubble generating area. As a result, the liquid supply performance becomes extremely high, and there is no possibility that the liquid supply performance is lowered even if the structure is arranged so that the movable member 31 covers the air bubble generating area 11 totally for the enhancement of discharging efficiency.

Figure 16:
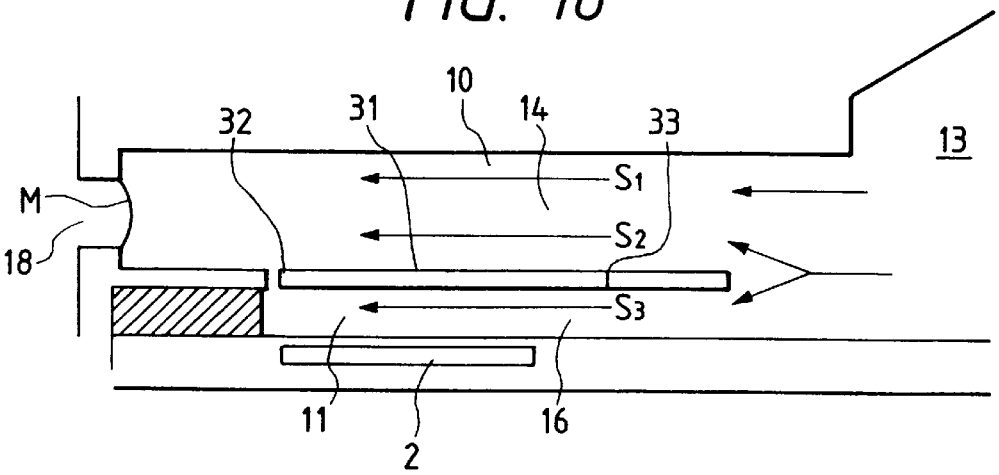
FIG. 16 is a view which schematically illustrates the flow of liquid of a novel type recording head.

Now, as to the positions of the free end 32 of the movable member 31 and the fulcrum 33, it is arranged so that the free end is on the downstream side relative to the fulcrum as shown in FIG. 15. Since the structure is arranged in this way, it becomes possible to implement the function to lead the pressure propagating direction and developing direction of the air bubble toward the discharge port side effectively when foaming is effectuated as described earlier. Further, with this positional relationship, it is made possible to produce not only favorable effects on the discharging functions, but also, to make the flow resistance smaller for liquid running in the liquid flow path 10 as liquid is being supplied, thus obtaining the effect that refilling is possible at higher speeds. This is because, as shown in FIG. 16, the free end and the fulcrum 33 are arranged not to present resistance to the flows $S_1$, $S_2$, and $S_3$ running in the liquid flow path 10 (including the first liquid flow path 14 and the second liquid flow path 16) along the meniscus M, which has regressed due to discharging, returning to the discharge port 18 by means of capillary force or along liquid supply being made subsequent to the bubble disappearance.

To supplement this, as shown in FIGS. 12A to 12D, the free end 32 of the movable member 31 extends over the heat generating element 2 to face the downstream side of the area center 3 (that is the line orthogonal to the longitudinal direction of the liquid flow path, passing the area center (central portion) of the heat generating element), which divides the heat generating element 2 into the upstream side and the downstream side. In this way, the pressure generated on the downstream side of the area center or central position 3 of the heat generating element, which contributes greatly to liquid discharging, or the air bubble, is received by the movable member 31. Thus, the pressure and air bubble are led to the discharge port side for the fundamental enhancement of the discharging efficiency and discharging power. Further, the upstream side of the air bubble is also utilized to produce many favorable effects. With the structure described above, the free end of the movable member 31 effectuates a mechanical displacement instantaneously. This function is also considered to contribute effectively to discharging liquid.

(Novel Type Recording Head (Two-Flow Path Structure))

Figure 17:
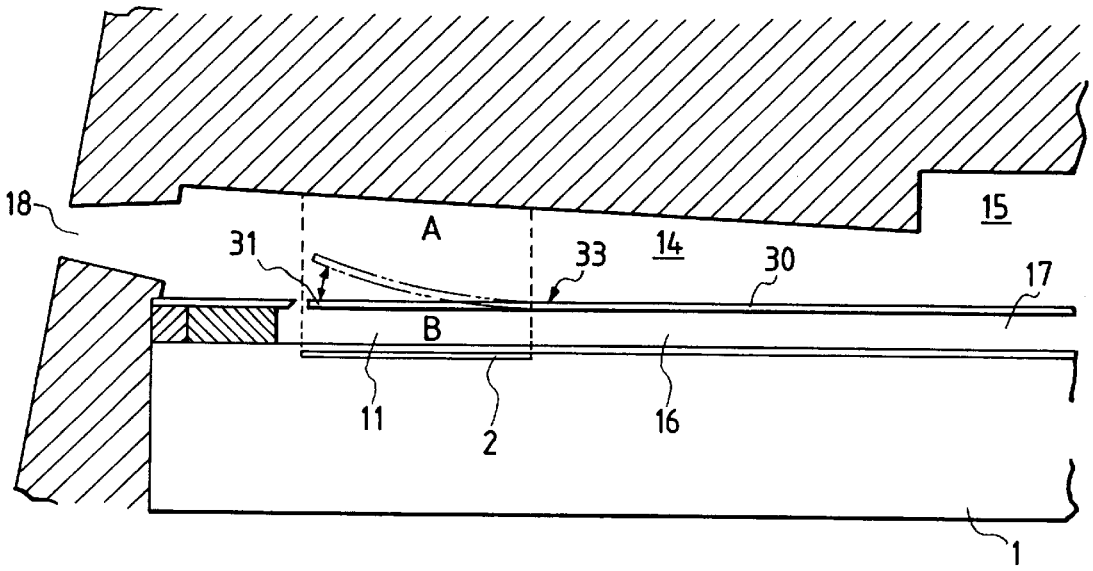
FIG. 17 is a cross-sectional view which shows a novel type recording head having a two-flow path structure.
Figure 18:
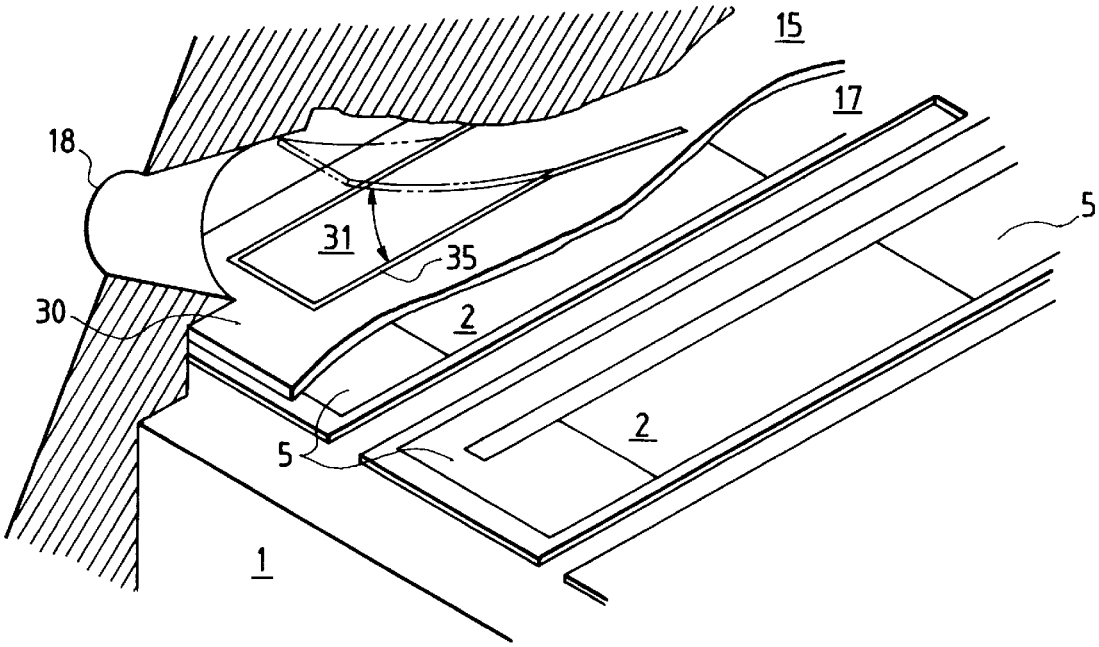
FIG. 18 is a partially broken perspective view of the novel type recording head represented in FIG. 17.

Now, a description will be provided of a liquid jet head whose liquid flow path structure is formed by a plurality of liquid flow paths (here, being defined as a two-flow path structure) so that liquid that foams by the application of heat (foaming liquid) and liquid used mainly for discharging (discharging liquid) are made separable. FIG. 17 is a cross-sectional view which schematically shows the liquid jet head having the two-flow path structure. FIG. 18 is a partially broken perspective view which shows the liquid jet head represented in FIG. 17.

For the liquid jet head of the two-flow path structure, the second liquid flow path 16 for use of foaming liquid is arranged on the elemental substrate 1 having the heat generating elements 2 arranged on it to give thermal energy to liquid for the creation of air bubbles. On this flow path, the first liquid flow path 14 is arranged, which is conductively connected with each of the discharge ports 18 directly. The upstream side of the first liquid flow path 14 is directly connected with each of the discharge ports 18 conductively. The upstream side of the first liquid flow path 14 is conductively connected with a first common liquid chamber 15 to supply discharging liquid to a plurality of first liquid flow paths 14. The upstream side of the second liquid flow path 16 is conductively connected with a second common liquid chamber 17 to supply foaming liquid to a plurality of second liquid flow paths 16. However, if the same liquid is adopted as foaming liquid and discharging liquid, it may be possible to provide only one common liquid chamber sharable use.

Between the first liquid flow path 14 and the second liquid flow path 16, there is arranged a separation wall 30 formed by an elastic metal or the like to partition the first liquid flow path and the second liquid flow path. In this respect, if it is better not to mix liquids to be used for foaming and discharging as far as the circumstances permit, the distribution of the first liquid flow path 14 and the second liquid flow path 16 should be separated by the provision of the separation wall. However, if there is no problem even by mixing foaming liquid and discharging liquid to a certain extent, the separation wall is not necessarily provided with such function as to implement the complete separation.

The portion of the separation wall, which is positioned in the projection space to the upper part of the surface direction of the heat generating element (hereinafter referred to as a discharge pressure generating area; areas designated by reference marks A and B with respect to the air bubble generating area 11 in FIG. 17), is arranged to function as a movable member 31 prepared in a cantilever fashion, which is provided with a free end by means of a slit 35 on the discharge port side (downstream side in the flow of liquid), and the fulcrum 33 positioned on the common liquid chambers (15 and 17) side. This movable member 31 is arranged to face the air bubble generating area 11 (at B in FIG. 17). Therefore, it operates to be open to the discharge port 18 side of the first liquid flow path 14 side by means of foaming of the foaming liquid (in the direction indicated by arrows in FIG. 17). In FIG. 18, too, the separation wall 30 is arranged through the space that constitutes the second liquid flow path 16 on the elemental substrate 1 having on it the heat generating resistor unit serving as the heat generating elements 2 and wire electrodes 5 to apply electric signals to the heat generating resistor unit. The relationship between the arrangements of the fulcrum 33 and the free end 32 of the movable member 31 and each of the heat generating elements 2 is made the same as the case referred to in the liquid jet head of the one-flow path structure.

Also, a description has been provided of the structural relationship between the liquid supply path 12 and the heat generating element 2 with respect to the liquid jet head of the one-flow path structure. For this liquid jet head of the two-flow path structure, the relationship between the structures of the second liquid flow path 16 and the heat generating element 2 is arranged to be the same as in the previous description.

Now, in conjunction with FIGS. 19A and 19B, the operation of the liquid jet head will be described.

When driving the head, the same water ink is used as discharging liquid to be supplied to the first liquid flow path 14 and as foaming liquid to be supplied to the second liquid flow path 16.

Heat generated by each of the heat generating elements 2 acts upon the foaming liquid on the air bubble generating area 11 of the second liquid flow path 16, thus creating air bubble 40 in the foaming liquid by means of film boiling phenomenon as disclosed in the specification of U.S. Pat. No. 4,723,129 in the same manner as referred to in the description of the liquid jet head of the one-flow path structure. Here, the foaming pressure cannot escape in the three directions but toward the upstream side of the air bubble generating area 11. Therefore, the pressure exerted by the creation of the air bubble is propagated intensively to the movable member 31 side arranged for the discharge pressure generating area, and then, along the development of the air bubble, the movable member 31 is displaced from the state shown in FIG. 19A to the liquid flow path side as shown in FIG. 19B. By this movement of the movable member 31, the first liquid flow path 14 and the second liquid flow path 16 are largely connected conductively, thus propagating the pressure exerted by the creation of the air bubble mainly in the direction toward the discharge port side of the first liquid flow path (direction A). By this propagation of pressure and the mechanical displacement of the movable member 31 as described earlier, liquid is discharged from the discharge port.

Figure 19A:
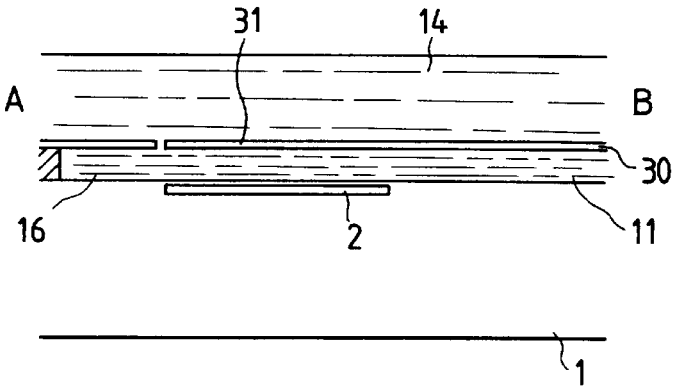
FIGS. 19A and 19B are views which illustrates the operation of the novel type recording head having the two-flow path structure.
Figure 19B:
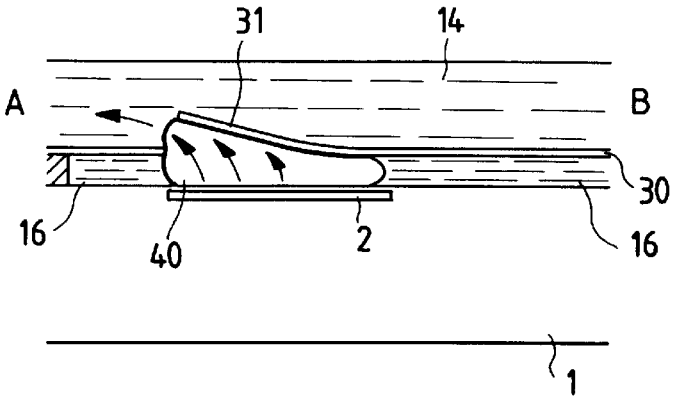

Now, when the movable member 31 returns to the position shown in FIG. 19A following the contraction of the air bubble, discharging liquid is supplied from the upstream side of the first liquid flow path 14 in an amount corresponding to the amount of discharging liquid that has been discharged. This supply of discharging liquid is in the direction in which the movable member 31 is closed in the same manner as the one-flow path structure. Therefore, refilling of discharging liquid is not hindered by the presence of the movable member 31.

The functions and effects of the principal part of this liquid jet head of the two-flow path structure, such as the propagation of foaming pressure following the displacement of the movable member, the developing direction of the air bubble, the prevention of back waves, are the same as those of the liquid jet head of the one-flow path structure. Besides, it has more advantages given below by adopting the two-liquid flow path structure thus arranged. In other words, in accordance with the structure described above, discharging liquid and foaming liquid can be separate ones, and then, it is made possible to discharge the discharging liquid by means of the pressure exerted by foaming of the foaming liquid. As a result, such highly viscous liquid as polyethylene glycol or the like, which presents insufficient discharging power due to insufficient foaming effectuated by the conventional heating, can be discharged in good condition in such a manner that a liquid of that kind is supplied to the first liquid flow path, while liquid (such as a mixture of ethanol and water=4:6 in approximately 1 to 2 cp) that promotes foaming of the liquid, or liquid having a low boiling point, is supplied to the second liquid flow path in order to perform good foaming operation. Also, as foaming liquid, it is made possible to select such a liquid that generates no burning residue or any other deposit on the surface of the heat generating element when receiving heat. Then, with the liquid thus selected, the stabilized foaming can be executed likewise so as to make good discharging possible.

Further, with the two-flow structure, it is possible to demonstrate the effects referred to in the description of the one-flow structure. Therefore, the highly viscous liquid and others can be discharged with a higher discharging efficiency and higher discharging power. Also, even for the liquid whose nature is not very strong against heating, it is equally possible to discharge such liquid with a high discharging efficiency and high discharging power as described above without damaging it thermally if this liquid is supplied to the first liquid flow path, while the liquid, whose nature is such that it does not change its properties thermally and presents good foaming, is supplied to the second liquid flow path.

(Structure of Recording Apparatus)

Now, a description will be provided of the structure of control system of the recording apparatus used for the present embodiment.

Figure 20:
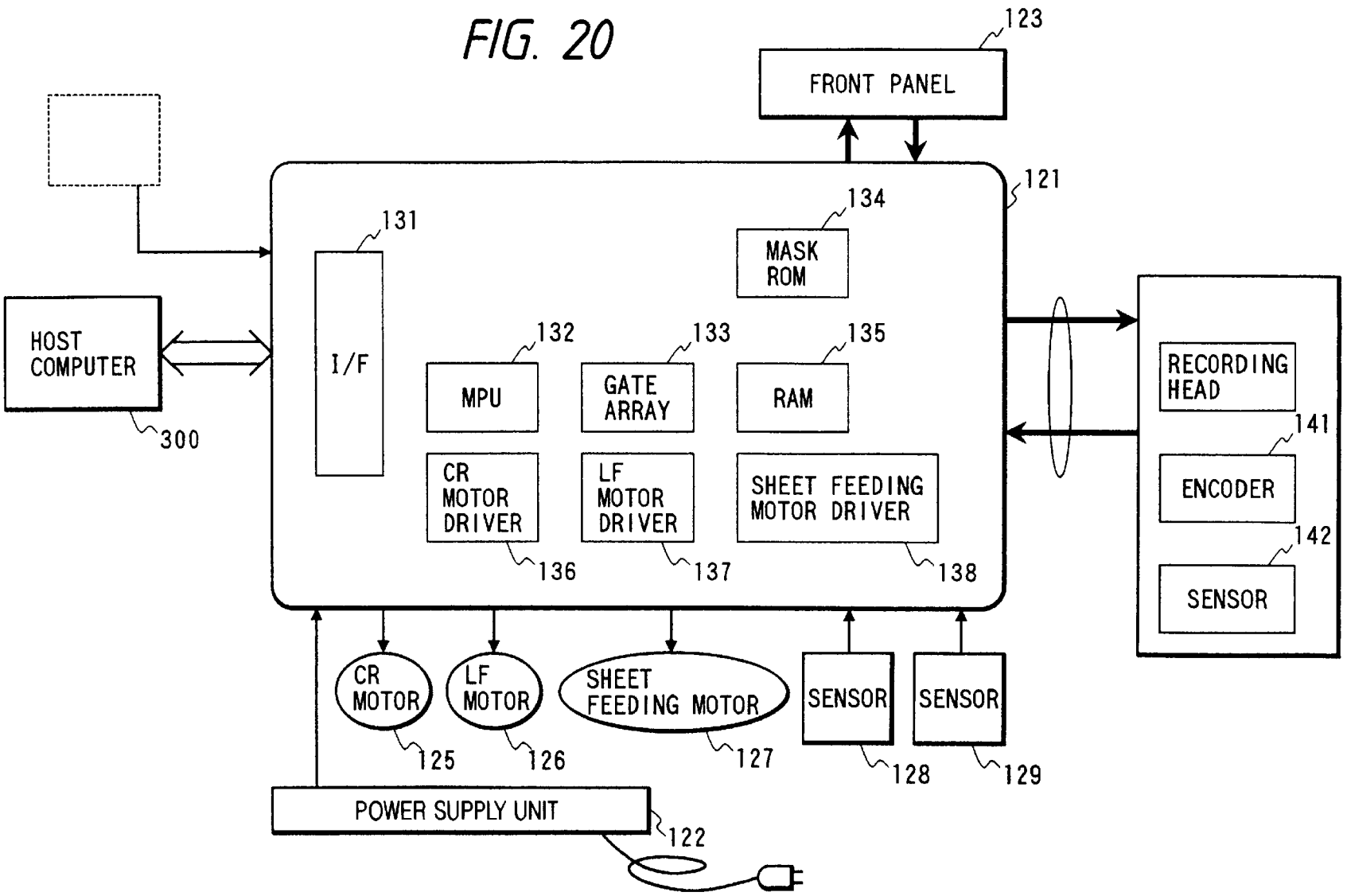
FIG. 20 is a block diagram which shows the structure of the control circuit for a recording apparatus.

There is difference between the conventional recording apparatus 200C and the novel type recording apparatus 200N. The novel type recording apparatus is capable of carrying the recording medium and the carriage faster than the conventional one, for example. However, there is no essential differences in the mechanical constructions between them. Also, the structures of the control system and electric circuitry arranged to operate such mechanically constructed parts are almost the same. What differs between them is whether the designing is made on the premise of providing the conventional type recording head or it is made to maximize the performance of the novel type recording head. FIG. 20 is a block diagram which shows the structure of the control circuit commonly used for the novel type recording apparatus 200N and conventional type recording apparatus 200C. Hereinafter, a description will be provided of these recording apparatuses by designating them only with a reference numeral 200.

The recording apparatus 200 is provided with a CR motor 125 to enable the carriage 50 to travel in the main scanning direction; an LF motor 126 to carry a recording material in the sub-scanning direction; a sheet feeding motor 127 to feed a recording medium to the printing surface; and a control board 121 arranged to drive each of these motors 125 to 127 or the recording head 210C or 210N. The control board 121 is connected with the carriage 50 by means of a flexible cable. At the same time, the power-supply unit 122 and the operational front panel 123 are connected with the control board. Also, an optional interface board may be connected therewith as required. Further, sensors 128 and 129 are connected with the control board 121 in order to detect the positions of the carriage 50 and the paper end of the recording medium.

On the control board 121, there are arranged the interface circuit 131 for connecting this board with an external host computer 300; the MPU 132 in the mode of a microprocessor that executes actual control operations; the mask ROM 134 that stores programs to operate the MPU 132; the RAM 135 that provisionally stores printing data and the like; the CR motor driver 136 that drives the CR motor in accordance with the instructions from the MPU 132; the LF motor driver 137 that drives the LF motor in accordance with the instructions from the MPU 132; the sheet feeding motor driver 138 that drives the sheet feeding motor 127 in accordance with the instructions from the MPU 132; and the gate array 133 that connects each of the circuits and elements described above with each other. The MPU 132 is connected with the host computer 300 through the interface circuit 131, and is arranged to control recording operations in accordance with the program stored in the mask ROM 134. More specifically, the MPU 132 controls the CR motor 125, the LF motor 126 and the sheet feeding motor 127 in accordance with the printing data from the host computer 300, which are stored on the RAM 135 provisionally. At the same time, the MPU controls the recording head 210C or 210N through the driving circuit (see FIG. 22). Also, the front panel 123 is provided with dip switches, key switches, and indication elements formed by light emitting diodes. On the carriage 50, the recording head 210C or 210N is detachably mounted as described above. At the same time, there are arranged on the carriage, the sensor 142 for detecting the current status, as well as the encoder 141 for detecting the positions of the carriage 50.

Figure 4A:
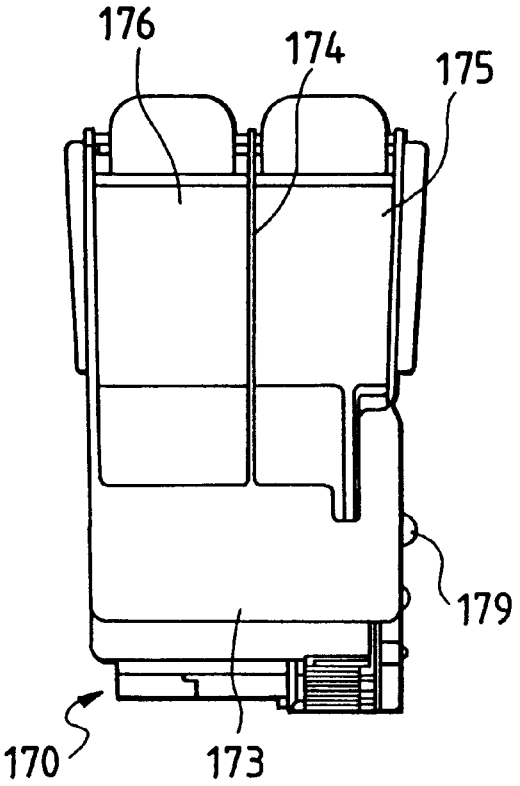
FIGS. 4A, 4B and 4C are views which illustrates a recording head having a separable ink tank.
Figure 4B:
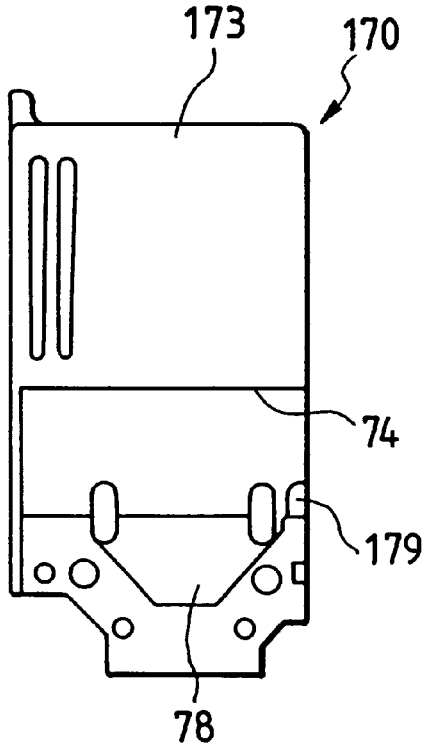
Figure 4C:
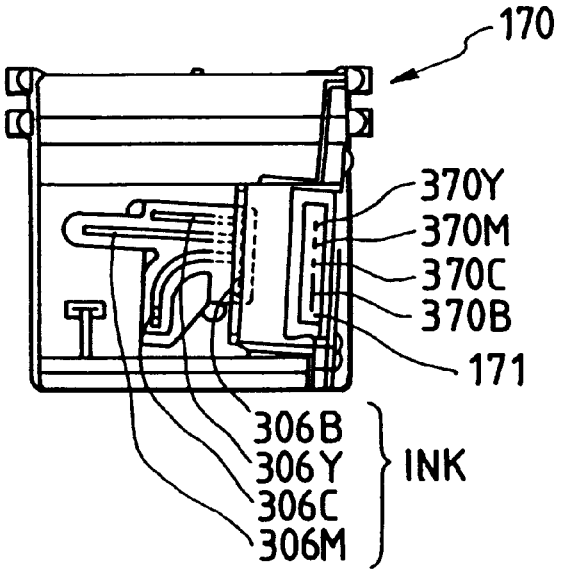
Figure 5A:
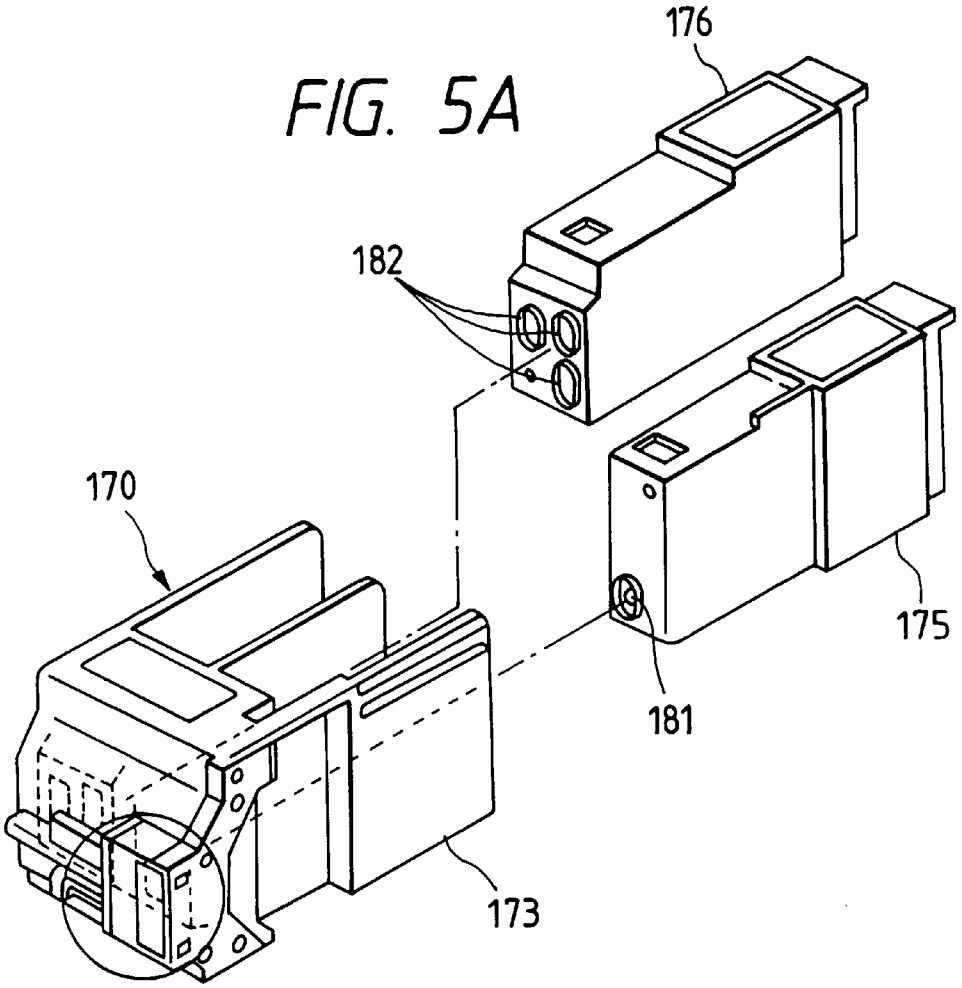
FIGS. 5A and 5B are perspective views which show a method for mounting an ink tank on a recording head.
Figure 5B:
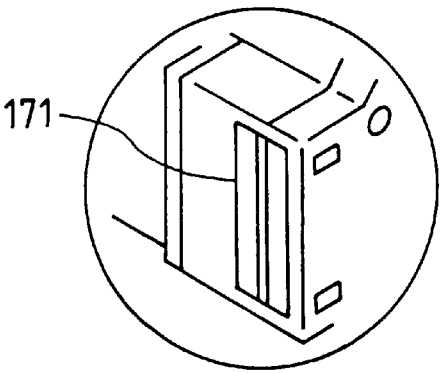
Figure 6B:
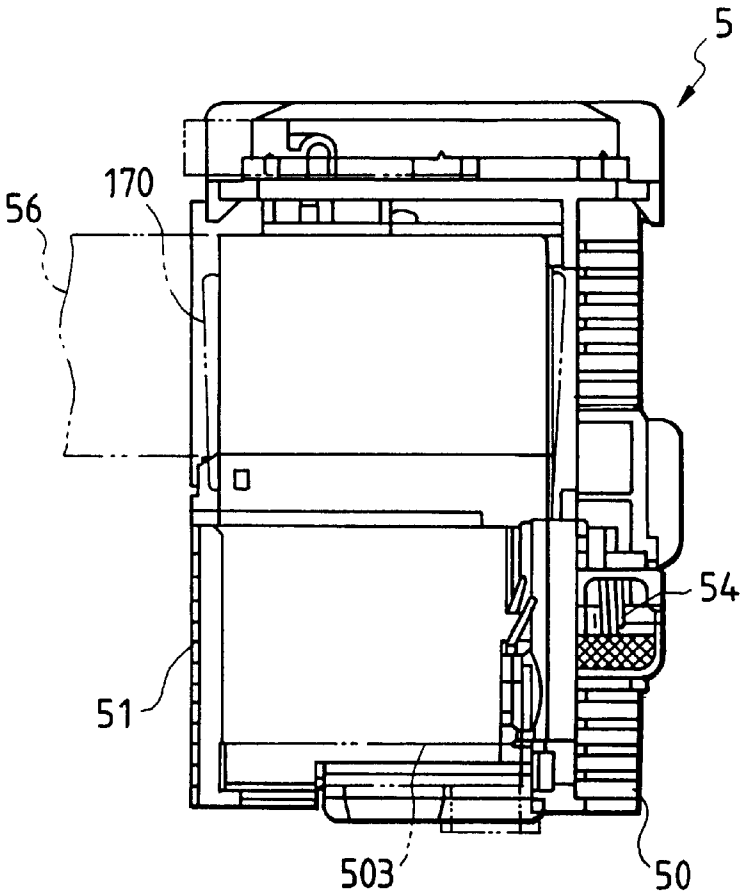
FIGS. 6A and 6B are front views which show the carriage of the ink jet recording apparatus represented in FIG. 1.
Figure 6A:
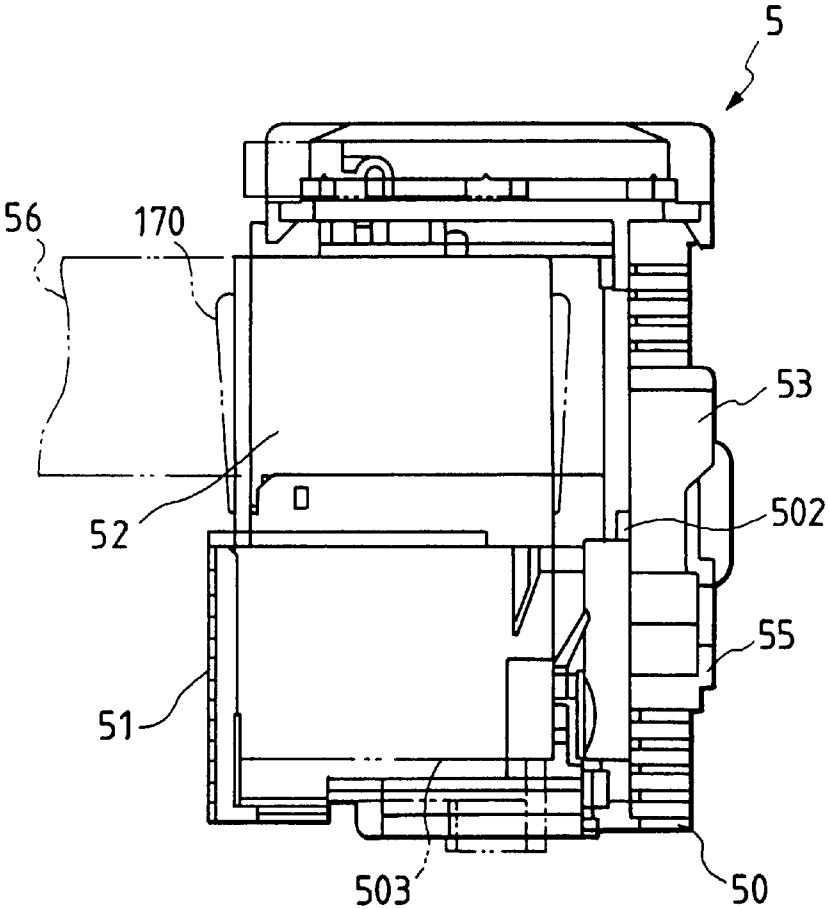
Figure 7A:
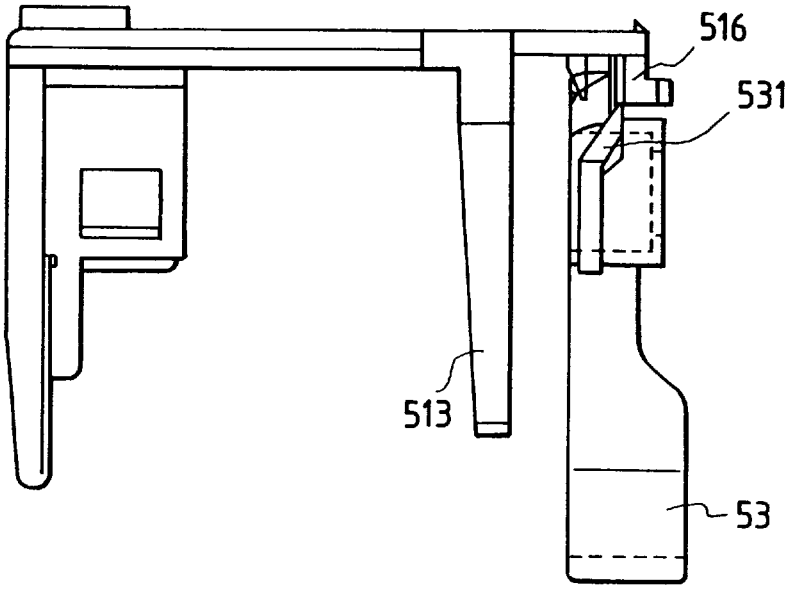
FIGS. 7A and 7B are views which show the principal part of the attachment and detachment mechanism of a head on the carriage represented in FIGS. 6A and 6B.
Figure 7B:
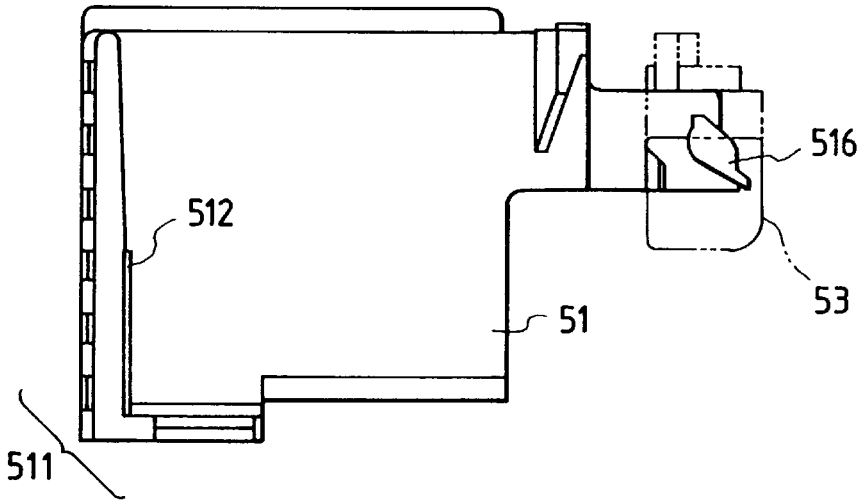
Figure 8:
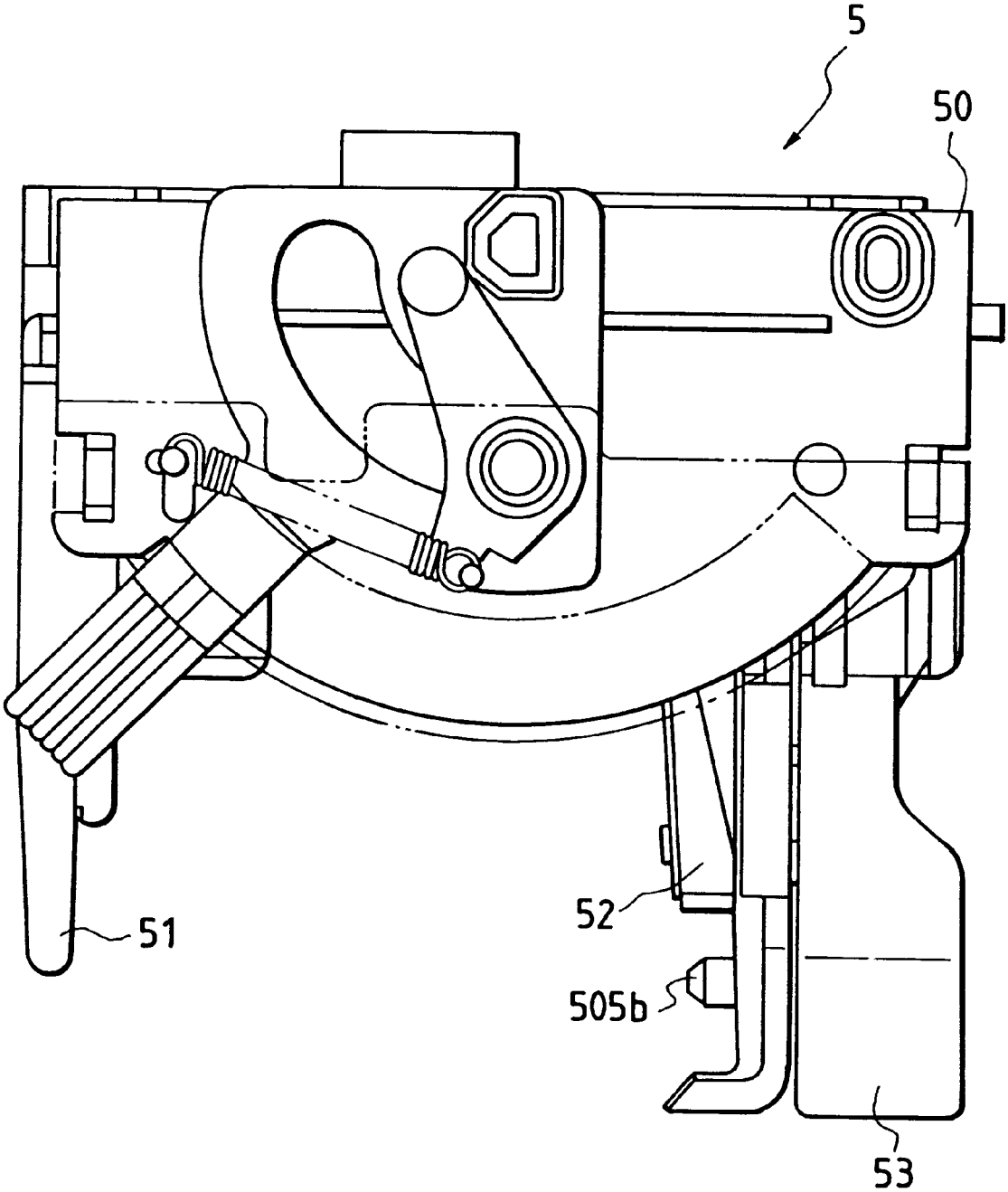
FIG. 8 is an upper surface view which shows the carriage represented in FIGS. 6A and 6B.
Figure 21B:
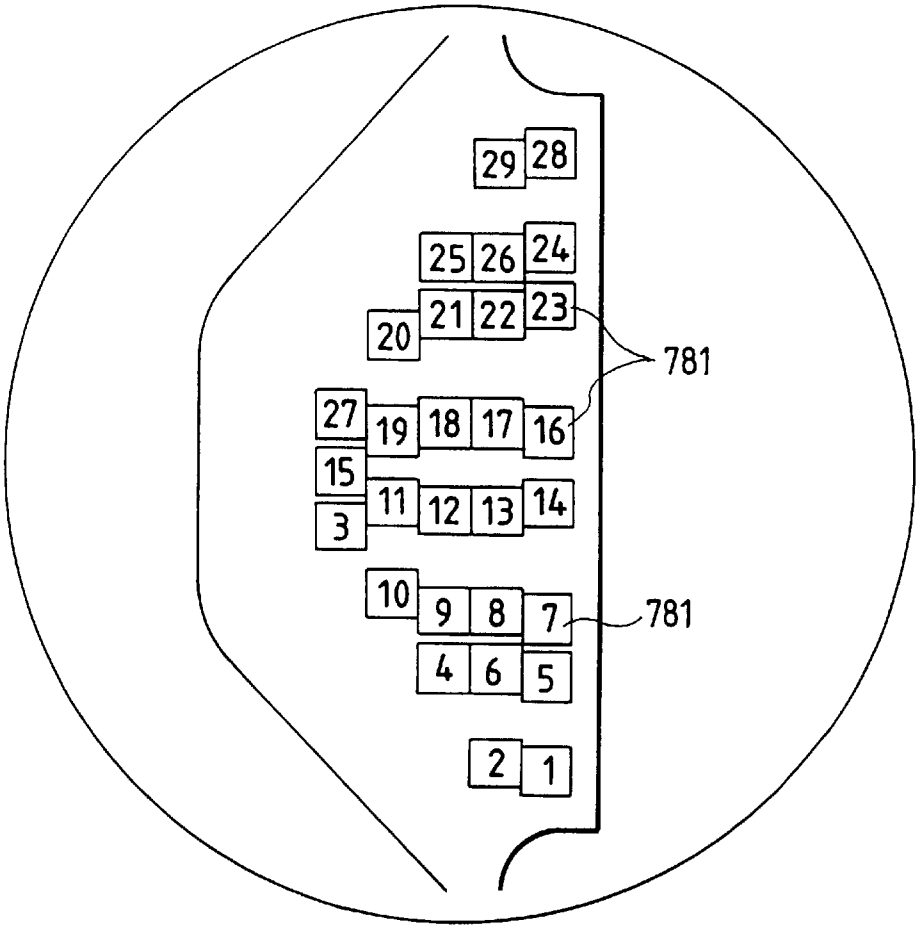
FIGS. 21A and 21B are views which show one structural example of the contact surface of a recording head.
Figure 21A:
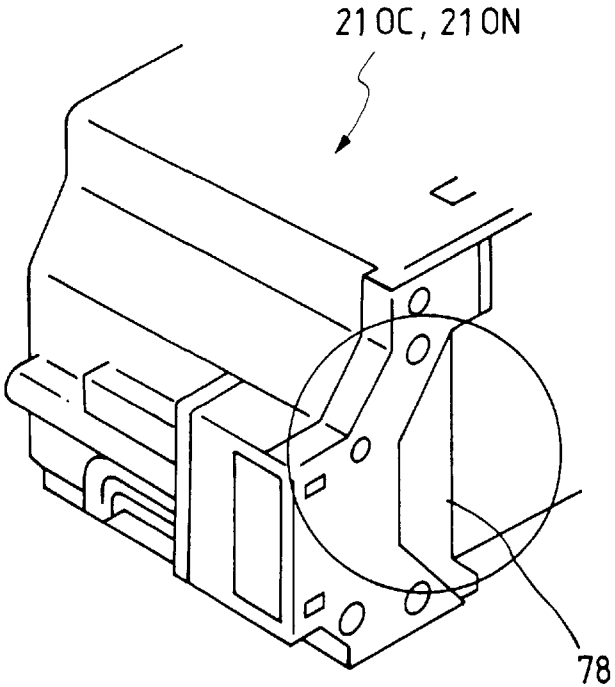

The physical configuration of the recording heads 210C and 210N are the same as the conventional recording head 170 described in conjunction with FIGS. 4A to 4C. In other words, for the recording heads 210C and 210N, the contact surface 78 is arranged with the contact points being positioned in a given pattern. When the recording head 210C or 210N is mounted on the carriage 50, this contact surface 78 engages with the contact surface 561 on the carriage 50 side. Then, it is arranged that the wiring pattern of the flexible cable and the contact points of the recording head are electrically connected reliably in the given facing relationship between them. Here, FIGS. 21A and 21B are views which show the example of the arrangement with respect to the contact surface 78 of the recording head and the contact points 781.

For the present embodiment, it is arranged to identify the type of a recording head mounted on the carriage 50, and the type of an ink tank mounted on the head by means of ID signals. In other words, of the contact points of each of the recording heads 210N and 210C for use of electric connection, some of them are set aside for such IDs of each head identification. Then, each voltage level of such contact points, which are set aside for the IDs, is read out on the apparatus main body side. In this way, for example, it is identified whether a monochrome head is mounted or a color head is mounted. The ink tank to be mounted is also provided with an electrically connected circuit unit, such as arranged in the form of contact points, and the structure is made for the recording apparatus side to be able to read the current status of this unit through the specific contact points of the recording head. In this way, the type of ink tank currently mounted is known to the recording apparatus main body side. Instead of the provision of such an electrically connected circuit unit for the ink tank, it may be possible to make a cut-off portion on a specific position of an ink tank, and the arrangement may be made to detect it by means of a mechanical switch to distinguish one kind of ink tank from another.

Figure 22:
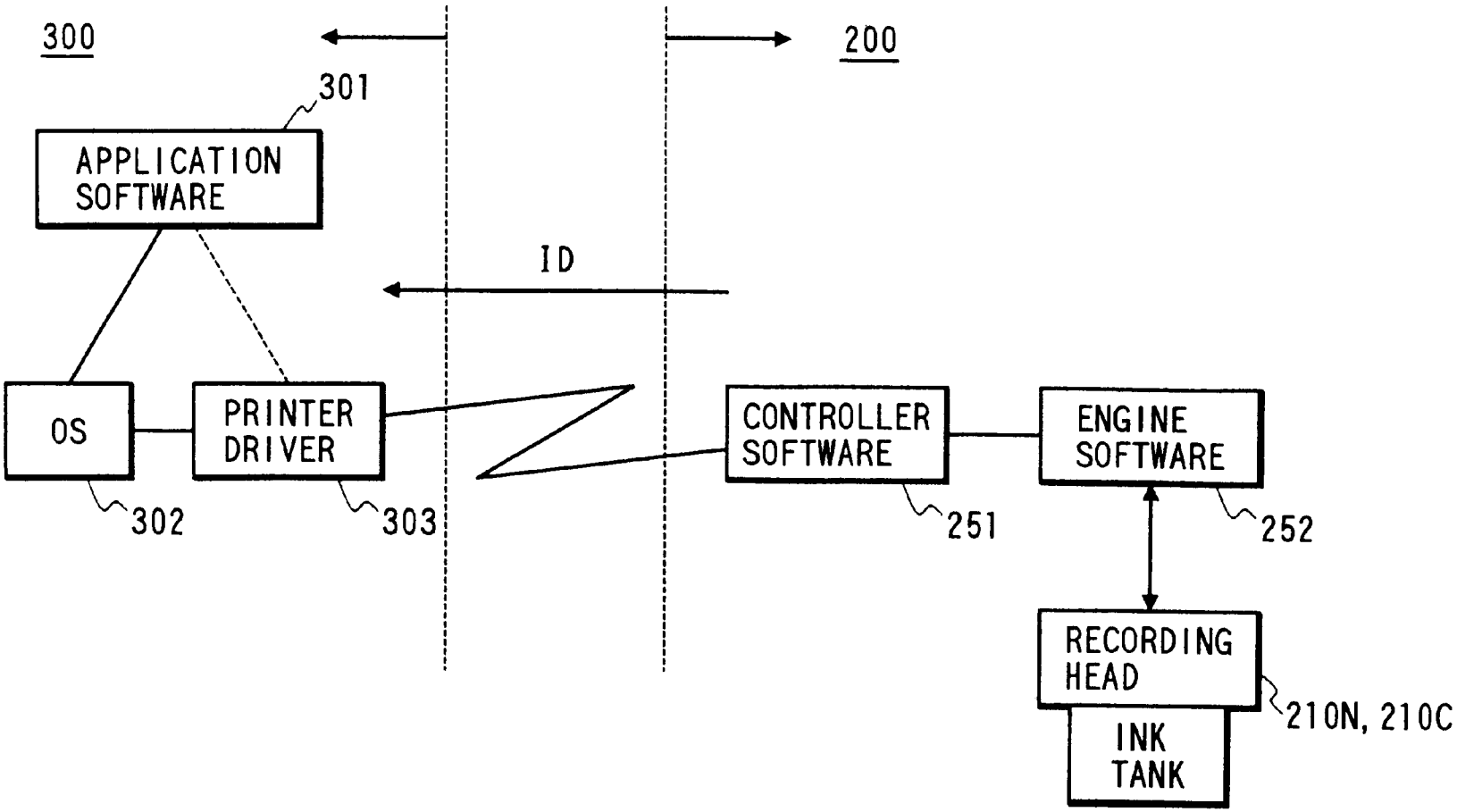
FIG. 22 is a block diagram which shows the structure of software for the ink jet recording system of one mode embodying the present invention.

Now, in conjunction with FIG. 22, a description will be provided of the software structure of this ink jet recording system.

The software provided for the host computer 300 includes an application software 301 of word processing or the like for the printing operation to be executed by the recording apparatus 200; the OS (Operating System) 302 that controls the application software 301, file management, and system call processes, among some others; the printer driver 303 that produces printing data in accordance with the instructions from the OS 302 and transfers them to the recording apparatus 200 side. In some cases, the application software 301 may issue instruction directly to the printer driver 303. In any case, however, the printer driver 303 executes altogether the production of printing data and the transfer thereof from the host computer 300 to the recording apparatus 200.

As described above, the printer driver is made independent as a device driver. Therefore, it is unnecessary to provide the application software 301 and the OS 302 itself with routines to control the recording apparatus precisely. In this way, the overall efficiency of the system is enhanced. More specifically, the color information, which is handled by the application software 301 or the OS 302, is usually represented by the luminance of each component of three colors, RGB (R=red, G=green, and B=blue). However, for a color ink jet printer, the color information is represented by each density of four colors, CMYK (C=cyan, M=magenta, Y=yellow, and K=black). Therefore, the conversion of the color information is necessary. Also, the resolution of image data is different on the application side and the printer side, and the degree of gradation is often different between them. Therefore, a conversion process is also required for matching them. The printer driver 303 performs a conversion of the kind altogether, hence making the load lighter on the side of application software 301 or the OS 302. In accordance with the present embodiment, the printer driver 303 also executes the compatibility processing for the novel and conventional types of recording apparatuses.

On the other hand, the recording apparatus 200 is provided with the controller software 251 that receives printing data from the printer driver 303, and at the same time, this software controls the entire operation of the recording apparatus 200 in the capacity as a software, and also, it is provided with the engine software 252 that generates driving signals for the mounted recording head 210N or 210C by the control of the controller software 251.

For this ink jet recording system, it is arranged to output the ID signal that indicates the kinds of recording head and ink tank from the recording apparatus 200 to the host computer 300 in order to notify the host computer 300 of the type of the recording head and ink tank mounted on the recording apparatus 200. In this respect, the kind of ink tank corresponds to the kind of ink retained in such ink tank.

Figure 23:
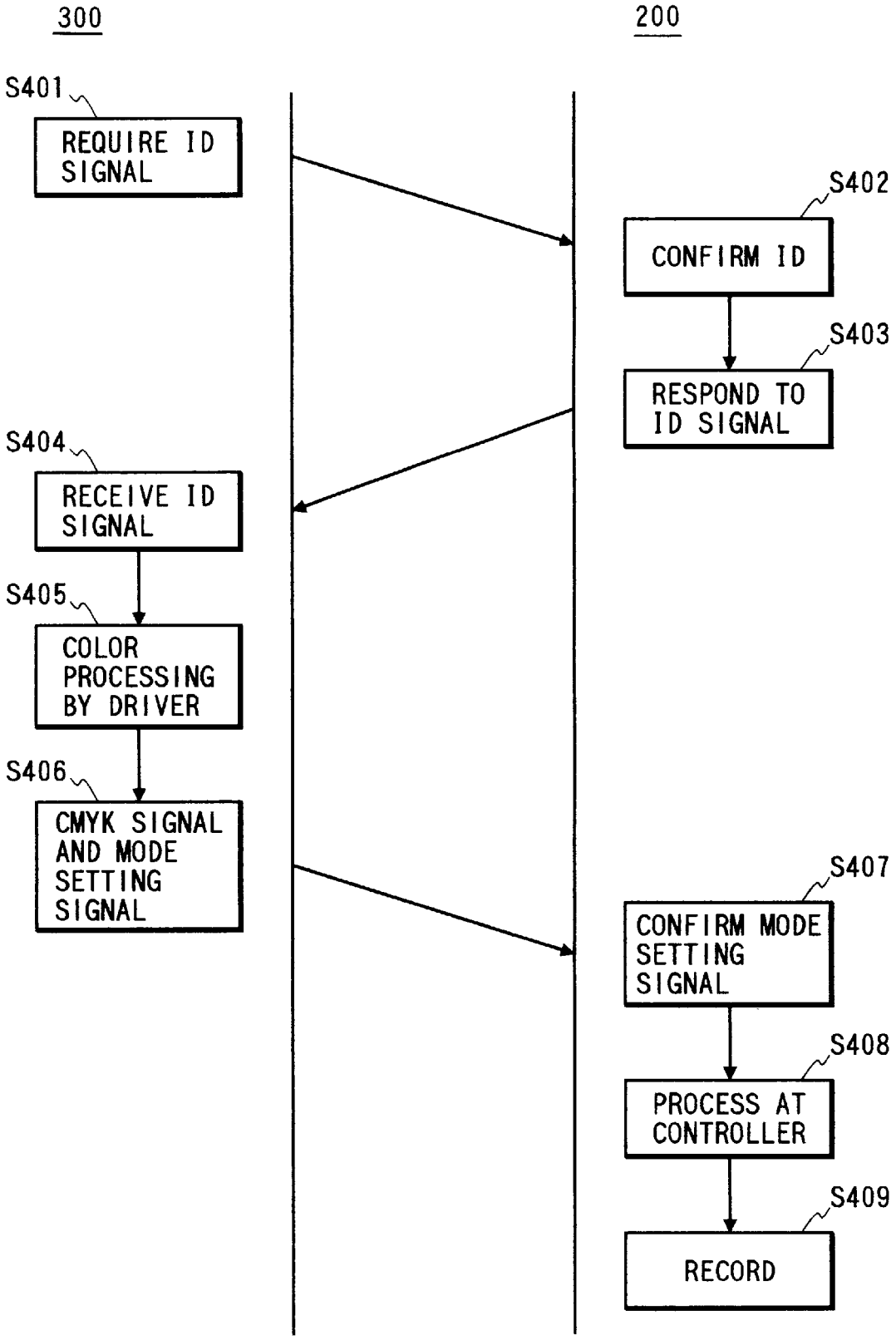
FIG. 23 is a view which shows a time series representing signals exchanged between a host computer and a recording apparatus.

FIG. 23 is a view which shows the signals exchanged between the host computer 300 and the recording apparatus 200 in accordance with the time series set for them. In other words, the host computer 300 issues at first a request of the ID signals and transmits it to the recording apparatus 200 side when the printer driver 303 is instructed to make a printing output (step 401). When receiving this request, the recording apparatus 200 confirms the IDs (kinds) of the mounted recording head and ink tank (step 402), and transfers them to the host computer 300 side (step 403). When the host computer 300 receives the ID signals (step 404), the printer driver 303 executes color processing (step 405) in accordance with the ID numbers thus received, that is, the kind of the recording head mounted on and the kind of ink used by the recording apparatus 200. Thus, the printer driver generates the CMYK signals and mode setting signals and transmits them to the recording apparatus 200 side (step 406). When receiving the CMYK and mode setting signals, the recording apparatus 200 confirms the contents of the mode setting signals (step 407). Then, the required control processing is executed by the controller software (step 408) as required in order to record on a recording medium (step 409).

Figure 24:
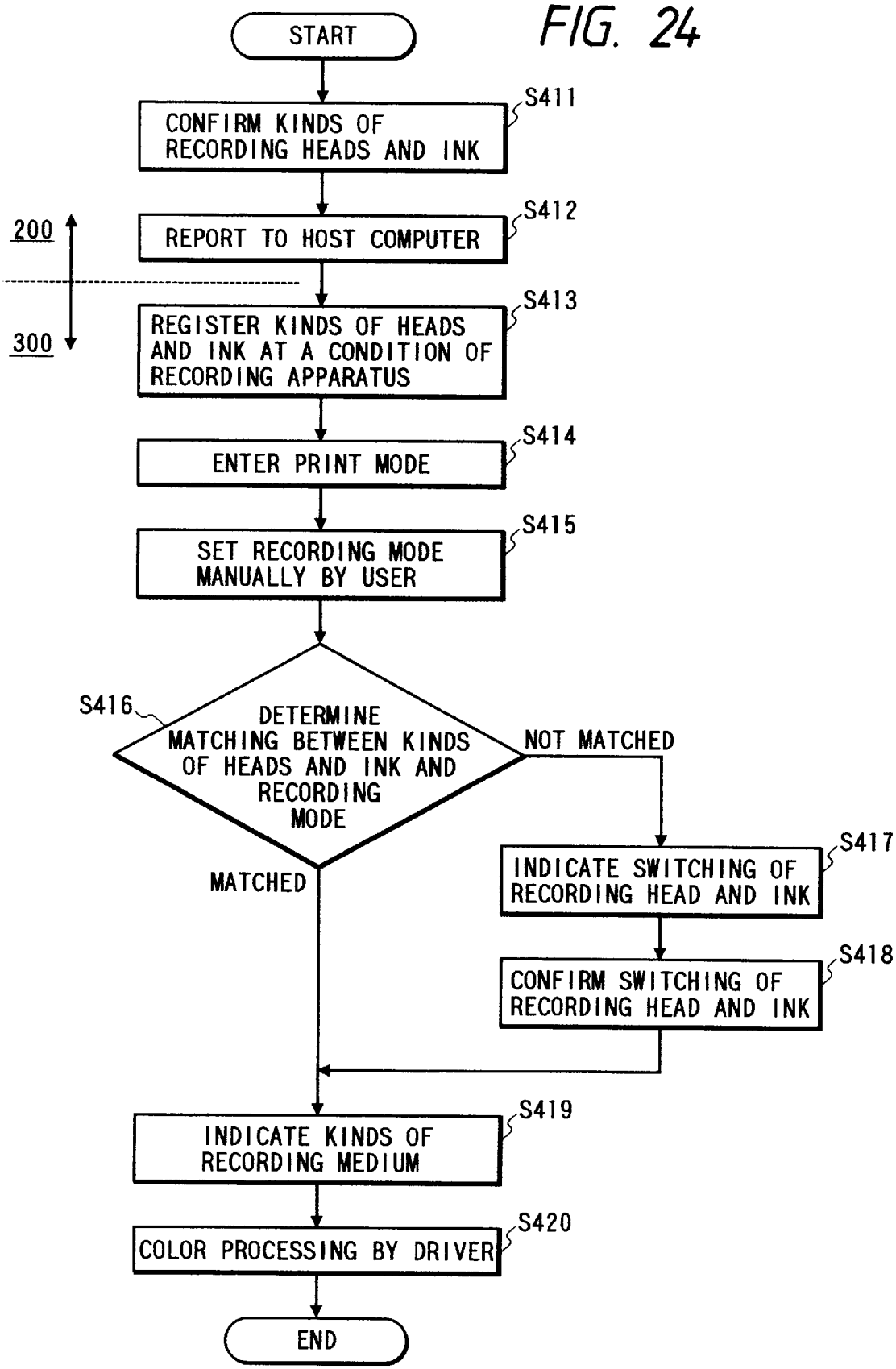
FIG. 24 is a flowchart which illustrates the operation of the ink jet recording system.

Now, in conjunction with FIG. 24, a description will be provided of the operation of recording by use of this ink jet recording system.

At first, the recording apparatus 200 confirms the kinds of mounted recording head and ink tank (step 411) and notifies the host computer 300 of these kinds as ID signals (step 412). Then, the host computer 300 requests that the printer driver 303 should register the kinds of the recording head and ink tank as the current status of the recording apparatus (step 413). Thus, the operation enters the printing mode (step 414), and as shown in FIG. 25, the indications are shown to prompt the user to select the recording mode. The user sets the recording mode manually (step 415). At this juncture, the host computer indicates the image quality and printing time in accordance with the kinds of images to be printed, thus making it easier for the user to select the recording mode as required. For example, it should be good enough if only the relationship between the number of passes and the reduction effect of unevenness and slippage is indicated. Then, the printer driver 303 determines whether or not there is any consistency between the kinds of the recording head and ink tank (that is, the kind of ink), and the recording mode (step 416). If affirmative, the process proceeds to step 419. If negative, the message is shown to prompt the replacement of recording heads and/or ink tanks as shown in FIG. 26 (step 417). After confirming whether or not the recording head and/or ink tank has been replaced (step 418), the process proceeds to step 419. In the step 419, the kind of recording medium, which should be installed on the recording apparatus, is indicated for the user as shown in FIG. 27. After that, the printer driver 303 executes color processing (step 420), thus terminating the process.

Figure 28:
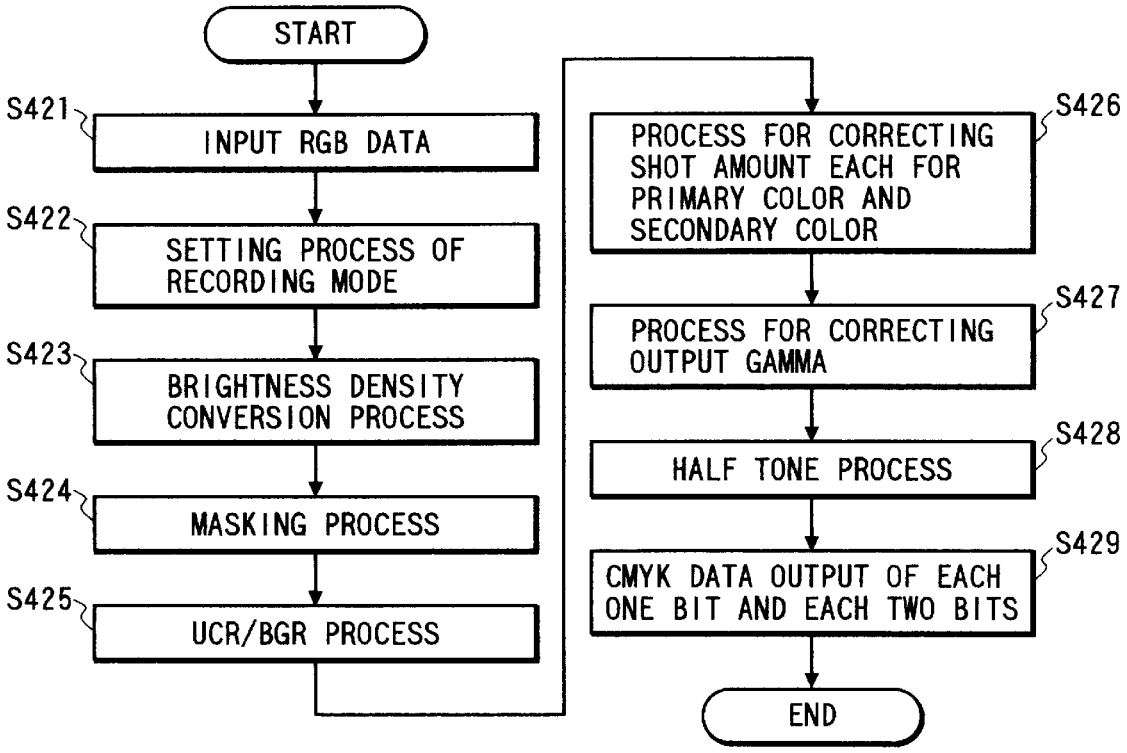
FIG. 28 is a view which illustrates the color processing by means of a printer driver.

FIG. 28 shows the outline of the color processing by means of the printer driver 303. When the data on RGB are inputted (step 421), the process is performed for setting the recording mode (step 422). In continuation, the processes are sequentially executed as given below among some others: the conversion process of each luminance of RGB data into each density (step 423); the masking process (step 424); the UCR/BGR process (step 425); the correction process of shot amounts of ink droplets for each of the primary color and the secondary color (step 426); the γ correction process for output data (step 427); and the process representing half tone by means of dither diffusion (step 428). Then, the input data are output as one bit or two-bit data of CMYK per color (step 429), then terminating the process. Regarding these processes executed by the printer driver 303, each processing is of course performed appropriately depending on whether the novel type recording head 210N or the conventional type recording head 210C is mounted on the recording apparatus 200 as the current recording head or whether the novel type ink tank retaining the novel type ink 220N or the conventional type ink tank retaining the conventional type ink 220C is installed as the current ink tank. For example, if the novel type ink is supplied, while the novel type recording head 210N is mounted on the conventional type recording apparatus 200C, it is made possible for the related processing to provide the best result of recording per process described above when using the novel type recording head 210N and the novel type ink within the allowable hardware restrictions existing by use of the conventional type recording apparatus 200C in this particular case.

(Security of Compatibility between the Conventional Type and the Novel Type)

In order to secure compatibility between the conventional type ink, the recording head, and the recording apparatus, and the novel type ink, recording head, and recording apparatus with each other, the following aspects should be taken into consideration in particular:

(1) Method for Discriminating the Contact Pads and the Kinds of Heads

The contact pads are arranged to be able to discriminate the mounted recording head and the kind of mounted ink tank irrespective of the conventional or novel type recording head mounted on the conventional or novel type recording apparatus. Here, however, the method for discriminating one recording head from another is not necessarily limited to the method that uses the contact pads. It may be possible to adopt a method that uses a mechanical switch provided for a carriage, while providing a cut-off portion in a specific position of a recording head, which is detected by the mechanical switch thus provided. Also, it should be arranged to avoid any discrepancies between the conventional and novel type recording heads as to the arrangements of signal lines, control lines and power-supply lines with respect to the contact pads. ROM or other devices may be adaptable in this respect.

(2) Setting of Condition Related to Driving Control

The optimal value of electric power of pulses, which is applicable to each of the electrothermal transducing elements (heat generating elements) in a recording head, is different between the novel type recording head and the conventional type recording head. Therefore, if the temporal width of a pulse, which is made applicable to a recording head from a recording apparatus side, is fixed, it is desirable to change the driving voltage (pulse voltage) $V_{op}$ in accordance with a recording head to be used. More specifically, the sheet resistance value of the electrothermal transducing element is made changeable on the head side or conceivably, it is possible to change the driving voltage on the recording apparatus main body using a DC-DC converter. In particular, if the compatibility with the conventional type recording apparatus should be taken into account, it may be advisable to provide the DC-DC converter, a drop converter, or some other voltage converting mechanism for the interior of the novel type recording head. On the other hand, if the driving voltage is constant, the pulse is made changeable. As a method for changing the pulse temporal width in accordance with recording heads, there is the method for referring to a pulse table having temporal widths of a pulse per kind of recording head stored on it; the method for driving a head by a temporal width per rank by classifying recording heads into several ranks; the method for using an one shot multiple vibrator circuit, or the like.

When changing the driving methods in accordance with recording heads, a driving method is selected from among sequential driving, sequential dispersion driving, dispersion driving and some others. Then, the block numbers of the synchronized driving, and the odd/even control are selected from among others. Also, it should be arranged to provide an appropriate control of breakage prevention, while taking the types of the recording heads and recording apparatus main bodies into consideration. Further, in order to make the recording densities agreeable, it is necessary to implement the modification of the driving frequencies, the discharging amounts, the recording methods, and the like.

(3) Setting of Condition Related to the Recovery Control

If the combination is not appropriate as to the condition of recovery control between a recording head and a recording apparatus, such drawbacks as unevenness, bubble generation, sticky fixation, mist generation, wet generation may take place, among some others. Therefore, depending on the kinds of recording heads, it is necessary to optimize the combination of the numbers of suction, the amount of suction, the numbers of pre-discharge, the intervals of pre-discharges, the numbers of wiping, the intervals of wiping operations, as well as to optimize the sequence of such recovery operations.

(4) Setting of Condition Related to the Printing Control

Generally, different kinds of ink are used for the conventional type recording head, and the novel type recording head, respectively. Therefore, color densities and fixation properties of ink are different accordingly. As a result, in accordance with the kinds of recording heads, it is necessary to optimize the mask, the number of passes, the carriage speeds (driving frequencies), the sheet feeding, the image processing (color, γ correction, and binarization), the amount of ink shooting, or the like for the suppression of the generation of printing unevenness, slippage, stripes, textures, bleeding, and white fogs, among some others, as well as to optimize them for the enhancement of the fixation.

(5) Setting of Condition Related to the Temperature Detection

The temperature detection should be conducted to control temperatures and the like in order to control an ink jet recording head. Therefore, it is necessary to set conditions with respect to the detection of temperatures by the use of temperature sensors; the determination of control methods and driving methods; the determination of the characteristics of heads, abnormal operations, and the like in accordance with each of the heads to be used. Particularly, in order to decide on the controlling and driving methods, and recognize the characteristics of the heads, it is necessary to utilize the IDs provided for each of the recording heads, and the rank resistance for classifying recording heads.

(Embodiments of the First Mode Embodying the Present Invention)

Now, a description will be provided of the examples by citing the numerical values thereof, in which good recording is performed, while maintaining the compatibility between the recording apparatuses, the recording heads, and the ink tanks of the conventional and novel types. Here, two kinds of conventional type and novel type recording apparatuses, recording heads, and ink tanks are adopted. Therefore, the total number of combinations should become 8 ($=2^3$). In consideration of the actual aspects encountered, the replacing frequency of the recording head is smaller than that of the ink tank, although the recording head is also one of the expendables. It is mostly the case where ink shortage takes place that the compatibility is needed. Therefore, in the description given below, the combination of the recording head and recording apparatus is fixed for the one between the conventional types or the one between the novel types as shown in the Table 1. Then, for the combinations of these recording heads and recording apparatuses, the cases are taken up for consideration, where the ink tank that retains the novel type ink 220N or the conventional type ink tank retaining the conventional type ink 220C is made applicable. The case 1, which is for the combination of conventional types alone, and the case 2, which is for the combination of novel types alone are based on the method of uses fundamentally anticipated. The case 3 and the case 4, which are for the combinations of the novel type and conventional type are not the method of uses that are fundamentally anticipated, but such methods of use may take place in the market.

TABLE 1

| | Ink | Head | Apparatus |
|---|---|---|---|
| Case 1 | Conventional | Conventional | Conventional |
| Case 2 | Novel type | Novel type | Novel type |
| Case 3 | Conventional | Novel type | Novel type |
| Case 4 | Novel type | Conventional | Conventional |
| Remarks | | | |
| Case 1 | Fundamental method of use (Conventional) | | |
| Case 2 | Fundamental method of use (Novel type) | | |
| Case 3 | Method of use that may take place in market | | |
| Case 4 | Method of use that may take place in market | | |

Now, hereinafter, a description will be provided of the novel type recording head using the recording head prepared in accordance with the new discharging principle shown in FIGS. 12A, 12B, 12C, 12D, 13, 14, 15, 16, 17, 18, 19A and 19B, and it is made of the conventional type recording head using the recording head shown in FIGS. 3, 4A, 4B and 4C. Here, the novel type ink is assumed to be the one discharged by such novel type recording head, and the conventional type ink is assumed to be the one discharged by such conventional recording head.

Embodiment 1

Here, ink for high speed recording is used as the novel type ink, and the recording head of one-flow path structure shown in FIGS. 12A, 12B, 12C, 12D, 13, 14, 15 and 16, which is made usable for this high speed ink, is adopted as the novel type recording head. Then, the description will be provided of the structure arranged to maintain the compatibility related to the driving relationship in this case.

The refilling frequency of the conventional type ink is a maximum 8.0 kHz. The conventional type recording apparatus 200C, which is designed on the premise that it should fit the use of the conventional type ink using the conventional type recording head 210C, is suitably applicable to a recording method of 360×360 dpi to 720×360 dpi, having a maximum driving frequency of 8.0 kHz, carriage driving frequency of 8.0 kHz (at the time of 360 dpi) or 4.0 kHz (at the time of 720 dpi), and a driving voltage of 24 V.

On the other hand, the novel type ink has its maximum refilling frequency of 20.0 kHz. The novel type recording apparatus 200N is designed on the premise that it is suitably applicable to this novel type ink using the novel type recording head 200N. Then, it is applicable to the recording method of 360×360 dpi to 720×720 dpi, having a maximum driving frequency of 20.0 kHz, a carriage driving frequency of 8.0 kHz (at the time of 360 dpi) or 4.0 kHz (at the time of 720 dpi), and a driving voltage of 18 to 24 V.

For the case 1 and case 2, which are the fundamental methods of use, it is possible to execute printing by discharging each ink at the maximum refilling frequency, using each of the recording heads 210N and 210C with the fundamental performance of each of the recording apparatuses 200N and 200C.

When the conventional type ink, the novel type recording head 210N, and the novel type recording apparatus 200N are combined (the case 3), it is arranged to enable the recording apparatus 200N side to meet all the requirements. More specifically, the novel type recording apparatus 200N is made suitably applicable to the recording method of 360×360 dpi to 720×720 dpi fundamentally. However, it is used by the application of the recording method of 360×360 dpi to 720×360 dpi. Further, although the maximum driving frequency of the recording apparatus 200N is 20.0 kHz, the apparatus is used at 8.0 kHz. Likewise, the driving voltage is made 24 V. The carriage driving frequency remains as it is at 4.0/8.0 kHz. In this way, even when the conventional type ink is used by the combination of the novel type recording head 210N and the novel type recording apparatus 200N, it becomes possible to execute recording.

On the other hand, when the novel type ink is applied to the combination of the conventional type recording head 210C and the conventional type recording apparatus 200C, that is the case 4, no problem is caused by the use of the novel type ink if ink is discharged at the driving frequency of 8.0 kHz at the driving voltage of 24 V.

(Embodiment 2)

Here, as the novel type ink, a high reliability ink is used. As the novel type recording head, the recording head of two-flow path structure shown in FIGS. 17, 18, 19A and 19B, which is applicable to this high reliability ink, is adopted. Then, a description will be provided of a structure to maintain the compatibility as to the recovery relationship.

The recovery condition of the conventional type ink is that the suction amount thereof is 0.05 cc, and the suction amount is 0.15 cc when the recovery process is executed in mode 2. It is regulated for both cases that the suction pressure is set at 0.5 atm, and that 10 shots of pre-discharges are executed per line currently in printing, with 200 shots before and after printing, and 2,000 shots after suction, and then, wiping is performed per 10 seconds in printing, per page, and after each suction.

The conventional recording apparatus 200C capable of executing the recovery process thus regulated for the conventional type ink has a suction amount of 0.05 to 0.15 cc and a suction pressure of 0.2 to 0.5 atm. The driving frequency of pre-discharge is 2 to 8 kHz. This apparatus is capable of performing the pre-discharges of 10×N shots (N=natural number). Further, the wiping direction is one way, and the amount of intrusion is constant with the wiping speed being fixed at 100 mm/s. On the conventional type recording apparatus 200C, the conventional recording head 210C is mounted, which suitably fits the use of conventional type ink described above.

The novel type ink requires the pressurized recovery of the head. As the condition of such recovery process, the amount of suction is set at 0.01 to 0.05 cc at the time of performing the recovery in mode 1, and the amount of push out is at 0.1 to 0.5 cc under pressure of the recovery process in mode 2, with the pre-discharges being five shots per line in printing, 50 shots before and after printing, and 500 shots after suction, and it is regulated that the wiping is performed per page and after suction.

The novel type recording apparatus 200N capable of the recovery process regulated for this novel type ink is provided with such pressurized recovery device, which presents a suction amount and push-out amount of 0.01 to 0.5 cc, the suction pressure and compression pressure being 0.2 to 0.4 atm. Further, this recording apparatus 200N has a pre-discharge whose driving frequency is 1 to 2 kHz, and is capable of performing the pre-discharges of 20×N shots (N=natural number). Further, the wiping direction is one way, and the amount of intrusion is constant with the wiping speed being fixed at 150 mm/s. The novel type recording apparatus 200N is mounted with the novel type recording head 210N matched with the novel type ink.

For case 1 and case 2, which are the fundamental methods of use, the recovery processes are performed for each of the recording heads 210C and 210N described above by use of each of the recording apparatuses 200C and 200N in accordance with the recovery conditions regulated for each of the recording heads. However, in case 2, the number of the predischarge of the recording apparatus 200N is indicated by 20×N, and the number of the predischarge for each line is 20 and the number of the predischarge for each page is 60.

When the conventional type recording head 210C and the novel type recording apparatus 200N are combined (case 3), it is arranged to enable the recording apparatus 200N side to meet all the requirements. More specifically, the novel type recording apparatus 200N is arranged to perform only the suction recovery, although it is capable of executing both the suction and compress operations. The recording apparatus 200N only generates the section pressure of 0.4 atm and this does not satisfy the regulated value of the conventional type ink. Therefore, the number of the section increases so as to perform the recovery process. Also the number of the predischarge for each line is 20 due to the regulated conditions of the recording apparatus 200N.

On the other hand, when the novel type recording head 210N is mounted on the conventional type recording apparatus 200C, the conventional type recording apparatus 200C is unable to perform the pressurized recovery. Therefore, it is impossible to execute the recovery regulated for this novel type ink. In this case, the message is shown to indicate that the novel type ink is not usable.

Embodiment 3

Here, as the novel type recording head, the recording head of two-flow path structure shown in FIGS. 17, 18, 19A and 19B, which is made applicable to the high coloring pigmental ink, is adopted. Then, a description will be provided of the structure to maintain the compatibility as to the printing control relationship.

Ink used for the conventional type recording head 210C is a YMCK colorant ink whose reflection density is 1.1 each with respect to an ordinary paper sheet, and 1.3 each with respect to a paper sheet dedicated to the use of such ink. Bleeding is slightly generated. It is not provided with any water proofing treatment.

The conventional recording apparatus 200C, which fits the use of the conventional type recording head 210C is arranged to select one or four passes for black and two, four, or eight passes for color as the number of passes at the time of printing, with the use of a fixed mask for the execution of the usual image processing.

Ink used for the novel type recording head 210N is a CMYK pigmental ink having the reflection density of 1.4 each with respect to an ordinary paper sheet, and 1.6 each with respect to a paper sheet dedicated to the use of such ink. It has no bleeding and the water proofing treatment is given to it.

The novel type recording apparatus 200N, which fits the use of this novel type recording head 210N is arranged to select one, two, or four passes for black and one, two, four or eight passes for color as the number of passes at the time of printing, with the use of a fixed mask or random mask being selected depending on images for the execution of the image processing accordingly, while discriminating characters from images.

For case 1 and case 2, which are the fundamental methods of use, each of the recording apparatuses 200C and 200N executes the printing control process with respect to the recording heads 210C and 210N in accordance with the performance values of each recording head respectively.

When the conventional type recording head 210C and the novel type recording head 210N, and the novel type recording apparatus 200N are combined (case 3), it is arranged to enable the recording apparatus 200N side to meet all the requirements. More specifically, the novel type recording apparatus 200N is arranged to select one or four passes for black and two, four or eight passes for color, with the use of a fixed mask of the two, the random mask and the fixed mask, and execute an appropriate process as the image processing by discriminating characters from images. In this case, since the appropriate process is adopted, the image quality is enhanced as compared with the case where the conventional recording head 210C is mounted on the conventional recording apparatus 200C.

For case 4 where the novel type recording head 210N is mounted on the conventional type recording apparatus 200C, it is impossible for the recording apparatus 200C to select the passes but one or four for black and two, four, or eight for color, and also, the mask that can be prepared is only the fixed one, while the image process is limited to the usual processing. Therefore, although printing is possible, the image quality becomes inferior, among some others, as compared with the case where the novel type recording head 210N is mounted on the novel type recording apparatus 200N. Therefore, printing is performed, while giving an indication to the user to the effect that the system is usable, but the quality of the image is lowered.

For the conventional type recording apparatus 200C to select only one or four passes for black and two, four or eight passes for color, with only the fixed mask being prepared, while the image processing is limited only to the usual one. Therefore, printing is possible, but the image quality becomes inferior, among some others, as compared with the combination of the novel type ink, the novel type recording head 210N and the novel type recording apparatus 200N. Therefore, printing is performed, while notifying the user by indicating to the effect that the combination is applicable, but the image quality should be lowered.

Now, a description has been provided of the preferred mode embodying the present invention and the embodiments thereof. However, the present invention is also applicable to the case where the head using piezo-elements are adopted as the first ink jet recording head of the present invention.

As described above for each of the embodiments of the first mode embodying the present invention, the ink jet recording system thereof, which forms images on a recording medium by discharging ink from the discharge ports of the exchangeable ink jet recording head, which is made capable of separating an ink tank from the head, comprises a mounting unit that exchangeably mounts at least two kinds of ink jet recording heads having different recording characteristics; and discriminating means for discriminating the kinds of the ink jet heads mounted on the mounting unit, and the kinds of ink tanks mounted on such ink jet recording heads. Then, with the provision of means for setting the optimal condition within the allowable range in accordance with the kinds of ink jet recording head and the kind of ink tank thus discriminated, this ink jet recording system demonstrates the effect of maintaining compatibility between the novel type ink, the conventional type of recording head, and the conventional type of recording apparatus; or between the conventional type ink, the novel type recording head, and the novel type recording apparatus; or between each of various novel type recording heads, as well as demonstrating the effect of performing the best recording on the premise of the combination of given ink, recording head, and recording apparatus. By maintaining the compatibility in this way, it becomes possible to deal with the image processing, and the anticipated future improvement of coloring materials, recording media, and the like. Also, it is anticipated to facilitate the procurement of the system and enhance the selectivity thereof at lower procurement costs. There are also effects that the image quality, recording speed, and reliability are significantly enhanced, while reducing power consumption and running costs.

(Second Mode Embodying the Present Invention)

Now, a description will be provided of the example of the head cartridge mode, in which a recording head and an ink container (ink tank) retaining ink in it are integrally formed. For this head cartridge mode, there is no occasion that the recording head or the ink container is replaced individually. As a result, the combination of the recording head and the ink container does not change. In accordance with the present mode embodying the invention, the head cartridge formed by a recording head and an ink container together is simply called a recording head.

Figure 9:
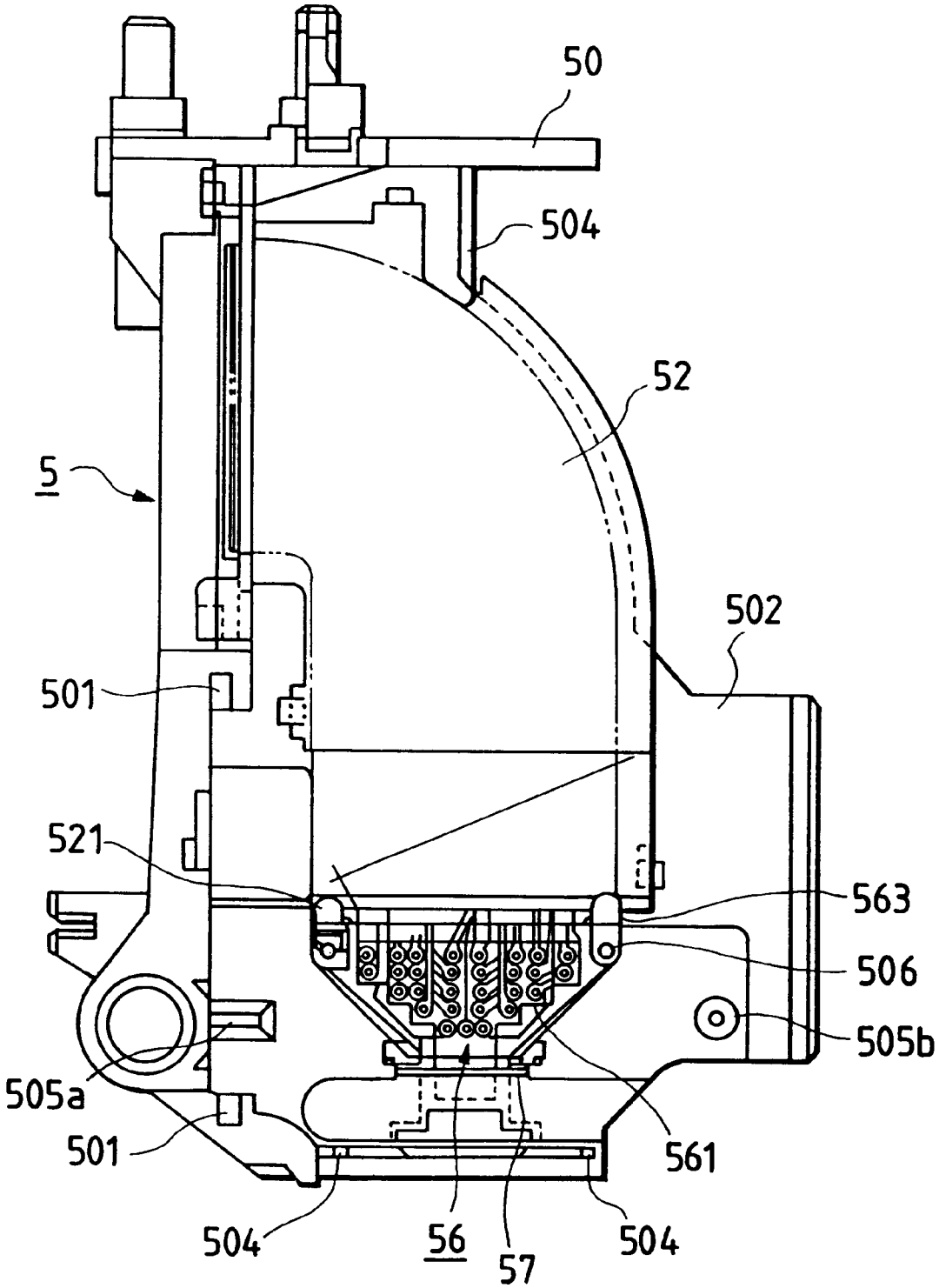
FIG. 9 is a view which shows the structure of the contact unit and the circumference thereof arranged for the carriage represented in FIGS. 6A and 6B.
Figure 10A:
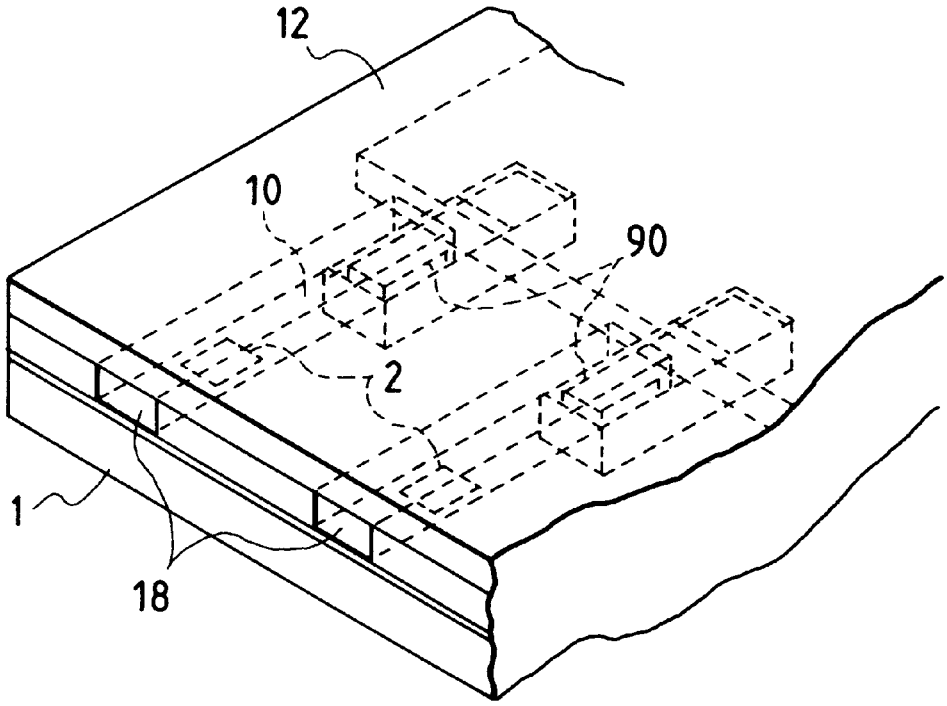
FIGS. 10A and 10B are views which illustrates the structure of liquid flow path of the conventional ink jet recording head.
Figure 10B:
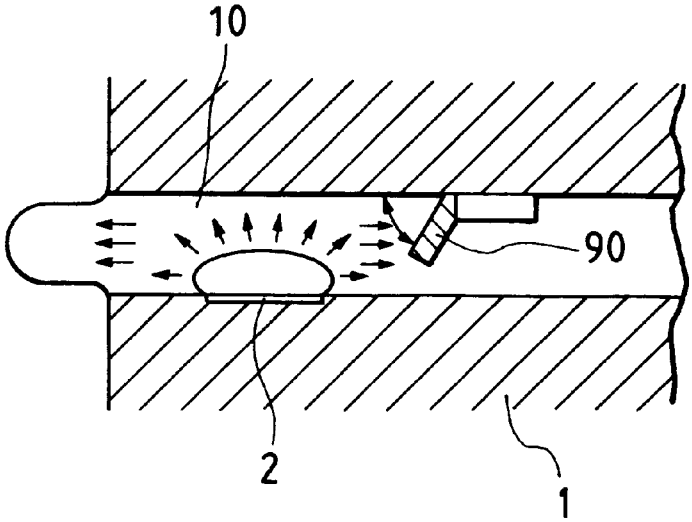

FIG. 9 is a view which illustrates the variation of the combination of the recording head (head cartridge) in accordance with the second mode embodying the present invention. As the recording head, it is assumed that the same ink jet recording apparatus as described in conjunction with FIG. 1 is adopted.

The main structure of the recording apparatus of the present mode is the same as that of the one used for the first mode embodying the invention. Therefore, the detailed description thereof will be omitted.

Figure 29:
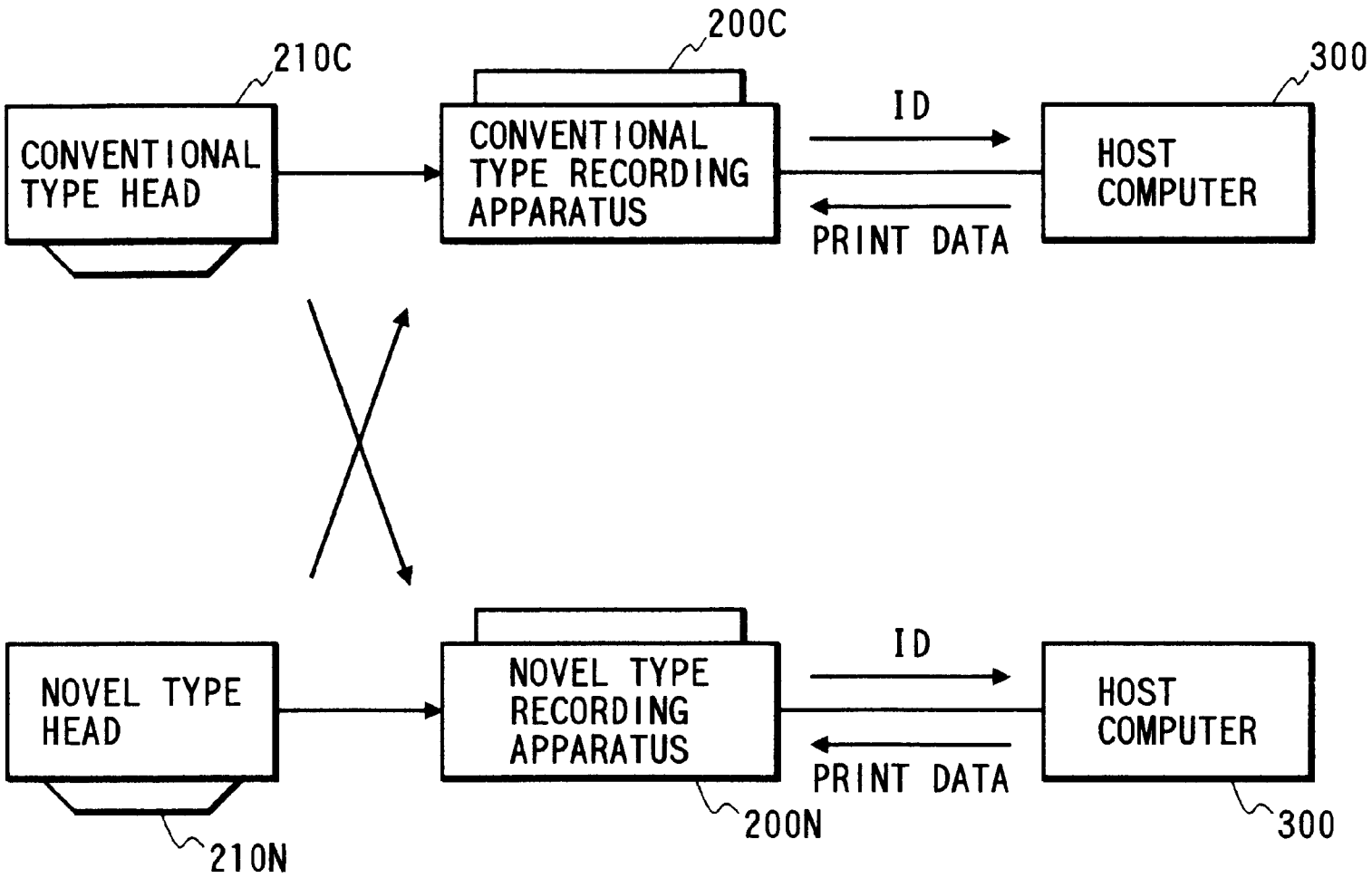
FIG. 29 is a view which shows one example of the variation of the combination of a recording head and a recording apparatus.

FIG. 29 shows the combinations of the recording heads and recording apparatuses by use of arrows as in FIG. 11 described earlier.

The conventional type recording apparatus 200C and the novel type recording apparatus 200N are connected with a host computer 300, respectively, to receive printing data from the host computer 300. These recording apparatuses 200C and 200N are arranged to be able to mount both the conventional type recording head 210C and the novel type recording head 210N. In other words, while the configurations of the conventional type recording head 210C and the carriage unit of the convectional type recording apparatus 200C are set so that the conventional type recording head 210C is made mountable on the carriage unit 5 (see FIG. 1) of the conventional type recording head 210C, the configuration of the novel type recording head 210N is made to be fitted into the carriage unit of the conventional type recording apparatus 200C. Then, the configuration of the novel type recording apparatus 200N is made to be able to receive either recording heads 210C and 210N. The difference between the conventional type and novel type of the recording apparatuses is whether the operational voltage and driving signals with respect to the head are designed on the assumption of use for the conventional one or of the most suitable use for the novel one.

Here, caution should be taken as to the fact that when the conventional type recording apparatuses are designed, none of novel type recording apparatuses exist. For designing of the conventional type hardware, any one of novel type recording heads is taken into consideration. As a result, if the novel type recording head 210N should be mounted on the conventional type recording apparatus 200C, the novel type recording head 210N should be driven in the same condition as applicable to the case where the conventional type recording head 210C is mounted or the software should be replaced to make it possible to drive the novel type recording head 210N in a condition applicable thereto (within the allowable limit of the hardware to be used).

The novel type recording head applicable to the present mode, that is, the liquid jet head based upon the new discharging principle, is the one, which is applicable to the first mode embodying the present invention as described earlier. Therefore, as one example of the novel type recording head, it is possible to apply either of the recording head of one-flow path structure (FIGS. 12A, 12B, 12C, 12D and 13) and the recording head of two-flow path structure (FIG. 17 and FIG. 18) as described earlier.

Figure 30:
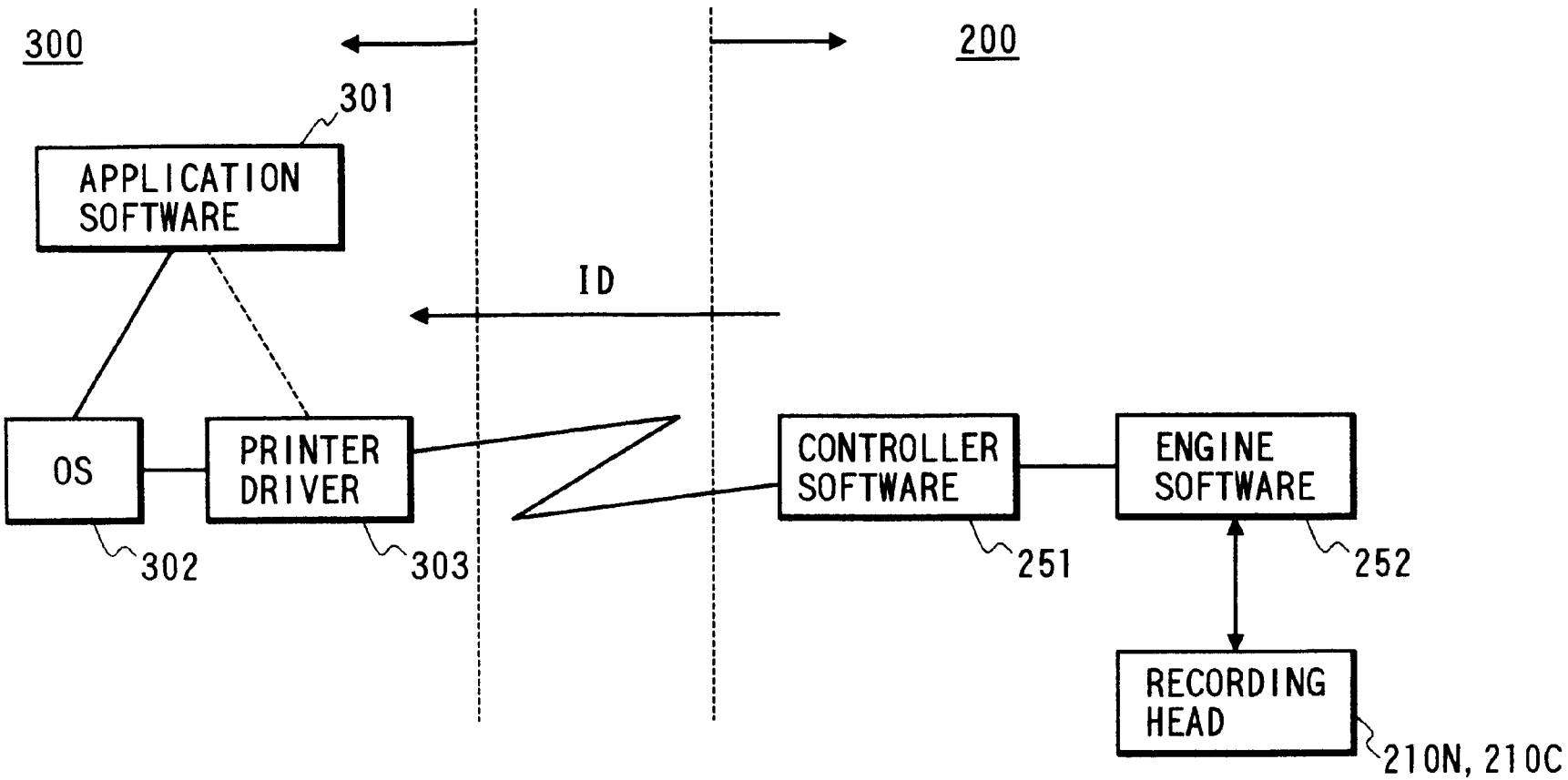
FIG. 30 is a block diagram which shows the structure of software for the ink jet recording system of one mode embodying the present invention.

Also, the structure of the applicable recording apparatus is the same as the one described with reference to FIG. 20 showing the example of the first mode embodying the present invention. Here, FIG. 30 shows the system structure of the ink jet recording system. This structure is almost the same as the one described earlier with reference to FIG. 22. However, in accordance with the present mode, the recording head 210N or 210C is integrally formed with the ink tank 220N or 220C.

In FIG. 29, the physical configurations of the recording heads (head cartridges) 210N and 210C are the same, and as described in the first mode embodying the present invention with reference to FIG. 21, the contact surface 78 is provided for either the recording heads 210N and 210C. Through this contact surface 78, the heads are connected with the recording apparatuses, respectively.

For the present mode, it is arranged to identify the type of recording head mounted on the carriage 50 by means of ID signals. In other words, of the contact points 781 of the conventional type recording head 210C for use of electric connection, some of them are set aside for such IDs of each head identification. Then, each voltage level of such contact points, which are set aside for the IDs, is read out on the apparatus main body side. In this way, it is identified whether a monochrome head is mounted or a color head is mounted. The table 2 given below shows one example in which two contact points are reserved for the ID use to identify whether the mounted head is monochrome or color.

In the table, the letter "H" indicates that the voltage level is high, and the letter "L" indicates the low level.

TABLE 2

| Point 1 | Point 2 | Judgment |
|---|---|---|
| H | H | - (not defined yet) |
| H | L | Monochrome head |
| L | H | Color head |
| L | L | Head yet to be mounted |

On the other hand, the novel type recording head 210N adopts a method for using those contact points that are reserved for the IDs of the conventional type recording heads, but yet are used extensively for the identification of the novel type recording head 210N; a method for expanding the combination yet to be defined for use thereof; or a method for reading out the contents of a non-volatile RAM through specific contact points by means of serial communication, while preparing the non-volatile RAM on the recording head 210N. A description will be provided later of the compatibility between the method for using the contact points for the IDs of the conventional type recording heads, and the method for reading out the data on the RAM serially for the IDs of the novel type recording heads.

The signal exchange between the host computer 300 and the recording apparatus 200 is the same as the one described earlier with reference to FIG. 23.

Also, in accordance with the first mode embodying the present invention, the structure is arranged so that the ID signals that notify the kinds of the recording heads and ink tanks are output to the host computer 300. For the present mode, however, only the ID signals that notify the kinds of recording heads are output to the host computer, because the structure is formed to integrate a recording head and an ink tank.

Figure 31:
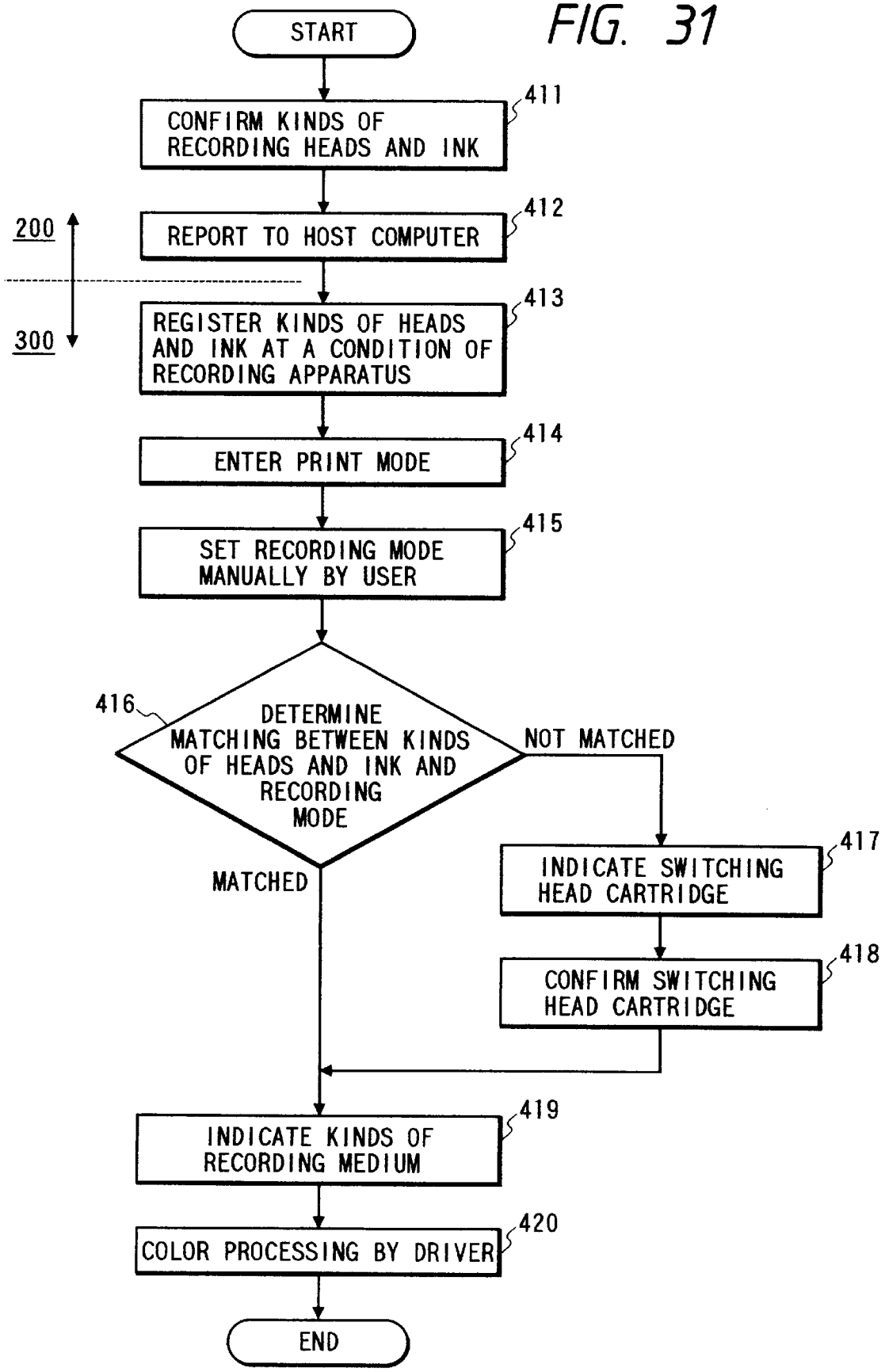
FIG. 31 is a flowchart which illustrates the operation of the ink jet recording system.

Now, in conjunction with FIG. 31, a description will be provided of the recording operation of this ink jet recording system.

At first, the recording apparatus 200 confirms the kind of mounted recording head (head cartridge) (step 411) and notifies the host computer 300 of this kind as ID signals (step 412). Then, the host computer 300 requests that the printer driver 303 should register the kind of the cartridge (recording head) as the current status of the recording apparatus (step 413). Thus, the operation enters the printing mode (step 414), and as shown in FIG. 25, the indications are shown to prompt the user to select the recording mode. The user sets the recording mode manually (step 415). At this juncture, the host computer indicates the image quality and printing time in accordance with the kinds of images to be printed, thus making it easier for the user to select the recording mode as required. For example, it should be good enough if only the relationship between the number of passes and the reduction effect of unevenness and slippage is indicated. Then, the printer driver 303 determines whether or not there is any consistency between the kind of the recording head and the recording mode (step 416). If affirmative, the process proceeds to step 419. If negative, the message shown to prompt the replacement of recording head shown in FIG. 26 (step 417). After confirming whether or not the recording head has been replaced (step 418), the process proceeds to step 419. In step 419, the kind of recording medium, which should be installed in the recording apparatus, is indicated for the user as shown in FIG. 27. After that, the printer driver 303 executes the color processing (step 420), thus terminating the process.

The outline of the color processing by means of the printer driver 303 is the same as the one described earlier with reference to FIG. 28.

The process executed by the printer driver 303 is of course performed appropriately depending on whether the novel type recording head 210N or the conventional type recording head 210C is mounted on the recording apparatus 200 as the current recording head. For example, if the novel type recording head 210N is mounted on the conventional type recording apparatus 200C, it is made possible for the novel type recording head 200N to provide the best result of recording per process described above within the allowable hardware restrictions existing by use of the conventional type recording apparatus 200C.

(Security of Compatibility between the Conventional Type and the Novel Type)

In order to secure the compatibility between the conventional type ink jet recording head, and recording apparatus, and the novel type ink jet recording head, and recording apparatus, the following aspects should be taken into consideration in particular:

(1) Method for discriminating the contact pads and the kinds of heads.

(2) Setting of condition related to the driving control.

(3) Setting of condition related to the recovery control.

(4) Setting of condition related to the printing control.

(5) Setting of condition related to the detection.

Of such aspects that should be taken into consideration, the items (2) to (5) are the same as described with respect to the first mode embodying the present invention. Here, therefore, a supplementary description will be provided of the item (1).

(1) The method for discriminating contact pads and the kinds of heads

The contact pads are arranged to be able to discriminate the mounted recording head irrespective of the conventional or novel type recording head mounted on the conventional or novel type recording apparatus. There is no problem even for the novel type recording head if discrimination is made by means of ID contact. However, it is necessary to make an arrangement so that the novel type recording head can be identified from the conventional type recording head by allowing the ID contacts to remain or by allowing a specific voltage to appear on each position of contact that is in use as the ID contact even when it is made possible that the ID signals of the novel type recording head are readable by means of serial communication. In this respect, however, the method for discriminating one recording head from another is not necessarily limited to the method that uses the contact pads. It may be possible to adopt a method that uses a mechanical switch provided for a carriage, while providing a cut-off portion in a specific position of a recording head, which is detected by the mechanical switch thus provided. Also, it should be arranged to avoid any discrepancies between the conventional and novel type recording heads as to the arrangements of signal lines, control lines and power-supply lines with respect to the contact pads. ROM or other devices may be adaptable in this respect.

(Embodiments of the Second Mode Embodying the Present Invention)

Now, a description will be provided of the examples by citing the numerical values thereof, in which good recording is performed, while maintaining the compatibility between the recording apparatuses and recording heads of the conventional and novel types. Here, the four combinations will be taken into consideration as shown in table 3. Case 1, which is for the combination of conventional types alone, and case 2, which is for the combination of novel types alone are based on the method of uses fundamentally anticipated. Case 3 and case 4, which are for the combinations of the novel type and conventional type are not the method of uses that are fundamentally anticipated, but such methods of use may take place in the market.

TABLE 3

| | Head | Apparatus |
|---|---|---|
| Case 1 | Conventional | Conventional |
| Case 2 | Novel type | Novel type |
| Case 3 | Conventional | Novel type |
| Case 4 | Novel type | Conventional |

Remarks

| | |
|---|---|
| Case 1 | Fundamental method of use (Conventional) |
| Case 2 | Fundamental method of use (Novel type) |
| Case 3 | Method of use that may take place in market |
| Case 4 | Method of use that may take place in market |

Now, hereinafter, a description will be provided of the novel type recording head using the recording head prepared in accordance with the new discharging principle shown in FIGS. 12A, 12B, 12C, 12D, 13, 14, 15, 16, 17, 18, 19A and 19B, and of the conventional type recording head using the recording head shown in FIGS. 2A, 2B, 2C, 2D and FIG. 3.

Embodiment 4

Here, using the recording head of one-flow path structure shown in FIG. 12 to FIG. 16 a description will be provided of the structure arranged to maintain the compatibility related to the driving relationship.

The conventional type recording head 210C has the performance of the resolution of 360 dpi (dpi being the dot number per 25.4 mm); the amount of ink discharge, 70 pl (one pl being $10^3$ $\mu m^3$) for black (Bk), and 40 pl for color ink (other than black); the number of nozzles, 64 for black ink, and 24 each for each of the color ink (C, M, Y); the driving frequency, 8.0 kHz; the driving voltage, 24 V; the driving pulse width, 5 $\mu$s; the block number, 16B; and the life of head, approximately 4,000 sheets of the standard source document of 5% printing density.

The conventional type recording apparatus 200C, which is designed to fit this conventional type recording head 210C, is suitably applicable to the recording method of 360×360 dpi to 720×360 dpi, with a maximum driving frequency of 8.0 kHz, a carriage driving frequency of 8.0 kHz (at the time of 360 dpi) or 4.0 kHz (at the time of 720 dpi), and a driving voltage of 24 V.

On the other hand, the novel type recording head 210N has the performance of the resolution of 360 dpi the amount of ink discharge, 70 pl for black (Bk), and 40 pl for color ink; the number of nozzles, 24 for black ink, and 24 each for each of the color ink; the driving frequency, 16.0 kHz; the driving voltage, 18 to 28 V; the driving pulse width, 3 to 6 $\mu$s; the block number, 16B; and the life of head, approximately 8,000 sheets of the standard source document of 5% printing density.

The novel type recording apparatus 200N, which is designed to fit this novel type recording head 210N, is suitably applicable to a recording method of 360×360 dpi to 720×720 dpi, with a maximum driving frequency of 20.0 kHz, a carriage driving frequency of 8.0 kHz (at the time of 360 dpi) or 4.0 kHz (at the time of 720 dpi), and a driving voltage of 18 to 24 V.

For case 1 and case 2, which are the fundamental methods of use, the printing is executed by the fundamental performance of the recording head 210N and 210C and the recording apparatuses 200N and 200C, respectively.

When the conventional type recording head 210C and the novel type recording apparatus 200N are combined (case 3), it is arranged to enable the recording apparatus 200N side to meet all the requirements. More specifically, the novel type recording apparatus 200N is made suitably applicable to a recording method of 360×360 dpi to 720×720 dpi fundamentally. However, it is used by the application of a recording method of 360×360 dpi to 720×360 dpi. Further, although the maximum driving frequency of the recording apparatus 200N is 20.0 kHz, the apparatus is used at 8.0 kHz. Likewise, the driving voltage is made 24 V. The carriage driving frequency remains as it is at 4.0/8.0 kHz. In this way, even when the conventional type recording head 210C is mounted on the novel type recording apparatus 200N, it becomes possible to execute recording.

On the other hand, when the novel type recording head 210N is mounted on the conventional type recording apparatus 200C, that is case 4, it is arranged to deal with all the requirements on the recording head 210N side. More specifically, the novel type recording head 210N is driven at the driving frequency of 8.0 kHz and the driving voltage of 24 V.

Embodiment 5

Here, as the novel type recording head, the recording head of two-flow path structure shown in FIGS. 17, 18, 19A and 19B, which is made applicable to ink of novel type composition, is adopted. Then, a description will be provided of the structure to maintain the compatibility as to the recovery relationship.

The recovery condition of the conventional type head 210C is that the suction amount thereof is 0.05 cc, and the suction amount is 0.15 cc when the recovery process is executed in mode 2. It is regulated for both cases that the suction pressure is set at 0.5 atm, and that 10 shots of pre-discharges are executed per line currently in printing, with 200 shots before and after printing, and 2,000 shots after suction, and then, wiping is performed per 10 seconds in printing, per page, and after each suction.

The conventional recording apparatus 200C capable of executing the recovery process thus regulated for the conventional type recording head 210C has a suction amount of 0.05 to 0.15 cc and a suction pressure of 0.2 to 0.5 atm. The driving frequency of pre-discharge is 2 to 4 kHz. This apparatus is capable of performing the pre-discharges of 10×N shots (N=natural number). Further, the wiping direction is one way, and the amount of intrusion is constant with the wiping speed being fixed at 100 mm/s.

The novel type recording head 210N requires the pressurized recovery of the head. As the condition of such recovery process, the amount of suction is set at 0.01 to 0.05 cc at the time of performing the recovery in mode 1, and the amount of push out is at 0.1 to 0.5 cc under pressure of the recovery process in mode 2, with the pre-discharges being five shots per line in printing, 50 shots before and after printing, and 500 shots after suction, and it is regulated that the wiping is performed per page and after suction.

The novel type recording apparatus 200N capable of the recovery process regulated for this novel type ink is provided with such pressurized recovery device, which presents a suction amount and push-out amount of 0.01 to 0.5 cc, and a suction pressure and compression pressure being 0.2 to 0.8 atm. Further, this recording apparatus 200N has a predischarge whose driving frequency is 1 to 10 kHz, and is capable of performing the pre-discharges of 20×N shots (N=natural number) and pattern discharge. Further, the wiping direction is one way, and the amount of intrusion is constant with the wiping speed being fixed at 20 to 150 mm/s.

For case 1 and case 2, which are the fundamental methods of use, the recovery processes are performed for each of the recording heads 210C and 210N described above by use of each of the recording apparatuses 200C and 200N in accordance with the recovery conditions regulated for each of the recording ink.

When the conventional type ink, the novel type recording head 210N, and the novel type recording apparatus 200N are combined (case 3), it is arranged to enable the recording apparatus 200N side to meet all the requirements. More specifically, the novel type recording apparatus 200N is arranged to perform only the suction recovery, although it is capable of executing both the suction and compress. Also, the novel type recording apparatus 200N performs the recovery process regulated in the conventional type recording head 210C.

On the other hand, when the novel type recording head 210N mounted on the apparatus is the conventional type recording apparatus 200C, the conventional type recording apparatus 200C is unable to perform the pressurized recovery. Therefore, it is impossible to execute the recovery for the novel type recording head 210N. In this case, a message is shown to indicate that the novel type recording head 210N is not usable. Even in this case 4 it is possible to perform the predischarge (the number of the predischarge is ten for each printing line) and wiping so that the novel type recording head 210N, which is not required to be recovered since it is used in other recording apparatuses immediately before, can perform printing when the head is mounted on the conventional type recording apparatus 200C.

Embodiment 6

Here, as the novel type ink, a high coloring pigmental ink is used. As the novel type recording head, the recording head of two-flow path structure shown in FIGS. 17, 18, 19A and 19B, which is applicable to this high coloring pigmental ink, is adopted. Then, a description will be provided of the structure to maintain the compatibility as to the printing control relationship.

The conventional type ink is a YMCK colorant ink whose reflection density is 1.1 each with respect to an ordinary paper sheet, and 1.3 each with respect to a paper sheet dedicated to the use of such ink. Bleeding is slightly generated. It is not provided with any water proof treatment.

The conventional recording apparatus 200C, which is designed to fit the use of conventional type ink on the premise that the conventional type recording head 210C is used, is arranged to select one or four passes for black and two or eight passes for color as the number of passes at the time of printing, with the use of a fixed mask for the execution of the usual image processing.

The novel type ink is a CMYK pigmental ink having the reflection density of 1.4 each with respect to an ordinary paper sheet, and 1.6 each with respect to a paper sheet dedicated to the use of such ink. It has no bleeding and a water proofing treatment is given to it.

The novel type recording apparatus 200N, which is designed to fit the use of this novel type ink on the premise that the novel type recording head 210N is used, is arranged to select one or two passes for black and one, two, four or eight passes for color as the number of passes at the time of printing, with the use of a fixed mask or random mask being selected depending on images for the execution of the image processing accordingly, while discriminating characters from images.

For case 1 and case 2, which are the fundamental methods of use, each of the recording apparatuses 200C and 200N executes the printing control process in accordance with the performance values of each recording apparatus, respectively.

When the conventional type recording head 210C, and the novel type recording apparatus 200N are combined (case 3), it is arranged to enable the recording apparatus 200N side to meet all the requirements. More specifically, the novel type recording apparatus 200N is arranged to select one or four passes for black and two, four or eight passes for color, with the use of a fixed mask of the two, the random mask and the fixed mask, and execute appropriate process as the image processing by discriminating characters from images. In this case, since the appropriate process is adopted, the image quality is enhanced as compared with the case using the conventional type ink, the conventional recording head 210C and the conventional recording apparatus 200C.

For case 4 where the novel type recording head 210N is mounted on the conventional type recording head 210C and the conventional type recording apparatus 200C, it is arranged for the conventional type recording apparatus 200C to select only one or four passes for black and two, four or eight passes for color, with only the fixed mask being prepared, while the image processing is limited only to the usual one. Therefore, printing is possible, but the image quality becomes inferior, among some others, as compared with the combination of the novel type ink, the novel type recording head 210N and the novel type recording apparatus 200N. Therefore, printing is performed, while notifying the user by indicating to the effect that the combination is applicable, but the image quality should be lowered.

Embodiment 7

Here, as the novel type recording head, the recording head of two-flow path structure shown in FIGS. 17, 18, 19A and 19B, which is made to transfer the IDs by means of serial communication, is adopted. Then, a description will be provided of the structure to maintain the compatibility related to the detection relationship.

The conventional type recording head 210C is structured to be capable of identifying recording heads by means of ID contacts using a fuse ROM or the like. Further, the sensor ranks are used to correct the detected values of the temperature sensor provided for the interior of the head. Also, rank resistance is used to correct the individual difference between each of the recording heads.

In this way, the conventional type recording apparatus 200C that fits the use of the conventional recording head 210C discriminates the kinds of recording heads by means of the ID contacts. At the same time, this apparatus reads out the sensor ranks through the contacts, and executes the sensor rank correction sequence in accordance with the result thus read out. Also, in order to read out the rank resistive values, the apparatus executes the sequence of rank resistance reading.

On the other hand, the novel type recording head 210N is structured to be applicable to the discrimination of the kinds of the recording heads by means of the ID serial communication, as well as to be capable of transferring the sensor ranks and rank resistance to the recording apparatus main body side.

The novel type recording apparatus 200N, which fits the use of the novel type recording head 210N, is provided with the serial communication function to receive the serial communication described above, thus checking the IDs of the recording heads by means of the serial communication. At the same time, this apparatus is structured to perform the sensor rank correction sequence and the sequence of rank resistance reading.

For case 1, which is the method of fundamental use, the conventional type recording apparatus 200C discriminates the conventional type recording head 210C by means of the ID contacts, that is, ID patterns, and also, reads out the sensor ranks through the contacts in order to execute the sensor rank correction sequence, as well as to execute the sequence of the rank resistance reading. Likewise, for case 2, which is also the method of fundamental use, the novel type recording apparatus 200N reads out from the novel type recording head 210N the IDs, sensor ranks, rank resistance, among some others, and executes the sensor rank correction sequence and the sequence of the rank resistance correction.

In the case of the combination of the conventional recording head 210C and the novel type recording apparatus 200N (case 3), it is arranged to make the recording apparatus 200N side meet all the requirements. More specifically, the novel type recording apparatus 200N is arranged to be able to discriminate the recording heads not only by means of the ID serial communication, but also, by means of the ID contacts. Then, the given data can be read out from the recording head by use of the novel type recording apparatus 200N in the same procedures as in the case of the conventional type recording apparatus.

For case 4, where the novel type recording head 210N is mounted on the conventional type recording apparatus 200C, the novel type recording head 210N is designed to allow the conventional type recording apparatus 200C to recognize the IDs (the kinds of heads) in spite of the inability of the conventional type recording apparatus 200C to deal with any serial communications. However, in general, the conventional recording apparatus 200C is not designed to be able to even read out the sensor ranks or rank resistance. Consequently, while indicating that the combination is usable, but control is not sufficient, the printing is performed.

Now, a description has been provided of the second mode embodying the present invention and the embodiments thereof. However, the present invention is also applicable to the case where the head using piezo-elements are adopted as the first ink jet recording head of the present invention.

As described above for each of the embodiments of the second mode, it is possible for the present invention to mount a first ink jet recording head that discharges ink under a first driving condition. Also, by the provision of a second ink jet recording head mountable on a second ink jet apparatus different from the first ink jet recording apparatus to discharge ink under a second driving condition different from the first driving condition with respect to the market system including the first ink jet recording apparatus having supply means for supply only the first driving condition, it is made possible for the present invention to maintain compatibility between the novel type recording head and the conventional recording apparatus or between the conventional recording head and the novel type recording apparatus, or, further, between each of the various novel type recording heads, as well as to demonstrate the effect of performing the best recording on the premise of the combination of given ink, recording heads, and recording apparatuses. By maintaining the compatibility in this way, it becomes possible to deal with the image processing, and the anticipated future improvement of coloring materials, recording media, and the like. Also, it is anticipated to facilitate the procurement of the system and enhance the selectivity thereof at lower procurement costs. There are also effects that the image quality, recording speed, and reliability are significantly enhanced, while reducing the power consumption and running costs.

Other Embodiments

As the first mode embodying the present invention, a description has been provided of the example in which the structure is arranged to make a recording head and an ink tank separable and exchangeable individually. Also, as the second mode embodying the present invention, a description has been provided of the example in which the structure is arranged to form a recording head and an ink tank together. The present invention is applicable to the mode in which each of the structures described above is combined. In other words, it is possible to apply the present invention even to the structure where a cartridge arranged to make a recording head and an ink tank separable, and a head cartridge having a recording head and an ink tank integrally formed in it are exchangeably mounted on a carriage if only the detection is made possible with respect to the structures of the mounted cartridges.

Also, for each of the embodiments of the present invention, a description has been provided of the setting of condition related to the driving control; the setting of condition related to the recovery control; the setting of condition related to the printing control; the setting of condition related to the detection operation, among some others, with respect to the types of recording head mounted on the recording apparatus 200 on the host computer 300 side when the ID signals are output to the host computer. However, it may be possible to arrange the structure so that the printer driver 303, which is the software to perform mainly the process to produce printing data and transmit them to the recording apparatus, can perform a part or all of the setting of condition related to each of the operations. As a more preferably mode, a printer driver for a plurality of recording apparatuses, such as the conventional type recording apparatus 200C and the novel type recording apparatus 200N, and each of the printer drivers for a plurality of recording apparatuses, respectively, are integrated, and then, the printer drivers are arbitrarily switched over corresponding to the recording apparatuses and recording heads connected with a host computer 300, among some other modes that may be cited.

In addition, as the mode of recording apparatuses in accordance with the present invention, it may be possible to adopt those which take the modes of image output terminals of a computer and other information processing equipment, which are integrally provided for such equipment or separately, besides those taking the modes of a copying machine combined with a reader or the like, or of a facsimile equipment provided with the function of transmission and reception.

The present invention is also applicable to a system constituted by a plurality of devices (such as a host computer, interface equipment, reader, and printer) or to an apparatus comprising a single device (such as a copying machine, or facsimile equipment). Furthermore, it goes without saying that the invention is applicable to a case where the object of the invention is attained by supplying a program to a system or an apparatus.

Also, the objectives of the present invention are of course attainable by providing the system or apparatus with the storing medium that records on it the programming codes of the software that implements the functions of the embodiments described above, thus making it possible for the computer (or CPU or MPU) of such system or apparatus to read out and execute the programming codes thus stored.

In this case, the programming codes themselves thus read out from the storing medium materialize the functions of the embodiment described above. Hence, it should be understood that the storing medium that stores such programming codes constitutes the present invention.

As the medium for the provision of the programming codes, it is possible to use a floppy disk, a hard disk, an optical disk, an optomagnetic disk, a CD-ROM, a CD-R, a magnetic tape, a non-volatile memory card, ROM, or the like.

Also, not only the functions of the embodiments described above are implemented by the execution of the programming codes read out by the computer, but also, a part or all of the actual processing is implemented by an OS (operating system) or the like that operates on the computer in accordance with such programming codes, hence the functions of the embodiments described above being materialized. It goes without saying that such case is also within the scope of the present invention.

Further, the programming codes read out from the storing medium are written on the memory provided for the extended functional board inserted into the computer or the extended functional unit connected with the computer, and then, the CPU or the like provided for such extended functional board or extended functional unit executes a part or all of the actual processing thereby to materialize the functions of the embodiments described above. Therefore, it is to be understood that such case is also within the scope of the present invention.

As many apparently widely different embodiments of the present invention can be made without departing from the spirit and scope thereof, it is to be understood that the invention is not limited to the specific embodiments thereof except as defined in the appended claims.

What is claimed is:

1. A method for standardizing an ink jet recording head for use with a first ink jet recording apparatus provided with a first ink jet recording head and for use with a second ink jet recording apparatus, comprising the step of:

providing a second ink jet recording head mountable on the first ink jet recording apparatus and capable of discharging ink under a first driving condition with respect to a market system including the first ink jet recording apparatus whose first ink jet recording head discharges ink under said first driving condition and supplying means for supplying only said first driving condition, said second ink jet recording head being mountable on the second ink jet recording apparatus, different from the first ink jet recording apparatus, having a discharging performance superior to said first ink jet recording apparatus, and discharging ink under a second driving condition different from the first driving condition.

2. A method for standardizing an ink jet recording head according to claim 1, wherein said first ink jet recording head and said second ink jet recording head are provided with an ink tank together, respectively.

3. A method for standardizing an ink jet recording head according to claim 1, wherein the second ink jet recording head is an ink jet recording head provided with discharge ports for discharging liquid, air bubble generating areas for creating air bubbles in liquid, movable members, each displaceable between a first position and a second position further away from each of the air bubble generating areas than the first position, and each of the movable members being displaced from the first position to the second position by pressure exerted by the creation of air bubbles in the air bubble generating areas, at the same time, the air bubbles being expanded larger by the displacement of the movable members on the downstream side than on the upstream side in the direction toward the discharge ports.

4. A method for standardizing an ink jet recording head according to claim 1, wherein the second ink jet recording head is provided with discharge ports for discharging liquid, heat generating elements for creating air bubbles in liquid by the application of heat, movable members, each having a free end on a discharge port side, being arranged to face each of the heat generating elements, to lead pressure to the discharge port side by displacing the free end by pressure exerted by the creation of air bubbles, a liquid flow path for supplying liquid onto the heat generating elements from the upstream side along the surface of said movable members nearer to said heat generating elements.

5. A method for standardizing an ink jet recording head according to claim 1, wherein the second ink jet recording head comprises: a first liquid flow path conductively connected with a discharge port; a second liquid flow path having an air bubble generating area provided with a heat generating element for creating air bubbles in liquid by the application of heat; and a movable member arranged between the first liquid flow path and the air bubble generating area to face the heat generating element, having a free end on a discharge port side to lead pressure to a discharge port side by displacing said free end to the first liquid flow path side by pressure exerted by the creation of air bubbles.

6. A method for standardizing an ink jet recording head according to claim 1, wherein the second ink jet recording apparatus is provided with a mounting unit to exchangeably mount each of the first and second ink jet recording heads, and the mounting unit includes a carriage to move an ink jet recording head mounted on the mounting unit in a direction parallel to the surface of a recording medium.

7. A method for standardizing an ink jet recording head according to claim 1, wherein the second ink jet recording apparatus is provided with a mounting unit to exchangeably mount each of the first and second ink jet recording heads, and the mounting unit has a contact surface for making electrical connection with an ink jet recording head mounted on the mounting unit.

8. A method for standardizing an ink jet recording head according to claim 7, wherein each of the first and second ink jet recording heads is provided with a contact surface capable of making electrical connection with the contact surface provided for the mounting unit.

9. A method for standardizing an ink jet recording head according to claim 8, wherein the first ink jet recording head enables the mounting of the first ink jet recording head to be recognized by causing a given voltage to appear on specific contacts formed on a contact surface thereof.

10. A method for standardizing an ink jet recording head according to claim 8, wherein the second ink jet recording head enables the mounting of the second ink jet recording head to be recognized by reading out data by serial transfer from specific contacts formed on a contact surface thereof.

11. A method for standardizing an ink jet recording head according to claim 10, wherein said second ink jet recording head is provided with a temperature detection sensor and ranking means for holding values for use of correction of characteristics, and when mounted on the mounting unit, measured values of the sensor and values for use of the correction of characteristics are read out by the serial transfer.

12. A method for standardizing an ink jet recording head according to claim 1, wherein the second ink jet recording apparatus is provided with a mounting unit capable of exchangeably mounting each of the first and second ink jet recording heads, and in accordance with a kind of the ink jet recording head mounted on the mounting unit, at least one of a driving frequency, a driving voltage, and a width of a driving pulse is changed.

13. A method for standardizing an ink jet recording head according to claim 1, wherein said second ink jet recording apparatus is provided with a mounting unit capable of exchangeably mounting each of the first and second ink jet recording heads, and recovery means for executing compressing and suction recovery for ink jet recording heads, and in accordance with a kind of a mounted ink jet recording head, whether recovery by only suction or recovery by compression and suction is selected.

14. A method for standardizing an ink jet recording head according to claim 1, wherein the second ink jet recording apparatus is provided with a mounting unit capable of exchangeably mounting each of the first and second ink jet recording heads, and in accordance with a kind of a mounted ink jet head, the contents of image processing for recording is changed.

15. An ink jet recording head used for an ink jet recording system provided with a mounting unit capable of exchangeably mounting ink jet recording heads, discriminating means for discriminating the kind of the ink jet recording head mounted on said mounting unit, and at least means for setting an optimal recording condition within an allowable range in accordance with the kind of the discriminated ink jet recording head, wherein said ink jet recording head comprises:

a contact surface engaging with a contact surface provided for said mounting unit to make electrical connection therewith, and wherein at least information regarding the kind of the ink jet recording head is transferred to the ink jet recording system by serial data communication through specific contacts on said contact surface.

16. An ink jet recording head according to claim 15, wherein said ink jet recording head is provided with a temperature detection sensor and ranking means for holding values for use of correction of characteristics, and wherein measured values measured by said sensor and a value for use of correction of characteristics are transmitted by serial transfer.

17. An ink jet recording method for an ink jet recording system to form images on a recording medium by discharging ink from a discharge port provided for an ink jet recording head of the ink jet recording system, comprising the following steps of:

providing an ink jet recording system comprising:

a mounting unit capable of exchangeably mounting at least two kinds of ink jet recording heads, the two kinds of ink jet recording heads comprising a first ink jet recording head having first recording characteristics, and a second ink jet recording head having second recording characteristics different from the first recording characteristics, and discriminating means for discriminating a kind of ink jet recording head mounted on the mounting unit; and recording images on the recording medium with the ink jet recording system in accordance with the result of discrimination by the discriminating means under an optimal recording condition selected among restrictive conditions in accordance with the combination of the ink jet recording head mounted on the mounting unit and the ink jet recording system.

18. An ink jet recording method according to claim 17, wherein the first recording characteristics are relatively superior to the second recording characteristics, and if said ink jet recording system cannot demonstrate recording characteristics of said first ink jet recording head completely, recording is made, while an indication is given to a user accordingly.

19. An information processing apparatus used for executing a method for standardizing an ink jet recording head and used for outputting printing data to an ink jet recording apparatus including a mounting unit, for mounting first and second ink jet recording heads, the first ink jet recording head discharging ink under a first driving condition when mounted to a first ink jet recording apparatus, the second ink jet recording head discharging ink under the first driving condition when mounted to the first ink jet recording apparatus and discharging ink under a second driving condition when mounted to a second ink jet recording apparatus, the second ink jet recording apparatus having a discharging performance superior to the first ink jet recording apparatus, said information processing apparatus comprising:

a printer driver for receiving from said ink jet recording apparatus information regarding a kind of an ink jet recording head mounted on said mounting unit; and means for executing image processing in accordance with a kind of ink jet recording head mounted on said mounting unit.

20. An information processing apparatus according to claim 19, wherein said printer driver converts RGB data into CMYK data by said image processing as printing data, and outputs them to said ink jet recording apparatus.

21. A method for standardizing an ink jet recording head and an ink tank for use with a first ink jet recording apparatus detachably mounting a first ink jet recording head and a first ink tank retaining a first ink supplied to the first ink jet recording head and for use with a second ink jet recording apparatus, comprising the steps of:

providing a second ink jet recording head different from the first ink jet recording head; and providing a second ink tank retaining a second ink supplied to the second ink jet recording head, wherein the second ink tank is detachably mountable on the second ink jet recording apparatus, different from the first ink jet recording apparatus with respect to a market system including the first ink jet recording apparatus, the second ink jet recording head being made capable of discharging the second ink by mounting the second ink tank, and having discharging performance superior to said first ink jet recording head, and also, being capable of discharging the first ink by mounting the first ink tank, and the second ink being discharged by the second ink jet recording head, and having characteristics superior to the first ink, and also, being discharged by the first ink jet recording head when the first ink jet recording head mounts the second ink tank.

22. A method for standardizing an ink jet recording head and an ink tank according to claim 21, wherein said second ink jet recording head is an ink jet recording head provided with discharge ports for discharging liquid, air bubble generating areas for creating air bubbles in liquid, movable members, each displaceable between a first position and a second position further away from each of said air bubble generating areas than said first position, and each of said movable members being displaced from said first position to said second position by pressure exerted by the creation of air bubbles in said air bubble generating areas, at the same time, said air bubbles being expanded larger by the displacement of said movable members on the downstream side than on the upstream side in the direction toward said discharge ports.

23. A method for standardizing an ink jet recording head and an ink tank according to claim 21, wherein said second ink jet recording head is provided with discharge ports for discharging liquid, heat generating elements for creating air bubbles in liquid by the application of heat, movable members, each having a free end on a discharge port side, being arranged to face each of said heat generating elements, to lead pressure to the discharge port side by displacing said free end by pressure exerted by said creation of air bubbles, a liquid flow path for supplying liquid onto said heat generating elements from an upstream side along a surface of said movable members nearer to said heat generating elements.

24. A method for standardizing an ink jet recording head and an ink tank according to claim 21, wherein said second ink jet recording head comprises:

a first liquid flow path conductively connected with a discharge port;

a second liquid flow path having an air bubble generating area provided with a heat generating element for creating air bubbles in liquid by application of heat; and a movable member arranged between said first liquid flow path and said air bubble generating area to face said heat generating element, having a free end on a discharge port side to lead pressure to the discharge port side by displacing said free end to the first liquid flow path side by pressure exerted by said creation of air bubbles.

25. A method for standardizing an ink jet recording head and an ink tank according to claim 21, wherein said d second ink jet recording apparatus s is provided with a mounting unit to exchangeably mount each of said first and second ink jet recording heads, and said mounting unit includes a carriage to move an ink jet recording head mounted to said mounting unit in a direction parallel to a surface of a recording medium.

26. A method for standardizing an ink jet recording head and an ink tank according to claim 21, wherein said second ink jet recording apparatus is provided with a mounting unit to exchangeably mount each of said first and second ink jet recording heads, and said mounting unit has a contact surface for making electrical connection with an ink jet recording head mounted to said mounting unit.

27. A method for standardizing an ink jet recording head and an ink tank according to claim 26, wherein each of said first and second ink jet recording heads is provided with a contact surface capable of making electrical connection with the contact surface provide ed for said mounting unit, and information regarding a kind of ink tank mounted on said first or second ink jet recording head is read out through said contact surface of said first and second recording heads.

28. A method for standardizing an ink jet recording head and an ink tank according to claim 21, wherein said second ink jet recording apparatus is provided with a mounting unit for mounting each of said first and second ink jet recording heads, and in accordance with a kind of ink tank installed on an ink jet recording head mounted on said mounting unit, at least one of a driving frequency, a driving voltage, and a width of a driving pulse is changed with respect to an ink jet recording head mounted on said mounting unit.

29. A method for standardizing an ink jet recording head and an ink tank according to claim 21, wherein said second ink jet recording apparatus is provided with a mounting unit for mounting each of said first and second ink jet recording heads, and in accordance with a kind of ink jet recording head mounted on said mounting unit and a kind of ink tank installed on an ink jet recording head mounted on said mounting unit, at least one of a driving frequency, a driving voltage, and a width of a driving pulse is changed with respect to an ink jet recording head mounted on said mounting unit.

30. A method for standardizing an ink jet recording head and an ink tank according to claim 21, wherein said second ink jet recording apparatus is provided with a mounting unit capable of mounting each of said first and second ink jet recording heads, and recovery means for executing compression and suction recovery for ink jet recording heads, and in accordance with a kind of the ink tank installed on an ink jet recording head mounted on said mounting unit, whether the recovery by only suction or recovery by compression and suction is selected with respect to an ink jet recording head mounted on said mounting unit.

31. A method for standardizing an ink jet recording head and an ink tank according to claim 21, wherein said second ink jet recording apparatus is provided with a mounting unit capable of mounting each of said first and second ink jet recording heads, and recovery means for executing compression and suction recovery for the first and second ink jet recording heads, and in accordance with a kind of the ink jet recording head mounted on said mounting unit and a kind of ink tank installed on an ink jet recording head mounted on said mounting unit, whether recovery by only suction or recovery by compression and suction is selected with respect to an ink jet recording head mounted on said mounting unit.

32. A method for standardizing an ink jet recording head and an ink tank according to claim 21, wherein said second ink jet recording apparatus is provided with a mounting unit capable of mounting each of said first and second ink jet recording heads, and in accordance with a kind of ink tank installed on an ink jet recording head mounted on said mounting unit, the contents of image processing for recording is changed.

33. A method for standardizing an ink jet recording head and an ink tank according to claim 21, wherein said second ink jet recording apparatus is provided with a mounting unit capable of mounting each of said first and second ink jet recording heads, and in accordance with a kind of ink jet recording head mounted on said mounting unit and a kind of ink tank installed on an ink jet recording head mounted on said mounting unit, the contents of image processing for recording is changed.

34. An ink jet recording method for an ink jet recording system to form images on a recording medium by discharging ink from a discharge port provided for an ink jet recording head of the ink jet recording system having an ink tank being made separable and exchangeable therefor, comprising the following steps of:

providing an ink jet recording system comprising:

a mounting unit capable of exchangeably mounting of at least two kinds of ink jet recording heads, the at least two kinds of ink jet recording heads comprising a first ink jet recording head having first recording characteristics, and a second ink jet recording head having second recording characteristics different from said first recording characteristics, and discriminating means for discriminating a kind of the ink jet recording head mounted on the mounting unit and a kind of ink tank installed on said ink jet recording head; and recording the images on the recording medium using the ink jet recording system in accordance with a result of discrimination by said discriminating means under an optimal recording c condition selected among restrictive conditions in accordance with the combination of an installed ink tank and the ink jet recording head mounted on the mounting unit and the ink jet recording system.

35. An ink jet recording method according to claim 34, wherein the first recording characteristics are relatively superior to the second recording characteristics, and if said ink jet recording system cannot demonstrate the recording characteristics of said first ink jet recording head and/or the characteristics of ink retained in an ink tank installed on said first ink jet recording apparatus completely, recording is made, while an indication is given to a user accordingly.

36. An information processing apparatus used for executing a method for standardizing an ink jet recording head and an ink tank, and used for outputting printing data to an ink jet recording apparatus including a mounting unit for mounting first and second ink jet recording heads, the first ink jet recording head detachably mounting a first ink tank with first ink therein and a second ink tank with second ink therein and discharging the first ink when the first ink tank is mounted thereon and discharging the second ink when the second ink tank mounted thereon, the second ink jet recording head detachably mounting the first and second ink tanks and discharging the first ink when the first ink tank is mounted thereon and discharging the second ink when the second ink tank is mounted thereon, said second ink jet recording head having discharging performance superior to said first ink jet recording head and said second ink having characteristics superior to the first ink, said information processing apparatus comprising:

a printer driver for receiving from said ink jet recording apparatus information regarding a kind of ink jet recording head mounted on said mounting unit, and a kind of ink tank installed on an ink jet recording head mounted on said mounting unit; and means for executing image processing in accordance with the kind of the ink jet recording head mounted on said mounting unit and the kind of ink tank installed on said ink jet recording apparatus.

37. An information processing apparatus used f or executing a method for standardizing an ink jet recording head and an ink tank, and used for outputting printing data to an ink jet recording apparatus including a mounting unit for mounting first and second ink jet recording heads, the first ink jet recording head detachably mounting a first ink tank with first ink therein and a second ink tank with second ink therein and discharging the first ink when the first ink tank is mounted thereon and discharging the second ink when the second ink tank is mounted thereon, the second ink jet recording head detachably mounting the first and second ink tanks and discharging the first ink when the first ink tank is mounted thereon and discharging the second ink when the second ink tank is mounted thereon, said second ink jet recording head having discharging performance superior to said first ink jet recording head and said second ink having characteristics superior to the first ink, said information processing apparatus comprising:

a printer driver for receiving from said ink jet recording apparatus information regarding a kind of ink tank installed on an ink jet recording head mounted on said mounting unit; and means for executing image processing in accordance with a kind of ink tank installed on an ink jet recording head mounted on said mounting unit.

38. An information processing apparatus according to claim 36, wherein said printer driver converts RGB data into CMYK data by image processing as printing data, and outputs them to said ink jet recording apparatus.

39. A host apparatus for transferring signals including recording data with a connected recording apparatus, said recording apparatus exchangeably mounting a plurality of recording heads, comprising:

receiving means for receiving signals related to a kind of connected recording apparatus and the kind of recording head mounted on said recording apparatus;

means for generating image data corresponding to images to be recorded by said recording apparatus;

output means for outputting to said recording apparatus said image data and signals to control said recording apparatus; and control means for changing at least one of image data and the signals to control said recording apparatus in accordance with signals related to the kind of said recording head received by said receiving means.

40. A method for controlling a recording apparatus connected to a host apparatus for transferring signals including recording data with the recording apparatus, the recording apparatus exchangeably mounting a plurality of recording heads, said method comprising the following steps of:

receiving signals related to the kind of a recording apparatus connected to the host apparatus and a kind of a recording head mounted on the recording apparatus with receiving means;

generating image data corresponding to images to be recorded by the recording apparatus;

changing at least one of image data and the signals to control the recording apparatus in accordance with signals related to the kind of recording head received by the receiving means; and outputting to the recording apparatus the image data and signals to control the recording apparatus.

41. A method for controlling the recording apparatus of a host apparatus according to claim 40, where in said host apparatus is provided with storing means for storing a control program to control the connected recording apparatus, and wherein said generating of image data, the signals to control said recording apparatus, and the changes of said image data and control signals, are processed by said control program.

* * * * *

UNITED STATES PATENT AND TRADEMARK OFFICE

CERTIFICATE OF CORRECTION

PATENT NO. : 6,116,716
DATED : September 12, 2000
INVENTOR(S) : Tajika et al.

It is certified that error appears in the above-identified patent and that said Letters Patent is hereby corrected as shown below:

[56] References Cited:

U.S. PATENT DOCUMENTS, the following should be inserted:

| | | |
|---|---|---|
| --4,480,259 | 10/1984 | Kruger et al. |
| 4,723,129 | 2/1988 | Endo et al. |
| 5,033,887 | 7/1991 | Baurele |
| 5,235,351 | 8/1993 | Koizumi |
| 5,278,585 | 1/1994 | Karz et al.--. |

FOREIGN PATENT DOCUMENTS, the following should be inserted:

| | | |
|---|---|---|
| --55-81172 | 06/1980 | Japan |
| 61-69467 | 04/1986 | Japan |
| WO 88/02310 | 04/1998 | WIPO |
| 63-199972 | 08/1988 | Japan |
| 0 315 417 | 05/1989 | EPO |
| 0 436 047 | 07/1991 | EPO |
| 5-124189 | 05/1993 | Japan |
| 0 560 562 | 09/1993 | EPO |
| 0 571 093 | 11/1993 | EPO |
| 6-155758 | 06/1994 | EPO |
| 0 627 323 | 12/1994 | EPO |
| 0 650 837 | 05/1995 | EPO |
| 0 765 754 | 04/1997 | EPO |
| 0 765 762 | 04/1997 | EPO |
| 0 769 381 | 04/1997 | EPO--. |

COLUMN 11:

Line 62, "These" should read --This--.

COLUMN 12:

Line 9, "liquid" should read --liquids--.

UNITED STATES PATENT AND TRADEMARK OFFICE

CERTIFICATE OF CORRECTION

PATENT NO. : 6,116,716
DATED : September 12, 2000
INVENTOR(S) : Tajika et al.

It is certified that error appears in the above-identified patent and that said Letters Patent is hereby corrected as shown below:

COLUMN 16:
Line 36, "illustrates" should read --illustrate--.
Line 60, "illustrates" should read --illustrate--.

COLUMN 18:
Line 13, "convectional" should read --conventional--.

COLUMN 37:
Line 9, "convectional" should read --conventional--.

COLUMN 49:
Line 45, "ink jet" should read --ink tank and an ink jet--.
Line 46, "and an ink tank" should be deleted.

COLUMN 50:
Line 48, "d" should be deleted.

COLUMN 52:
Line 56, "f or" should read --for--.

Signed and Sealed this

Nineteenth Day of June, 2001

Nicholas P. Godici

*Attest:*

*Attesting Officer*

NICHOLAS P. GODICI
*Acting Director of the United States Patent and Trademark Office*